United States Patent [19]

Runyan et al.

[11] 4,009,789

[45] Mar. 1, 1977

[54] MACHINE FOR FEEDING STACKED ARTICLES

[75] Inventors: Kenneth R. Runyan, Dayton; Quentin E. Honnert, Cincinnati; Ronald H. Porter, Milford, all of Ohio

[73] Assignee: Multifold-International, Inc., Milford, Ohio

[22] Filed: June 27, 1975

[21] Appl. No.: 590,966

Related U.S. Application Data

[62] Division of Ser. No. 437,167, Jan. 28, 1974, Pat. No. 3,907,273.

[52] U.S. Cl. ..... 214/6 S; 271/221

[51] Int. Cl.[2] ..... B65H 31/40

[58] Field of Search ..... 214/6 S, 6 C; 271/210, 271/221; 93/36 SQ

[56] References Cited

UNITED STATES PATENTS

| | | | |
|---|---|---|---|
| 2,940,613 | 6/1960 | Prentice et al. | 214/6 S X |
| 3,239,944 | 3/1966 | Gebert | 271/210 X |
| 3,596,776 | 8/1971 | Melin | 214/6 S |
| 3,643,939 | 2/1972 | Nussbaum et al. | 271/221 X |
| 3,656,743 | 4/1972 | Ruud | 271/210 X |
| 3,724,089 | 4/1973 | Thompson et al. | 214/6 S X |
| 3,842,995 | 10/1974 | Dooley | 214/6 S |

*Primary Examiner*—L. J. Paperner
*Attorney, Agent, or Firm*—James W. Pearce; Roy F. Schaeperklaus

[57] ABSTRACT

A machine which takes upright stacks of flat articles such as carton blanks or the like from a pallet, straightens each stack, and feeds the articles from the stack in a shingled stream. The machine includes a crane which is programmed to pick up stacks from a plurality of locations on the pallet. Each stack is transferred to a conveyor which first advances the stack to a stack straightening device which tips the stack from upright to horizontal position to separate articles in the stack and straightens and centers the stack. The stack is then restored to upright position on the conveyor and is advanced to elevators which raise the stack against a pick-off belt which withdraws articles from the top of the stack in a stream shingle-fashion. The stream is directed around a drum which inverts the articles in the stream, and the stream is discharged.

5 Claims, 40 Drawing Figures

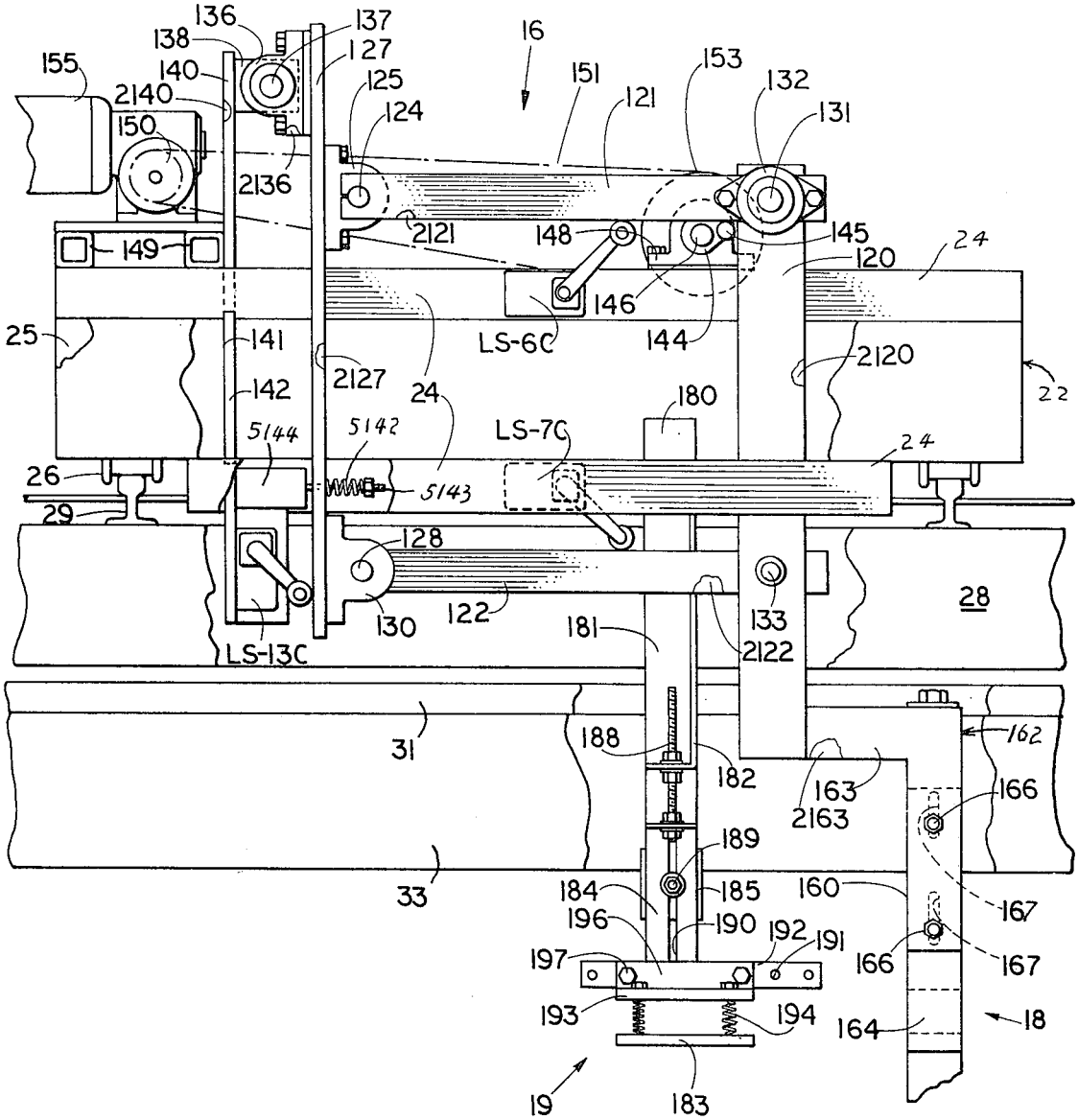
FIG. 5
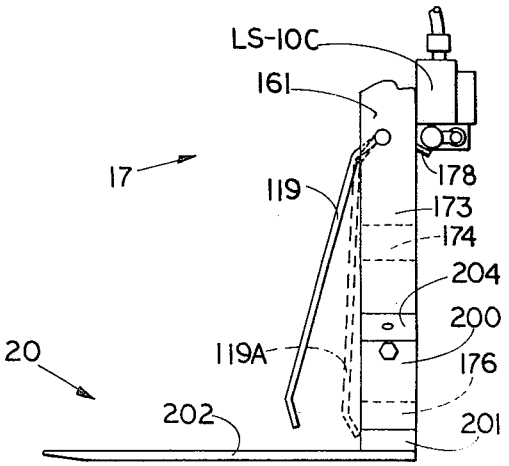

464
465
495
2068
496
430
431
642
635
643
646
75
80
58R
65
85
567
499
497
51
565
59
484
482
505
69
490
488
492
493
416
415
515
544
73
539
533
560
563
561
LS-9F
558
535
557
562
LS-3F
532
505
58
492
491
502
501
61
518
481
480
483
485
485
76
551
519
520
522
502
529
518
530
78
512
546
LS-7F
556
547
LS-8F
555
550
LS-10F
494
55
566
76
537
56
62
52

OPERATOR SIDE 26
68
496
790
784
495
782
430
431
785
783
768
767
710
771
712
787
775
706
777
708
769
773
571
570
597
598
75
83
608
573
2576
581
87
81
578
580
655
575
652
667
653
600
80
576
670
669
675
19A
663
673
668
662
674
651
665
567
659
485
483
85
58
76
487
482
664
480
481
78
20
557
LS-9F
484
562
522
560
561
522
523
541
540
563
73
539
507
69
526
502
514
518
515
508
519
505
488
LS-3F
547
553
492
491
529
546
LS-8F
LS-7F
520
511
524
528
20
550
537
530
501
55
10
62
52
56

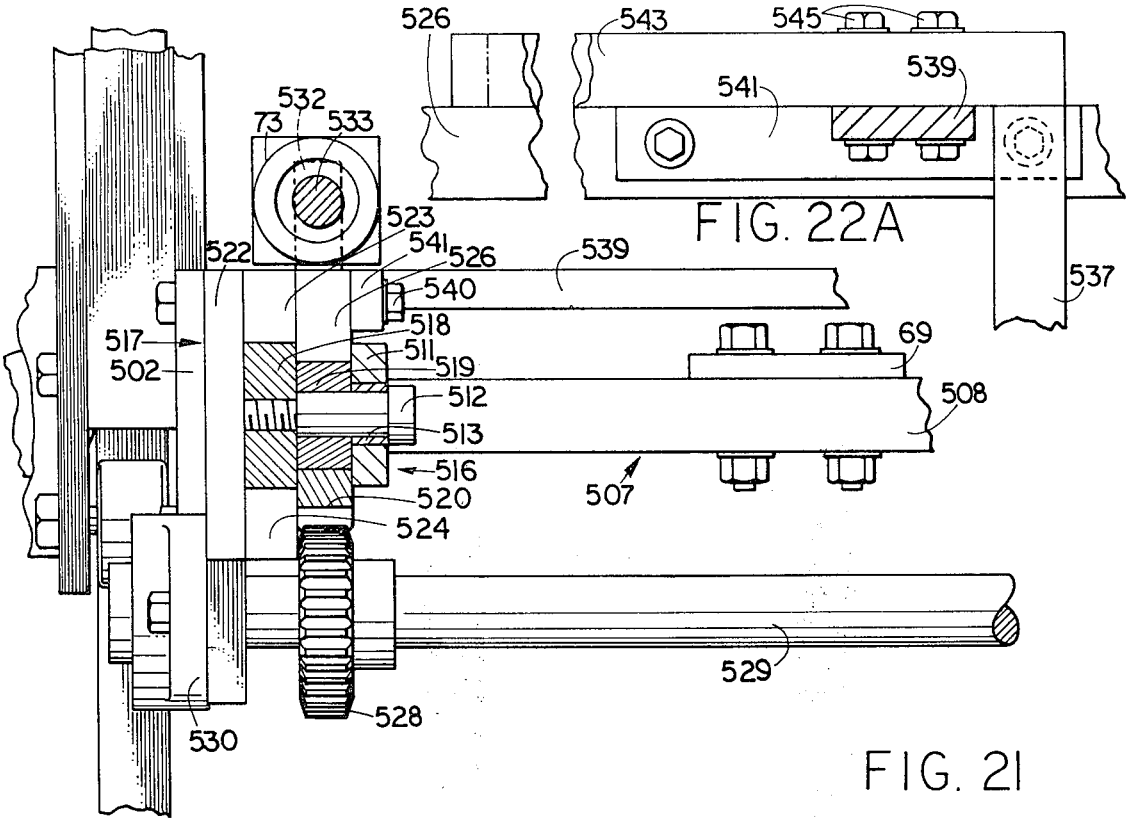
FIG. 22A
FIG. 21
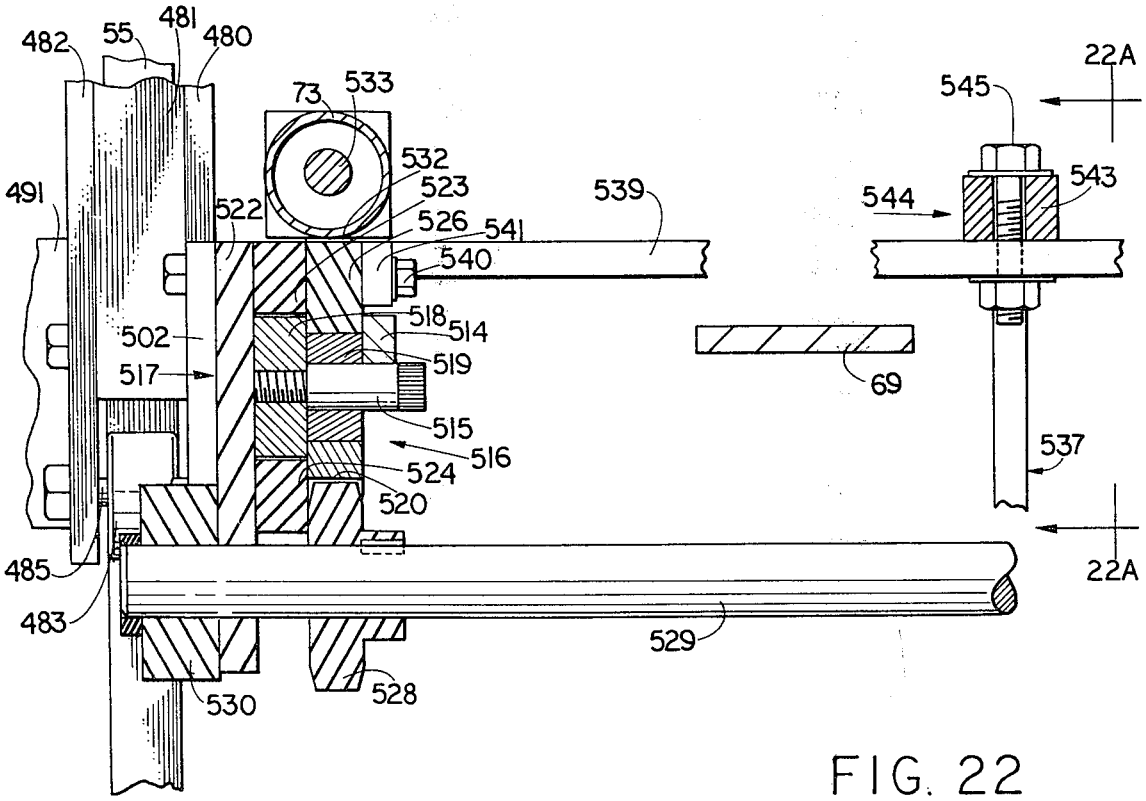
FIG. 22

| | A | B | C | D | E | F | G | H | I | J | K | L | M | N | O | P | Q | R | S | T | U | V | W | X |
|---|---|---|---|---|---|---|---|---|---|---|---|---|---|---|---|---|---|---|---|---|---|---|---|---|
| 1 | | | | | | | | | | | | | | X | X | X | X | X | X | X | X | X | X | X |
| 2 | | | | | | | X | X | | | X | X | | | | | | | | | | | | |
| 3 | | | | | | | | | | | | | | | X | | | | | | | | | |
| 4 | X | | | | | | | X | | | | | | | | | | | | | | | | |
| 5 | | | | | X | | | | | | | X | | | | | | | | | | | | |
| 6 | | | | | | | | | | | X | | X | | | | | | | | | | | |
| 7 | | | | | | | X | | X | | | | | | | | | | | | | | | |
| 8 | | X | | X | | X | | | | X | | | | | | | | | | | | | | |
| 9 | | | X | | | | | | | | | | | | | | | | | | | | | |
| 10 | | | | | | X | | | | | | | | | | | | | | | | | | |
| 11 | | | | | | | | | | | | | | | | | | | | | | | | |
| 12 | | | | | | | | | | | | | | | | | | | | | | | | |
| 13 | | | | | | | | | | | | | | | | | | | | | | | | |
| 14 | | | | | | | | | | | | | | | | | | | | | | | | |
| 15 | X | | | | | | | | | | | | | | | | | | | | | | | |
| 16 | | | | | | | | X | | | | | | | | | | | | | | | | |
| 17 | | | | | X | | | | | | | X | | | | | | | | | | | | |
| 18 | | | | | | | | | | | | | X | | | | | | | | | | | |
| 19 | | | | | | | X | | | | X | | | | | | | | | | | | | |
| 20 | | | | | | | | | X | | | | | | | | | | | | | | | |
| 21 | | | | X | | | | | | X | | | | | | | | | | | | | | |
| 22 | | X | | | | X | | | | | | | | | | | | | | | | | | |
| 23 | | | | | | | | | | | | | | | | | | | | | | | | |
| 24 | | | | | | | | | | | | | | | | | | | | | | | | |

FIG. 32

MACHINE FOR FEEDING STACKED ARTICLES

This is a division of our copending application Ser. No. 437,167, filed Jan. 28, 1974, now U.S. Pat. No. 3,907,273.

This invention relates to a machine for transferring flat articles from a stack into a flowing steam of articles in a shingled relation.

An object of this invention is to provide a machine which can transfer a stack of articles from a skid or the like to elevators which raise the stack to a pick-off device which feeds the articles off the top of the stack in shingled relation.

A further object of this invention is to provide such a machine which inverts the articles as the articles are fed from the pick-off device.

A further object of this invention is to provide such a machine in which the stack is swung from upright position to horizontal position before it is advanced to the elevator to permit inspection and straightening of sides of the stack and removal of misformed or deformed articles.

A further object of this invention is to provide such a machine in which a stack which has been straightened is advanced to and held at a standby station adjacent the elevator while a preceding stck is being discharged and is advanced to the elevator when the elevator is ready to receive the stack.

Briefly, this invention provides a machine which includes a crane which lifts stacks of flat articles such as carbon blanks or the like from a skid. The crane is arranged to progressively pick up stacks from the skid, one at a time. The crane raises a selected stack from the skid and moves the stack to a transfer table at which the stack is lowered onto transfer belts. The transfer belts move the stack in one direction onto a tip-over or tilt table which swings the stack from the upright or horizontal position to permit inspection of the stack and removal of improperly formed or deformed cartons from the stack. At the tilt table, stack straightening pads move against sides of the stack to straighten the stack. Then, the tilt table returns the stack to upright position and the stack is advanced to a standby position where the stack waits until an elevator is ready to receive the stack. When the stack is advanced to the elevator, the elevator raises the stack against a pick-off device which feeds carton blanks off the top of the stack in overlapping shingled relation. The carbon blanks are advanced around a drum which inverts the shingled carton blanks and the carton blanks are discharged in a shingled stream.

The above and other objects and features of the invention will be apparent to those skilled in the art to which this invention relates from the following detailed description and the drawings, in which:

FIG. 5 is a view in side elevation of a crane structure of the machine looking in the direction of the arrows 5—5 in FIG. 2, parts being broken away to reveal details of structure;

Figure 2:
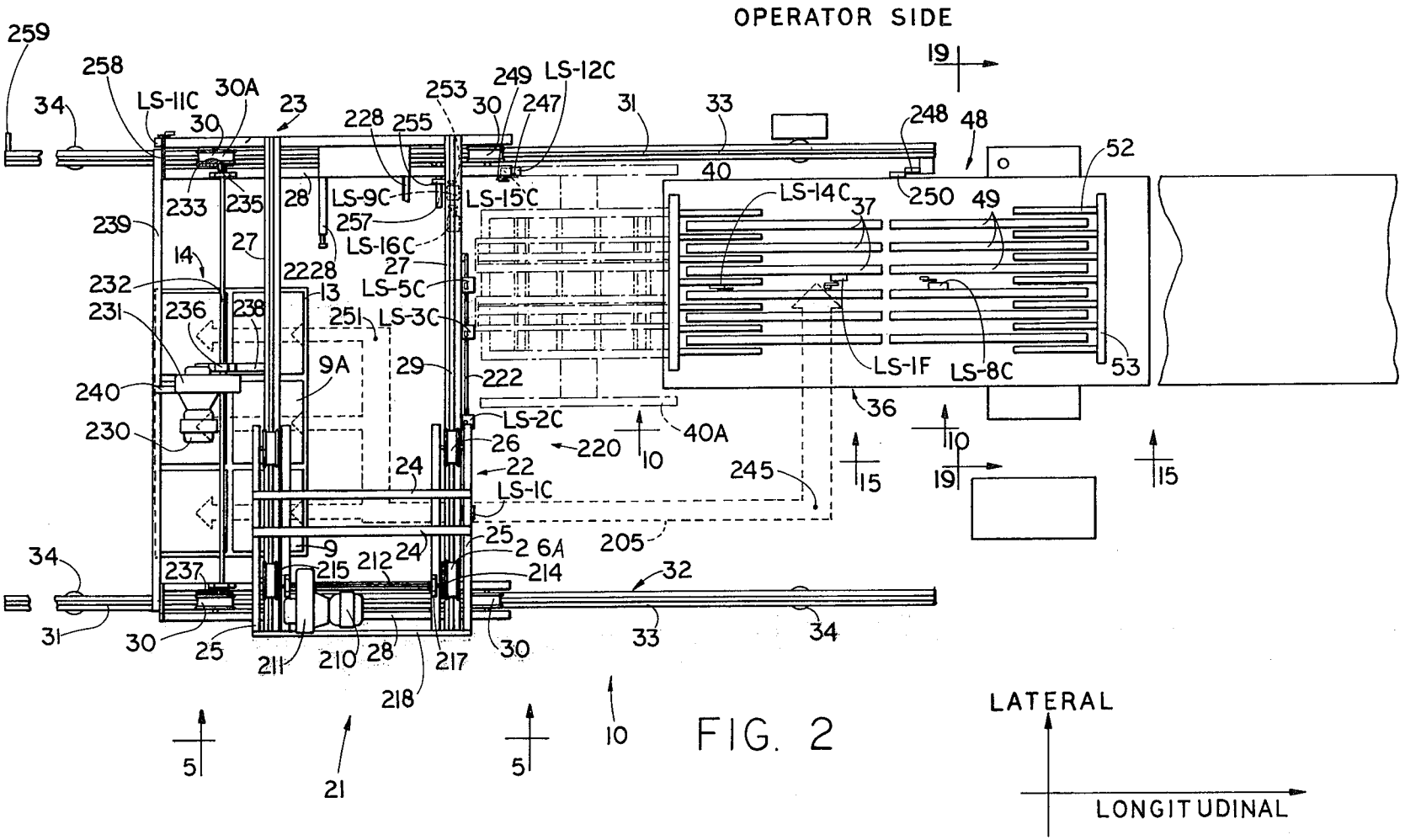
FIG. 2 is a somewhat schematic plan view of a crane area and a transfer table of the device, the path of a crane being shown in dashed lines, the tip-over table being shown in full lines in raised position and in dash-dot lines in lowered position.
Figure 15:
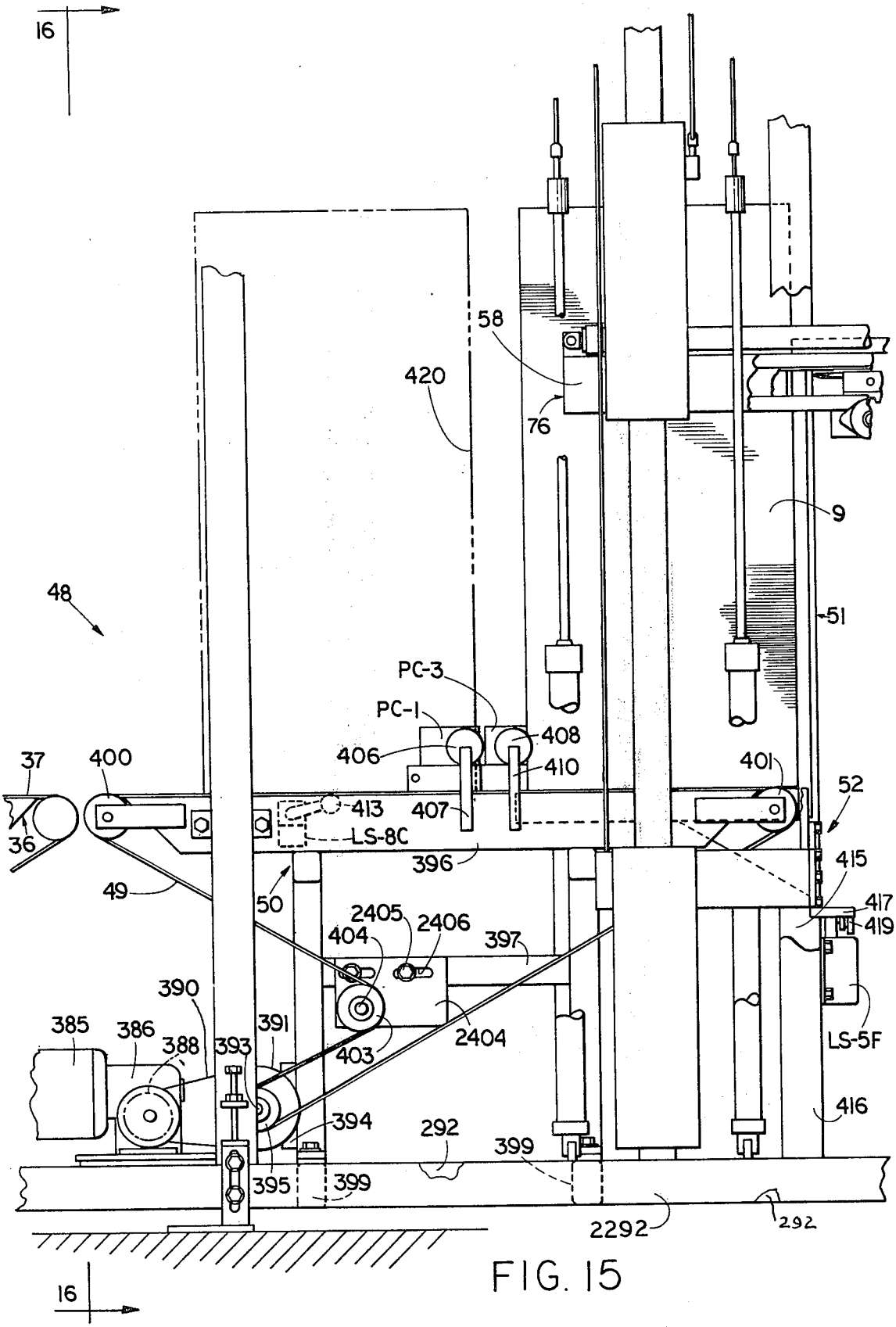
Figure 16:
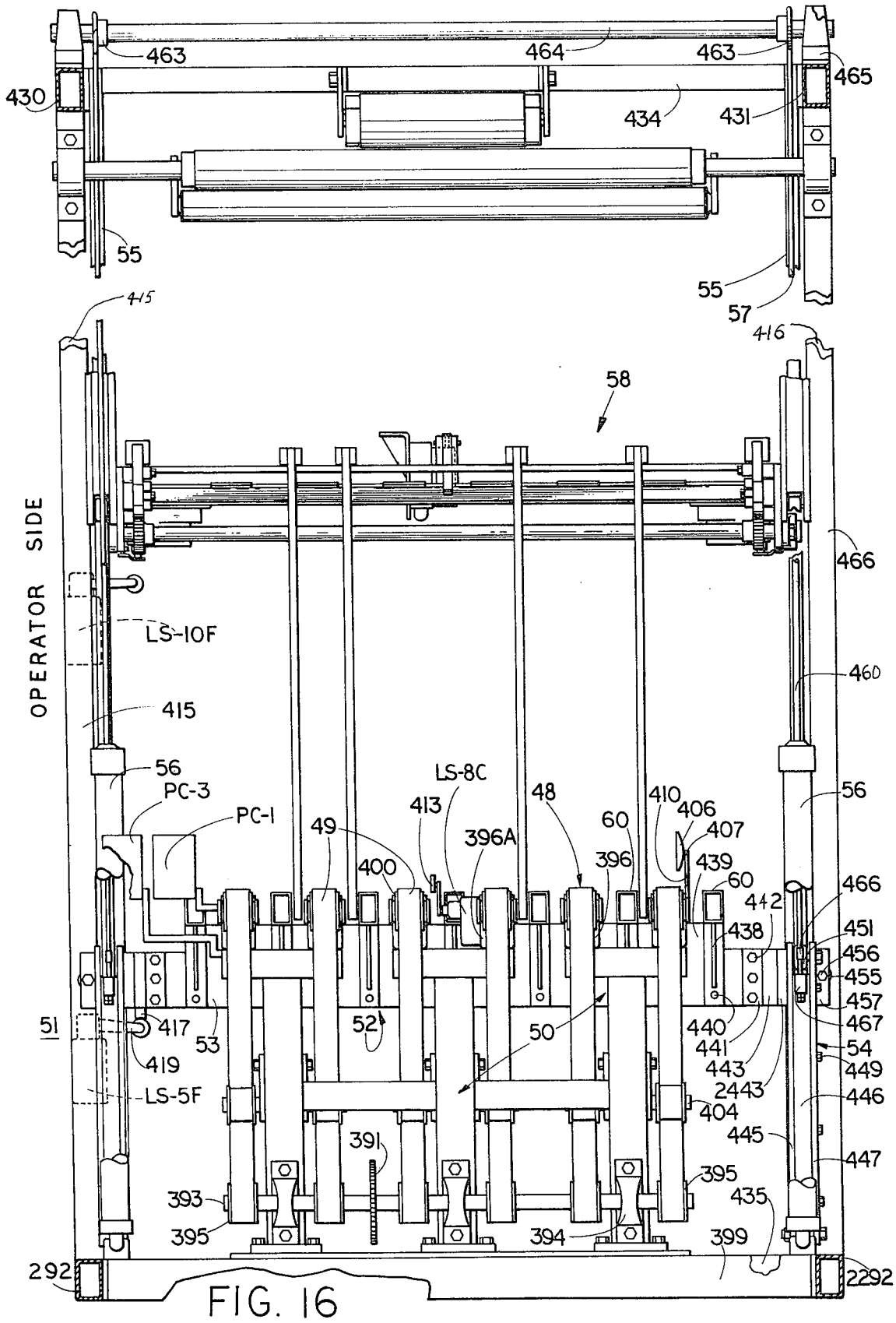
Figure 17:
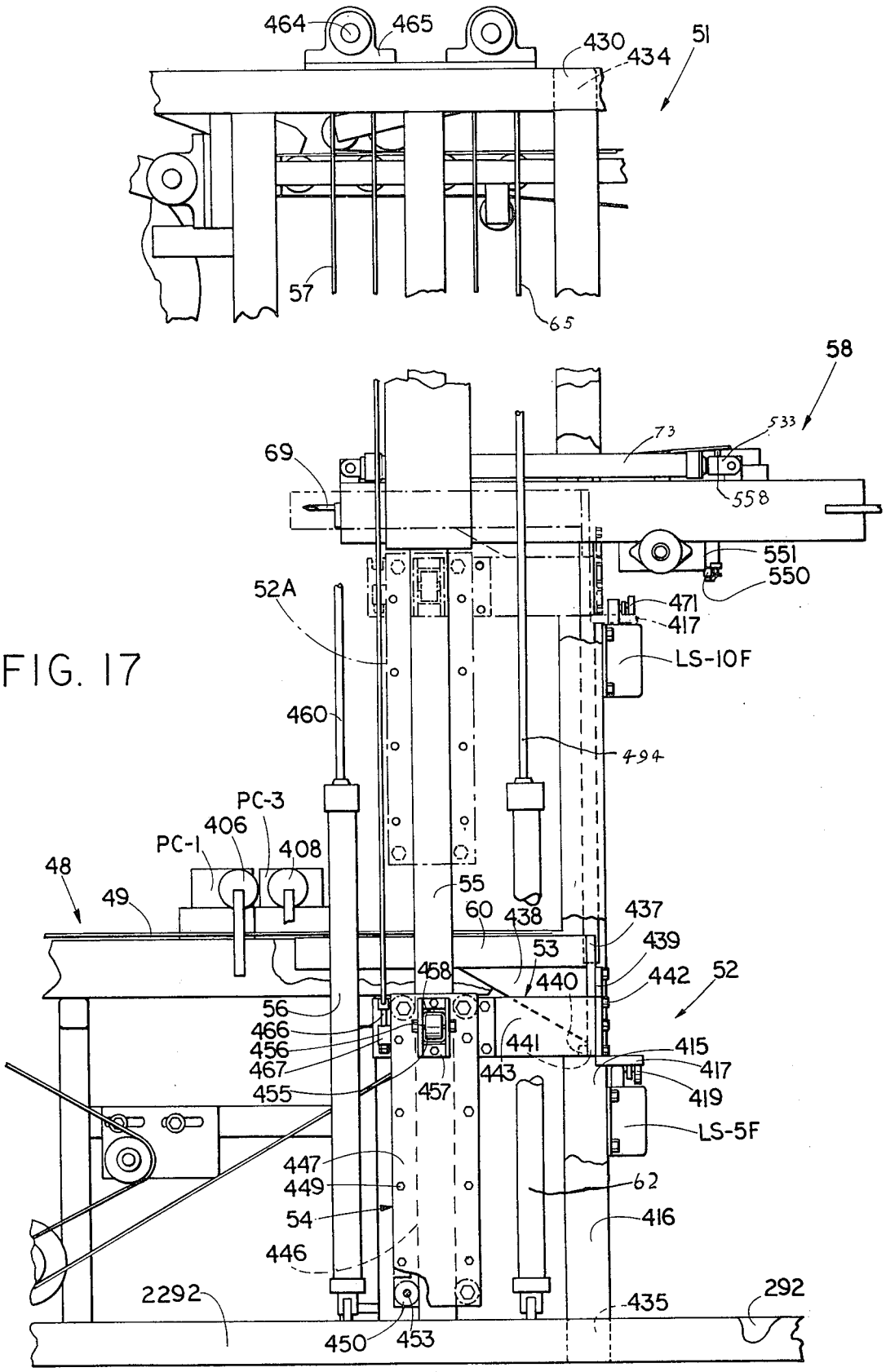
Figure 18:
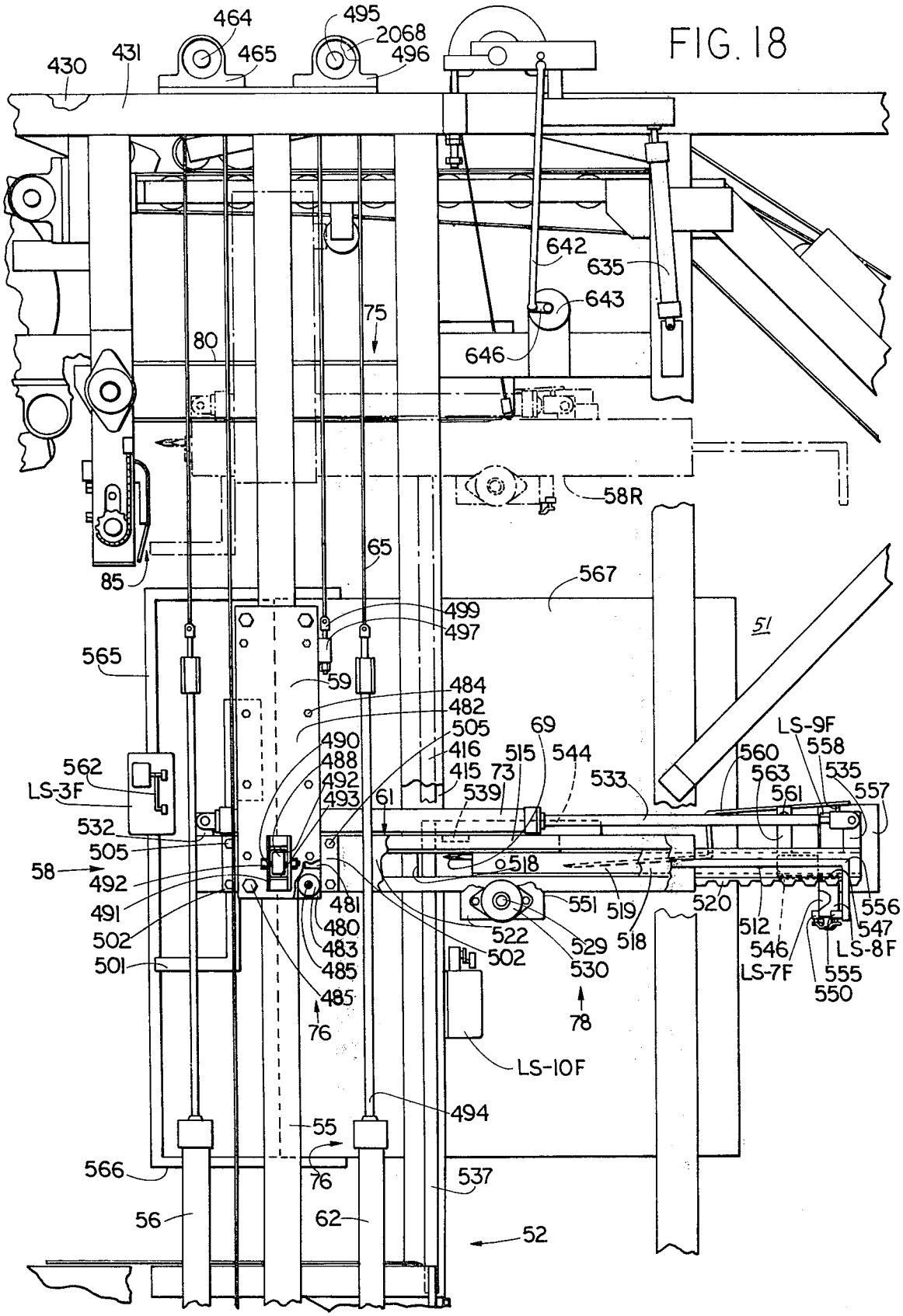
Figure 19:
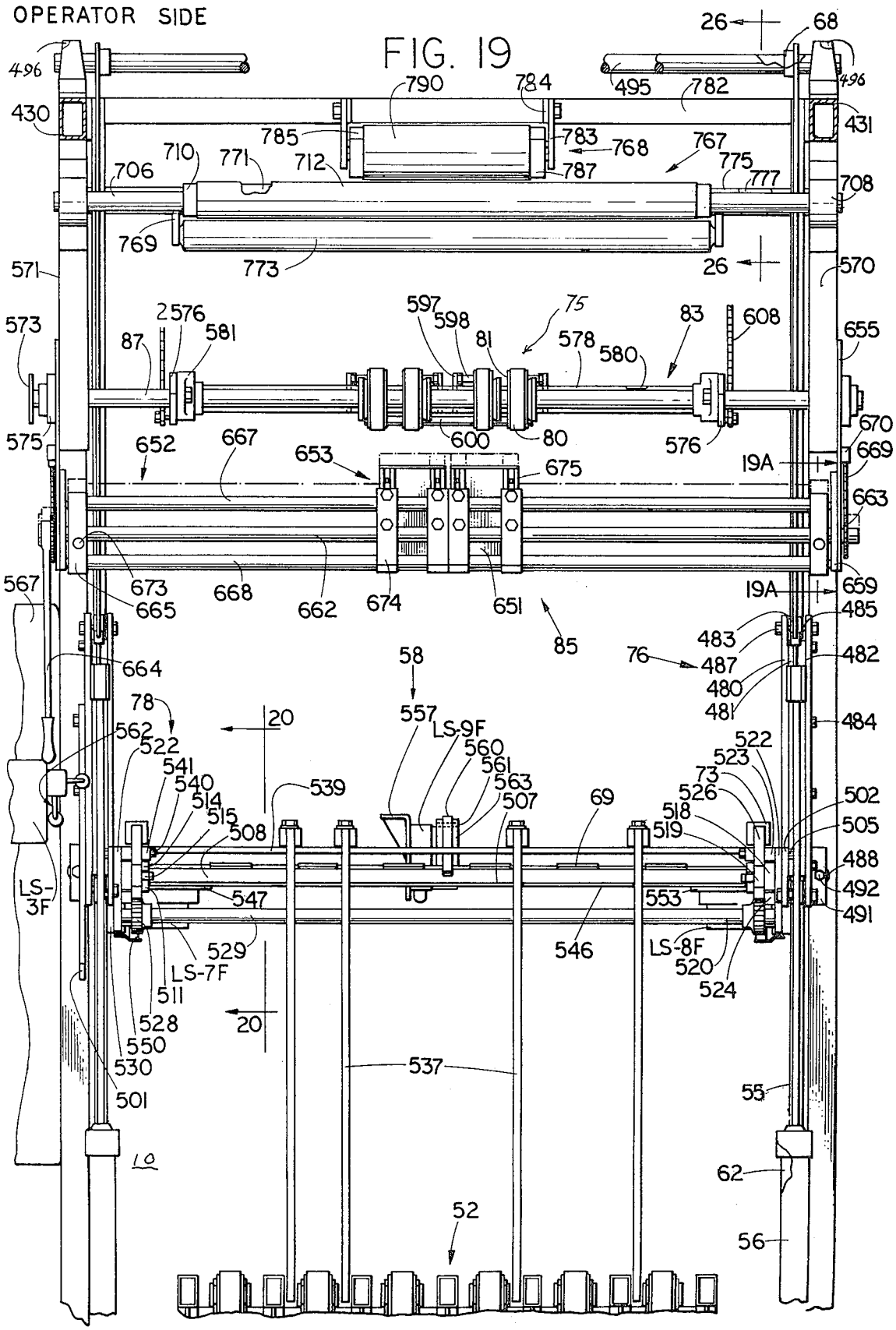
Figure 19A:
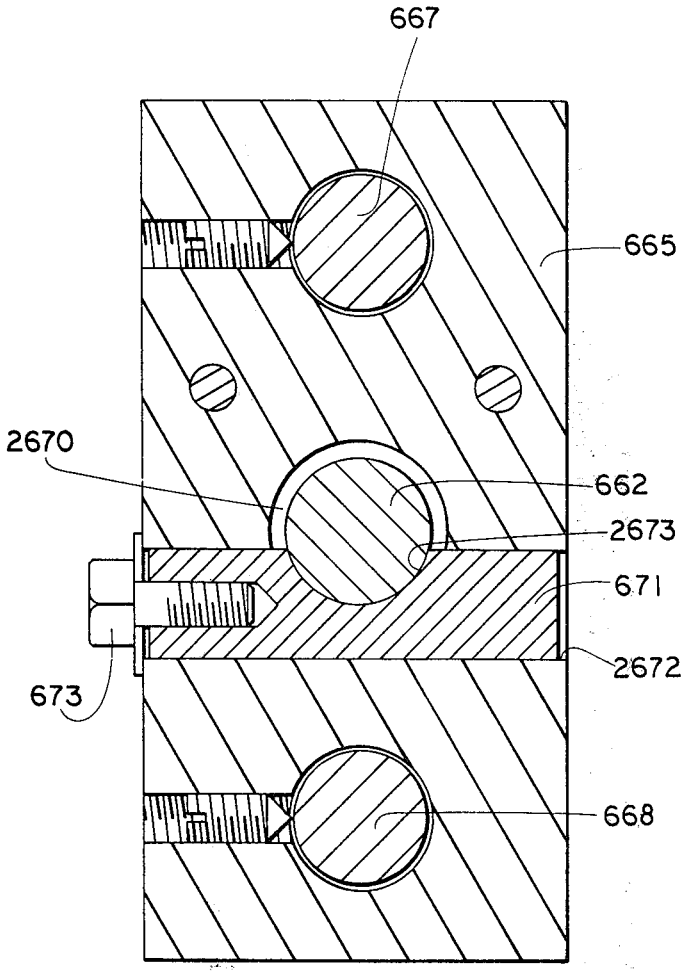
Figure 20:
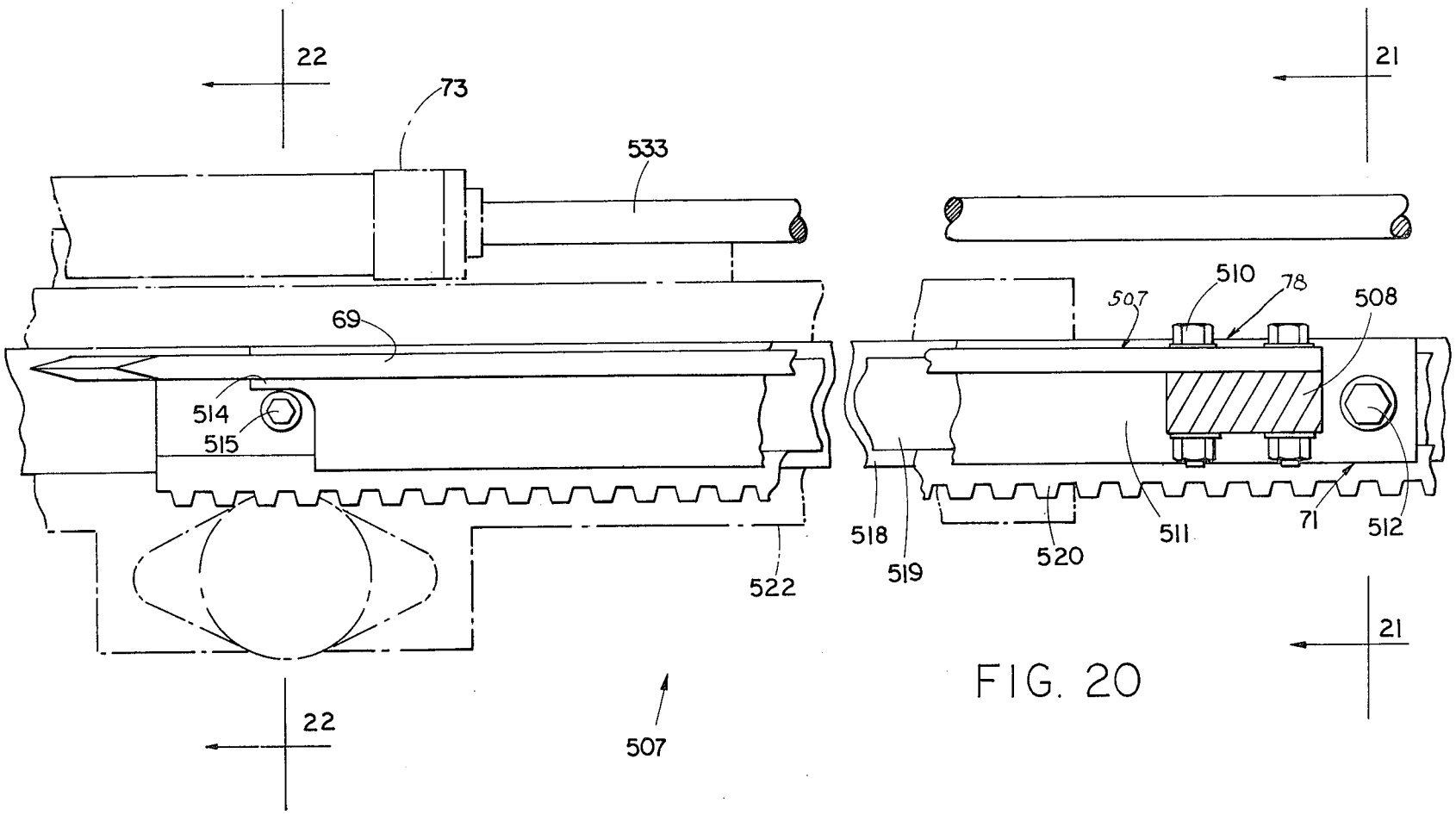
Figure 23:
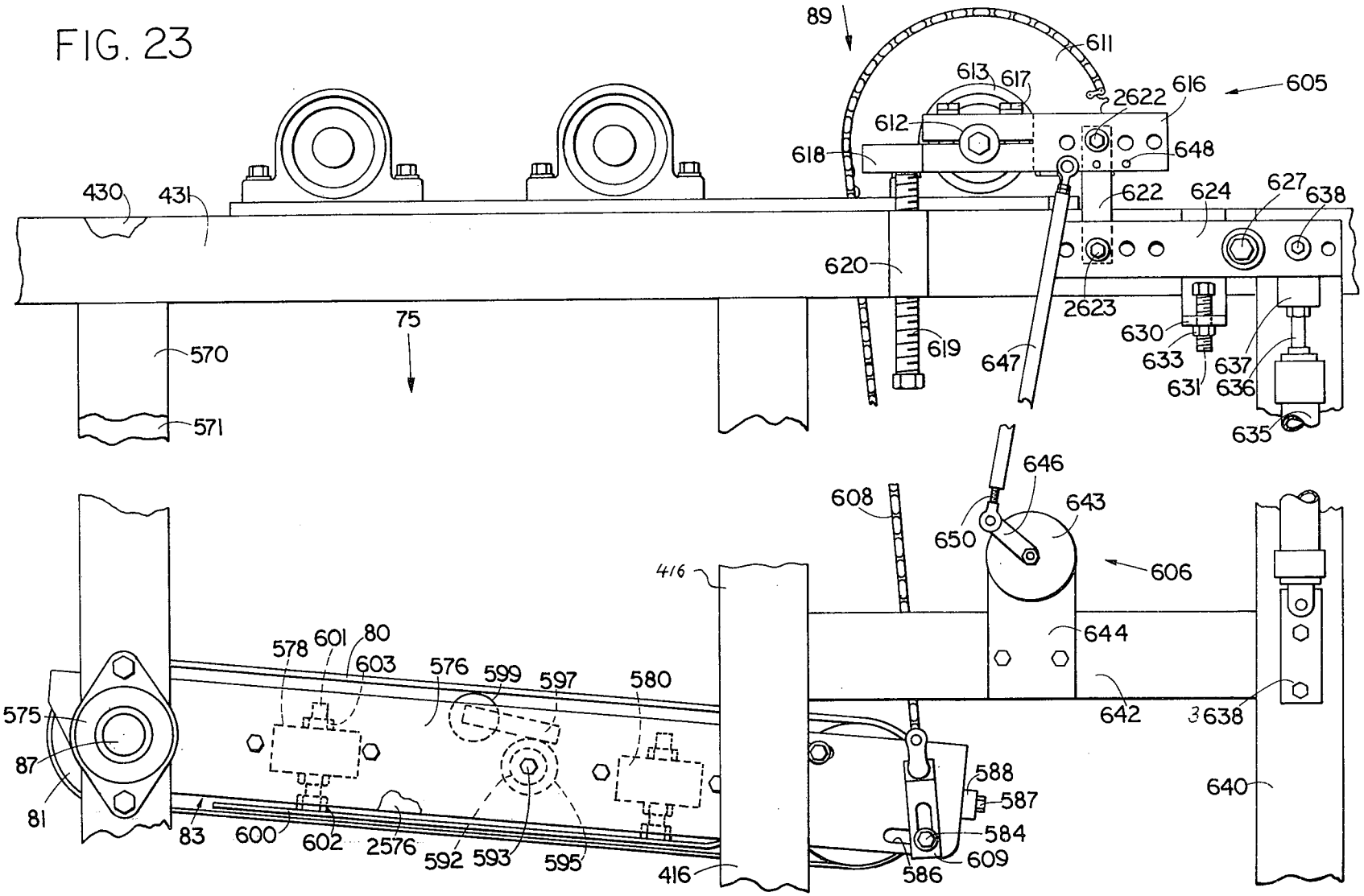
Figure 24:
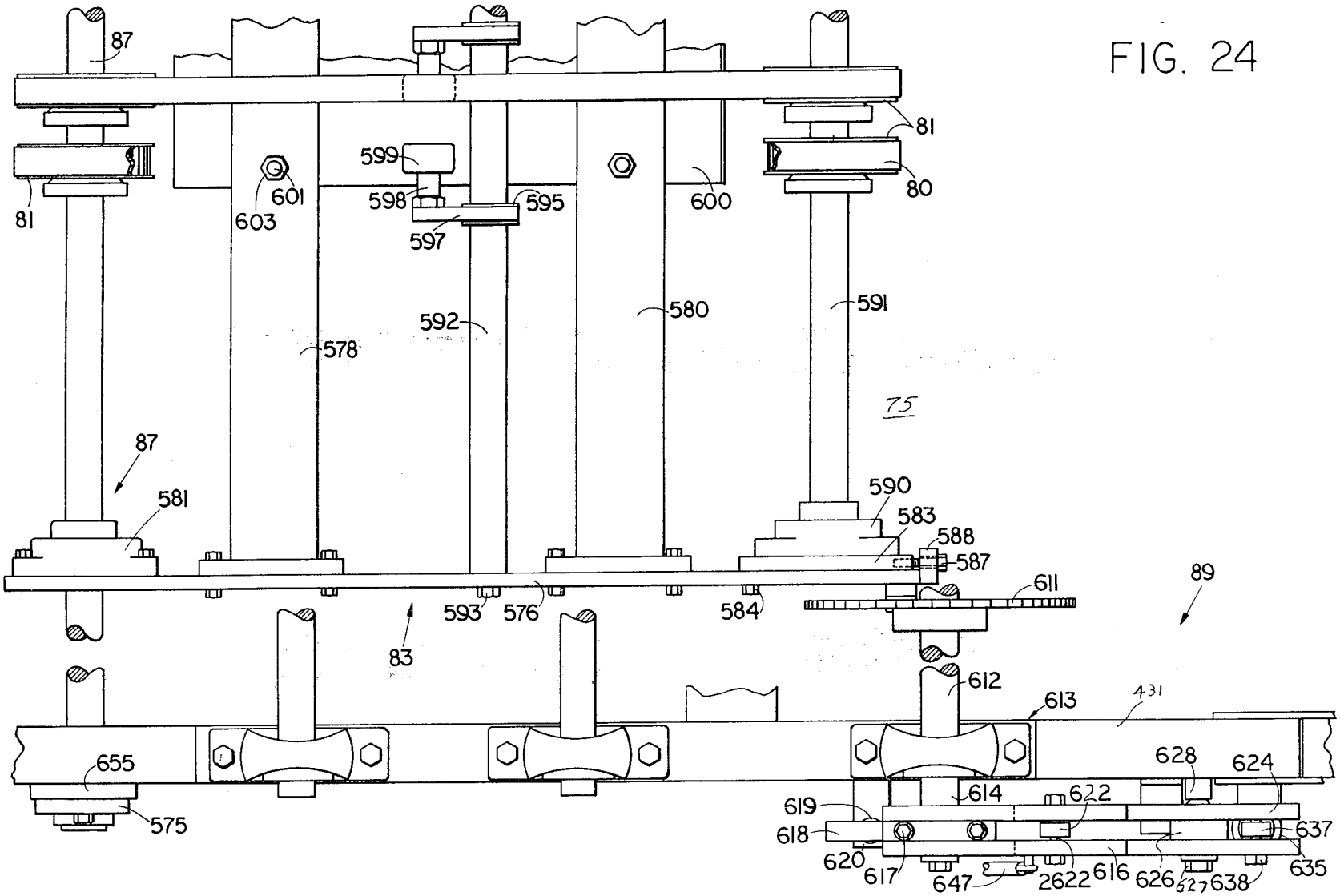
Figure 25:
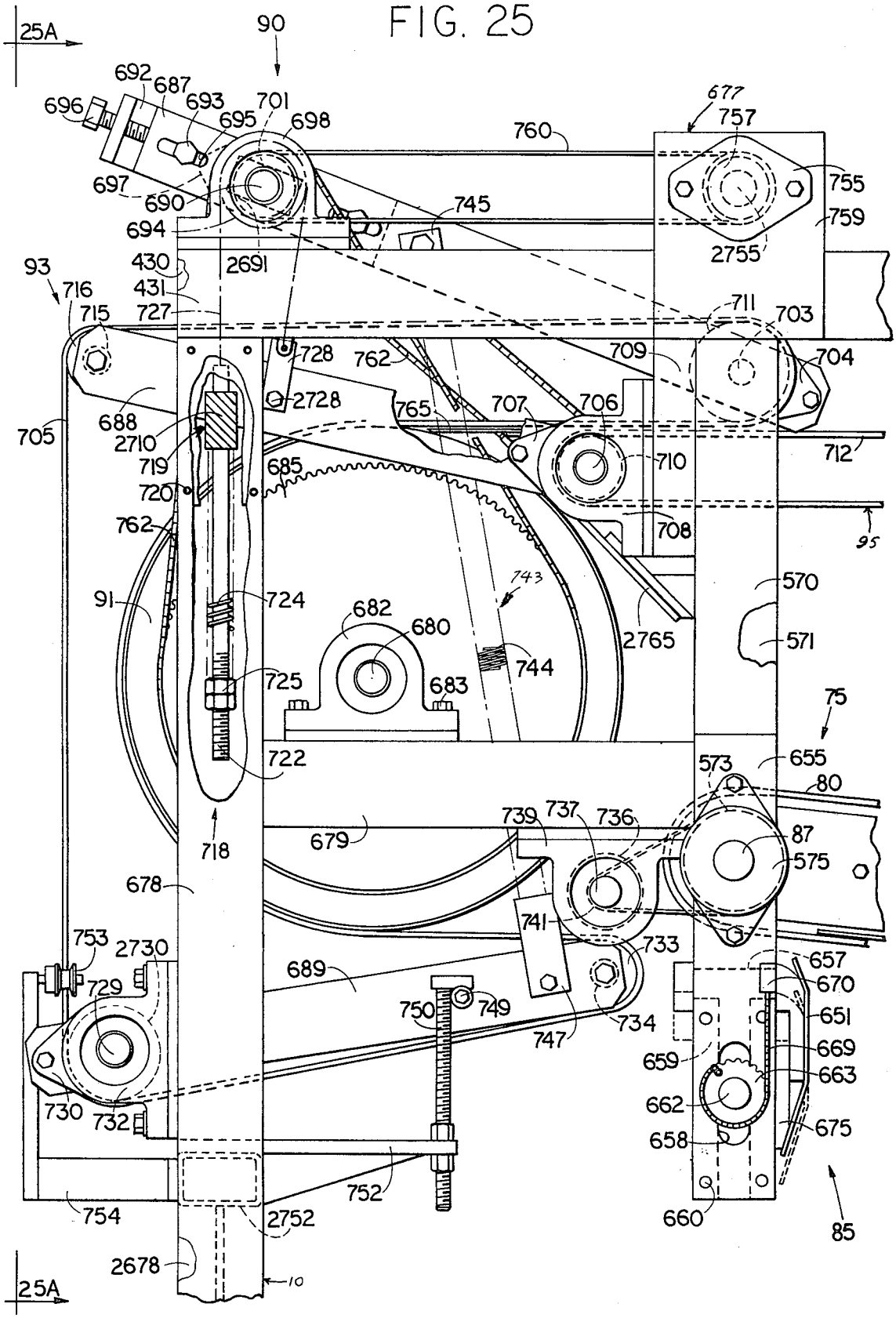
Figure 25A:
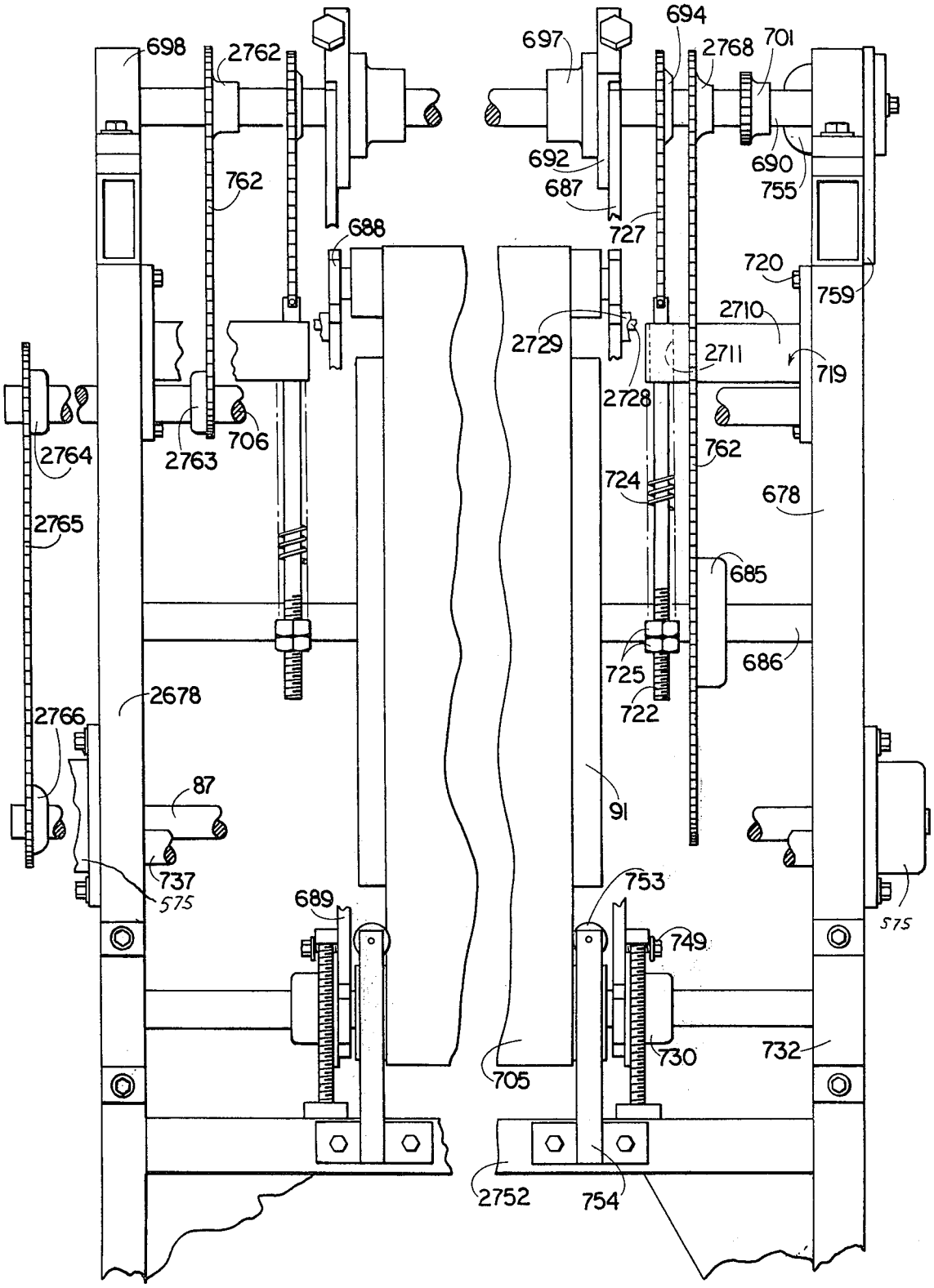
Figure 26:
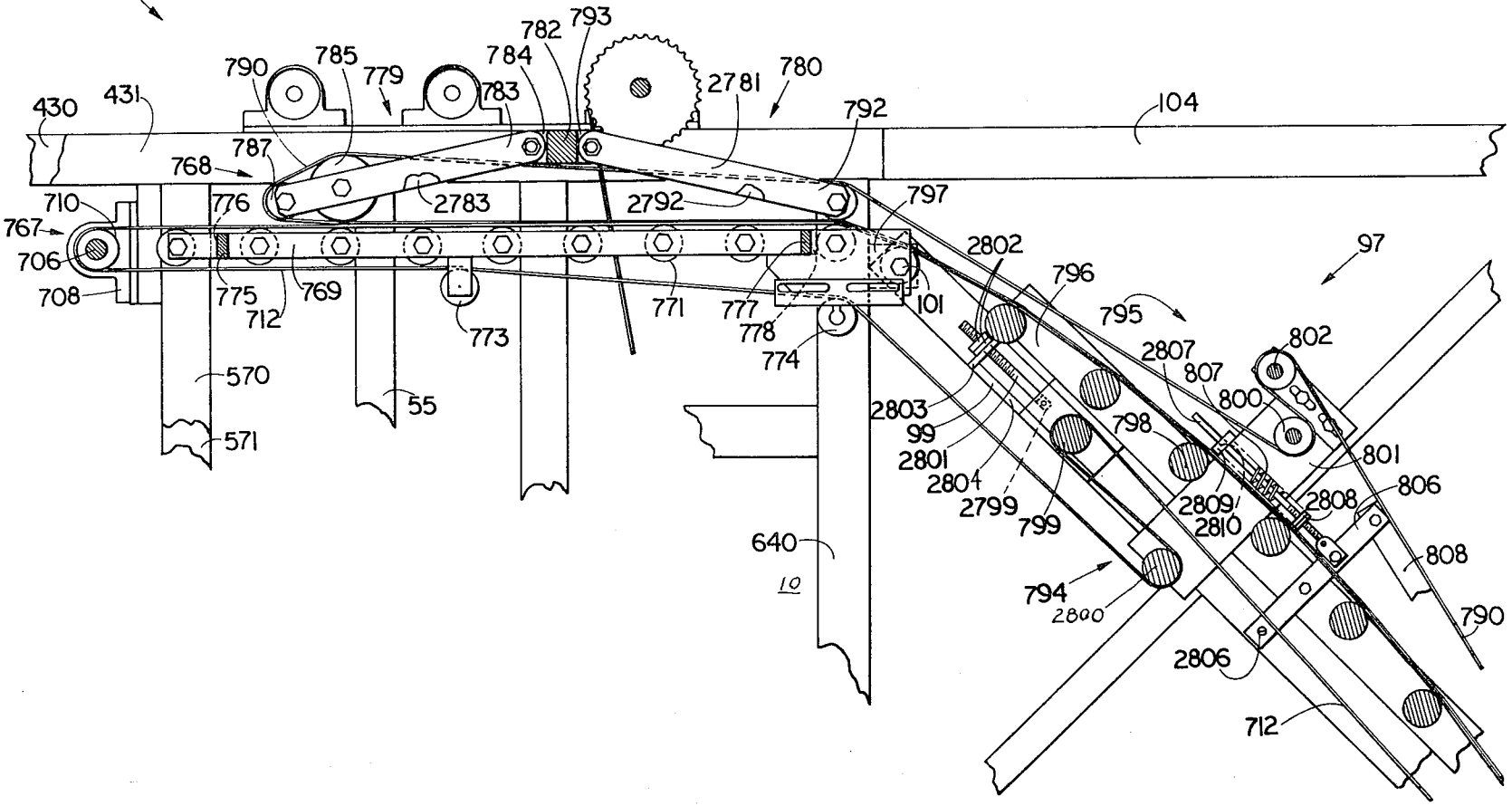
Figures 27, 29:
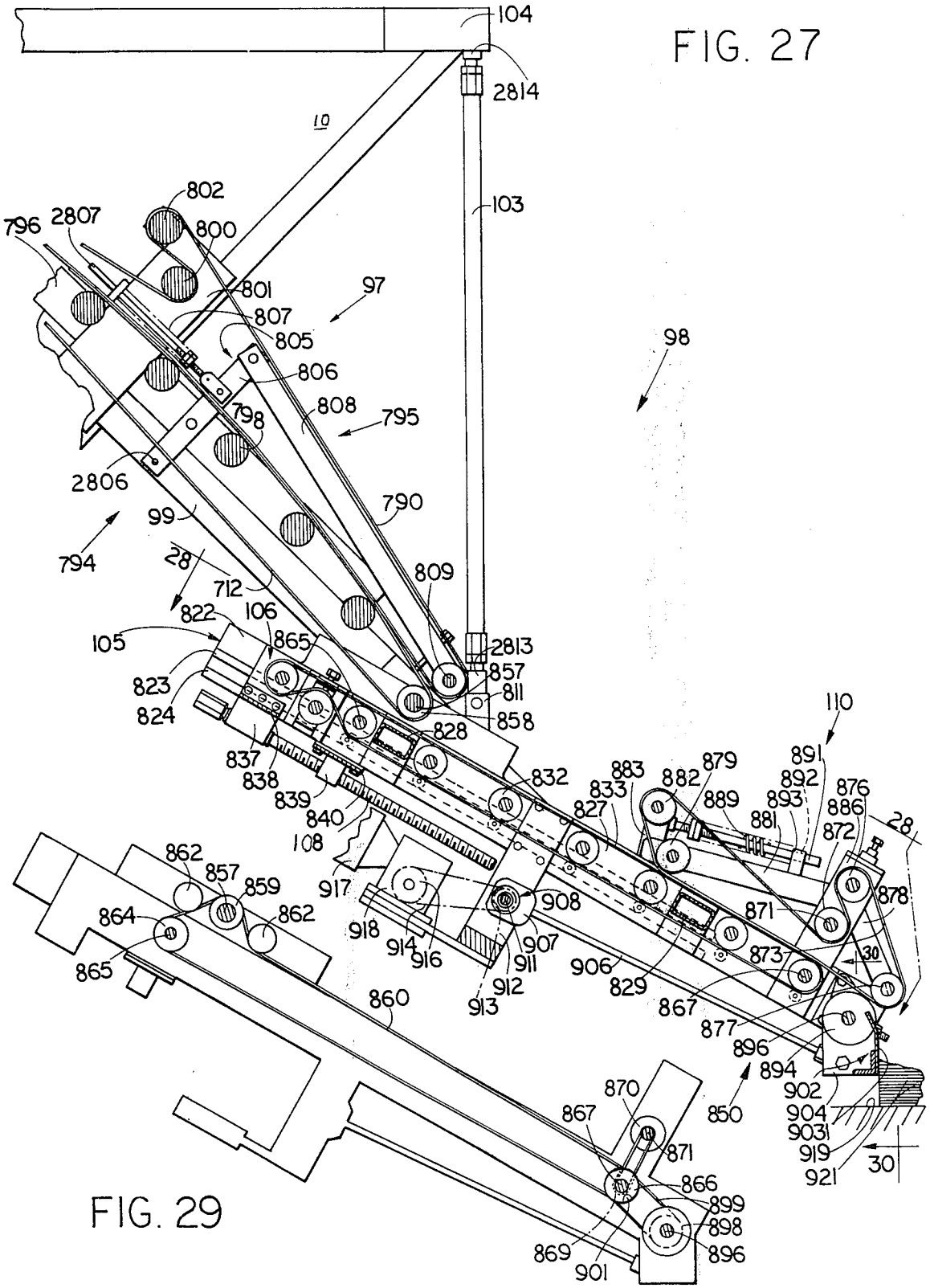
Figure 28:
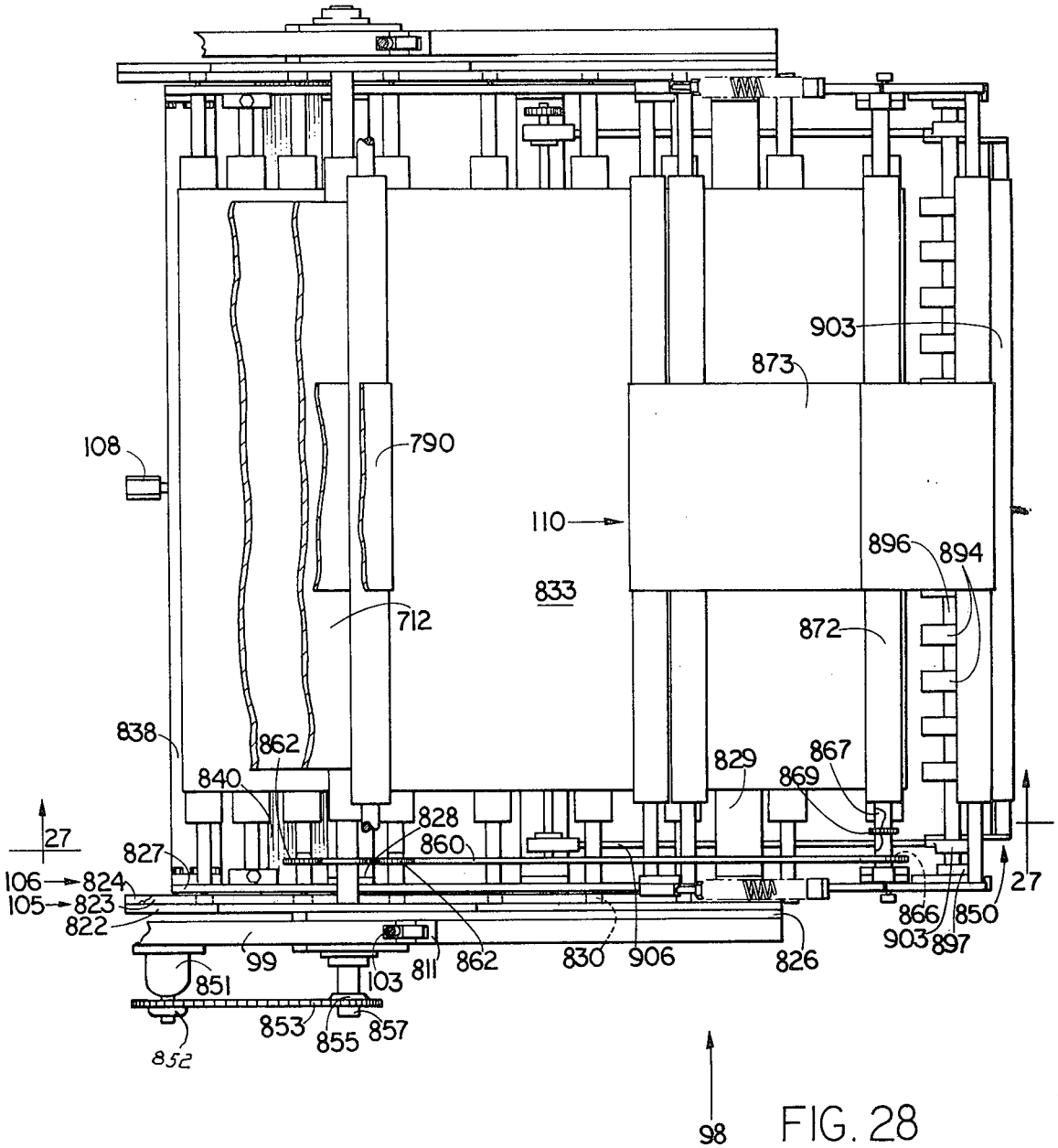
Figure 30:
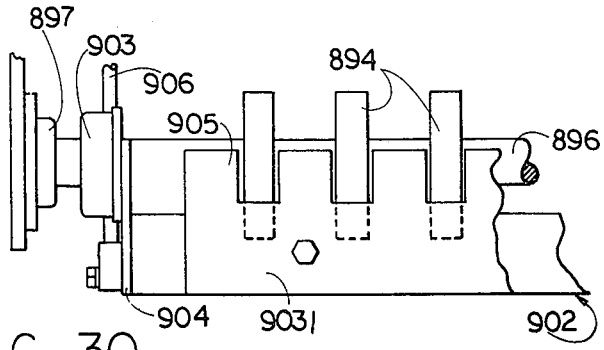
Figure 31:
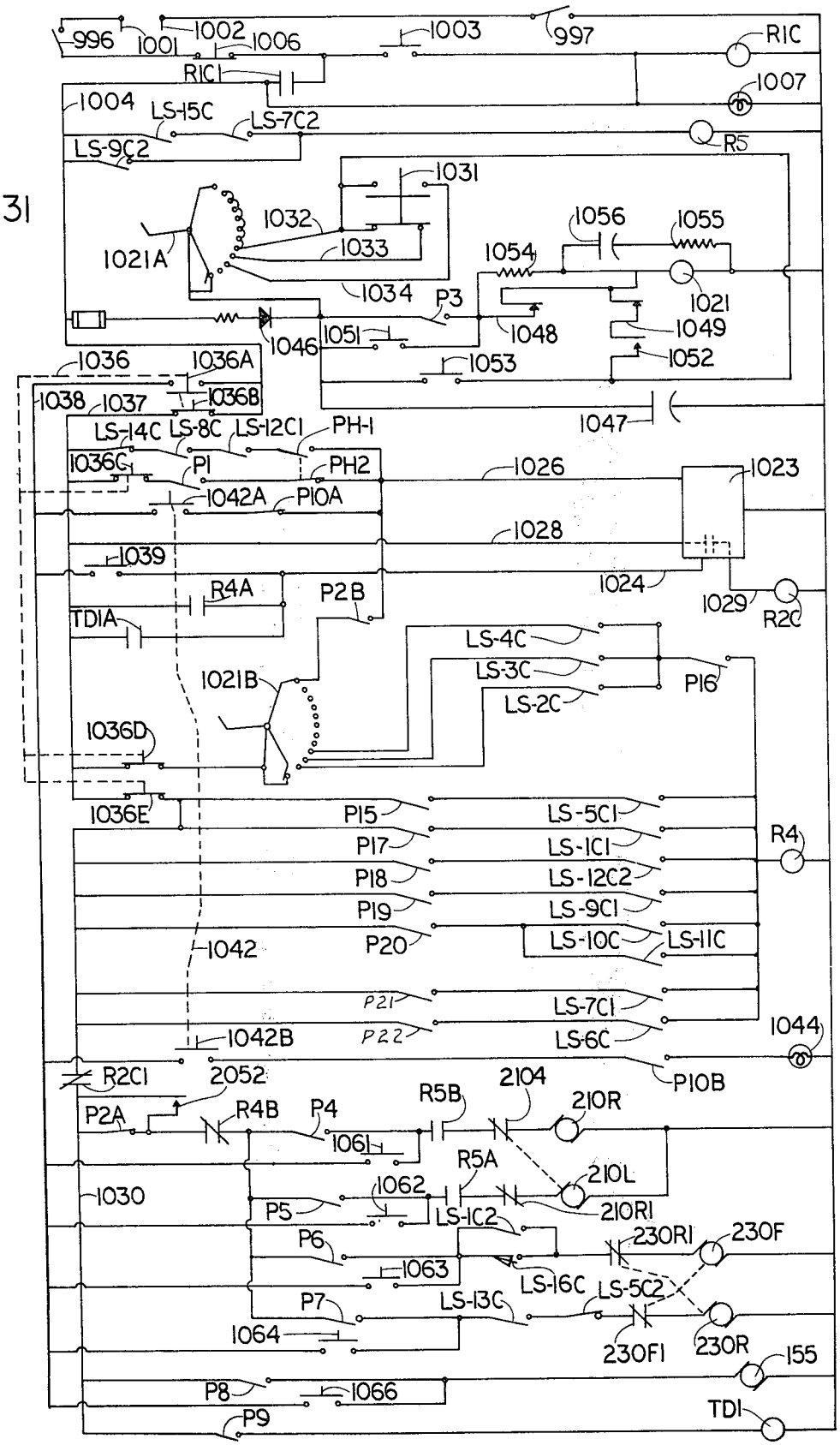
Figure 33:
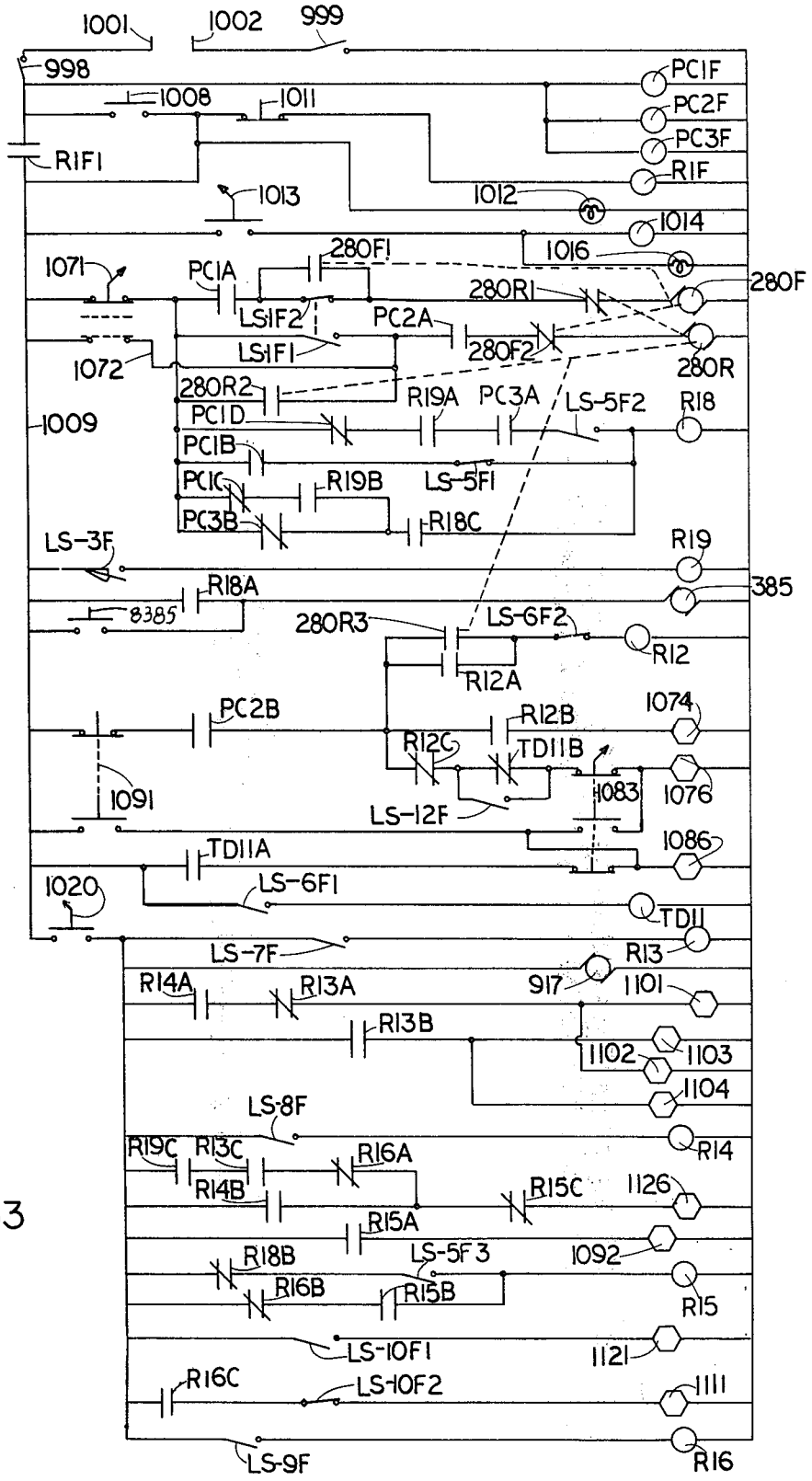
Figure 34:
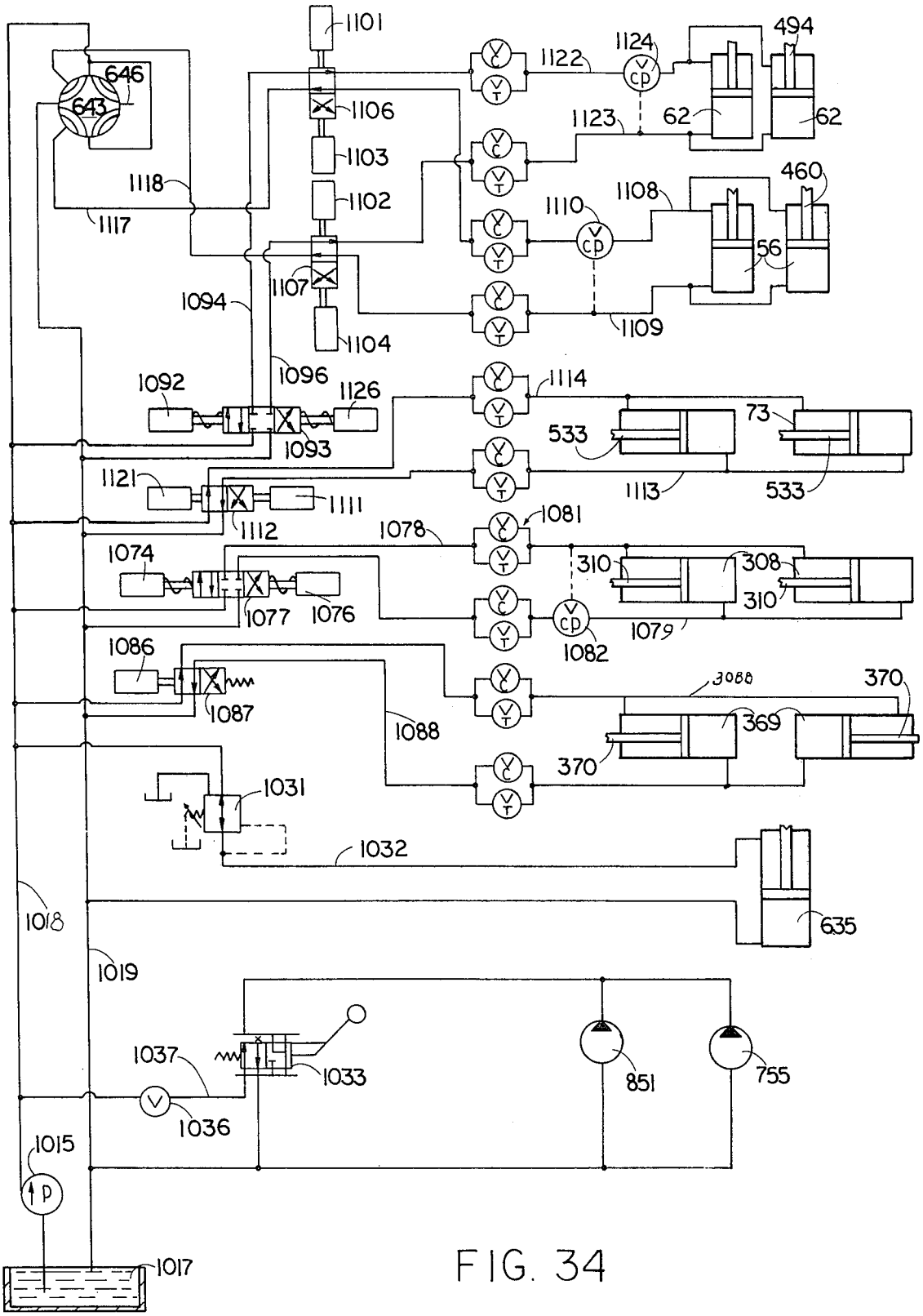

FIG. 15 a fragmentary view in side elevation looking in the direction of the arrows 15—15 in FIG. 2, some details being omitted for clarity;

FIG. 16 is a view in section taken on the line 16—16 in FIG. 15;

FIG. 17 is a fragmentary view in side elevation taken in the same direction as FIG. 15, but with other details omitted for clarity, forks at a fork elevator being shown in lowered position in full lines and in raised position in dot-dash lines;

FIG. 18 is another fragmentary view in side elevation taken in the same direction as FIGS. 15 and 17 with other details omitted for clarity, a tongue elevator being shown in lowered position in full lines and in raised position in dot-dash lines;

FIG. 19 is a view in section taken on the line 19—19 in FIG. 2;

FIG. 19A is a view in section taken on an enlarged scale on the line 19A—19A in FIG. 19;

FIG. 20 is an enlarged view in side elevation partly broken away showing details of construction of a slidable tongue assembly which forms a part of the machine, supports therefor being shown in dot-dash lines;

FIG. 21 is a view in section taken on the line 21—21 in FIG. 20; FIG. 22 is a view in section taken on the line 22—22 in FIG. 20;

FIG. 22A is a fragmentary view in section taken on the line 22A—22A in FIG. 22;

FIG. 23 is a fragmentary view in side elevation on an enlarged scale taken in the same direction as FIG. 18;

FIG. 24 is a fragmentary plan view of the portion of the machine shown in FIG. 23;

FIG. 25 is a view in side elevation on an enlarged scale partly broken away and in section of a carton inverter section of the machine;

FIG. 25A is a view in end elevation looking in the direction of the arrows 25A—25A in FIG. 25;

FIG. 26 is a fragmentary view in section taken generally on a line 26—26 in FIG. 19, of a first portion of a carton discharging section of the machine;

FIG. 27 is a view in section taken generally on a line 27—27 in FIG. 28 showing a second portion of the carton discharging section;

FIG. 28 is a view in section taken on the line 28—28 in FIG. 27;

FIG. 29 is a somewhat schematic view partly in side elevation and partly in section showing conveyor drives of a slide conveyor of the carton discharging section of the machine;

FIG. 30 is a fragmentary view in side elevation looking in the direction of the arrows 30—30 in FIG. 27;

FIG. 31 is a schematic electrical wiring diagram of a section of the machine;

FIG. 32 is a schematic representation of the program of a programmer of the machine;

FIG. 33 is a schematic electrical wiring diagram of a second section of the machine; and FIG. 34 is a schematic view of hydraulic connections of the machine.

In the following detailed description and the drawings, like reference characters indicate like parts.

GENERAL DESCRIPTION

Figure 1:
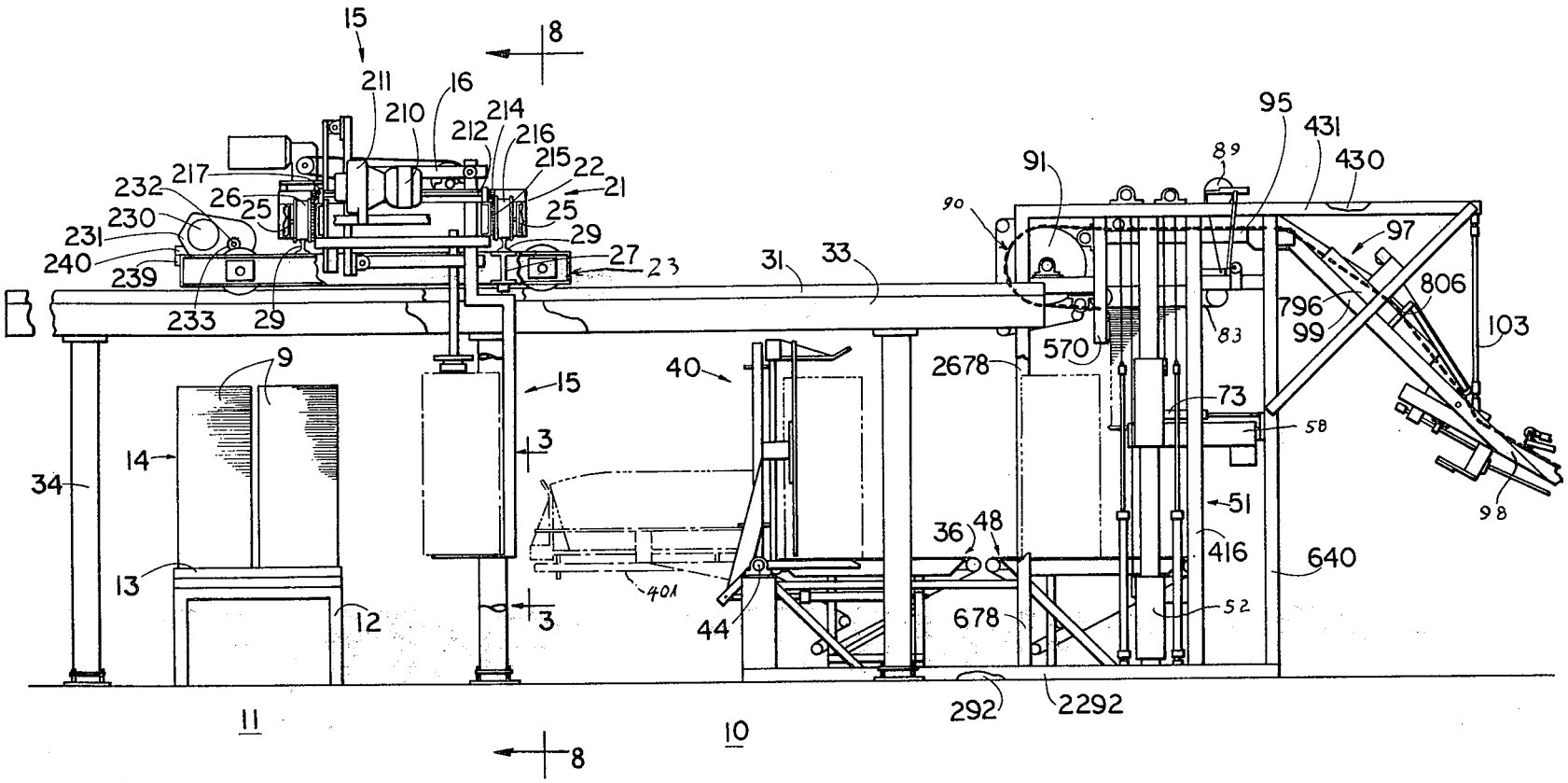
FIG. 1 is a somewhat schematic view in side elevation of a carton de-stacking machine constructed in accordance with an embodiment of this invention, parts of a crane guiding track and of a discharge conveyor being broken away, a tip-over table of the machine being shown in lowered position in dot-dash lines.

In FIG. 1 is shown a machine 10 for transferring articles from a stack to a shingled stream which is constructed in accordance with an embodiment of this invention. The machine 10 can direct cartons into a customer machine generally located to the right of FIG. 1 and not shown. The cartons are picked up as right side up vertical stacks 9 and delivered to the customer machine in a sequenced or shingled procession, each carton being face down as the cartons are delivered by the machine.

Generally moving from left to right in FIGS. 1 and 2, the machine 10 provides a loading station 11 (FIG. 1) comprising a rigid pallet stand 12, a wooden pallet 13 (FIGS. 1 and 3) on the top of the pallet stand 12, and an array of carton stacks 14 (FIG. 1) on the pallet 13. An ordinary fork lift truck (not shown in detail) delivers the pallet 13 and the array of cartons 14 on the pallet to the pallet stand 12 which positions the pallet 13 in such a way to permit an automated crane 15 (FIGS. 1 and 8) to sequentially unload the individual carton stacks 9 (FIG. 1).

Figure 4:
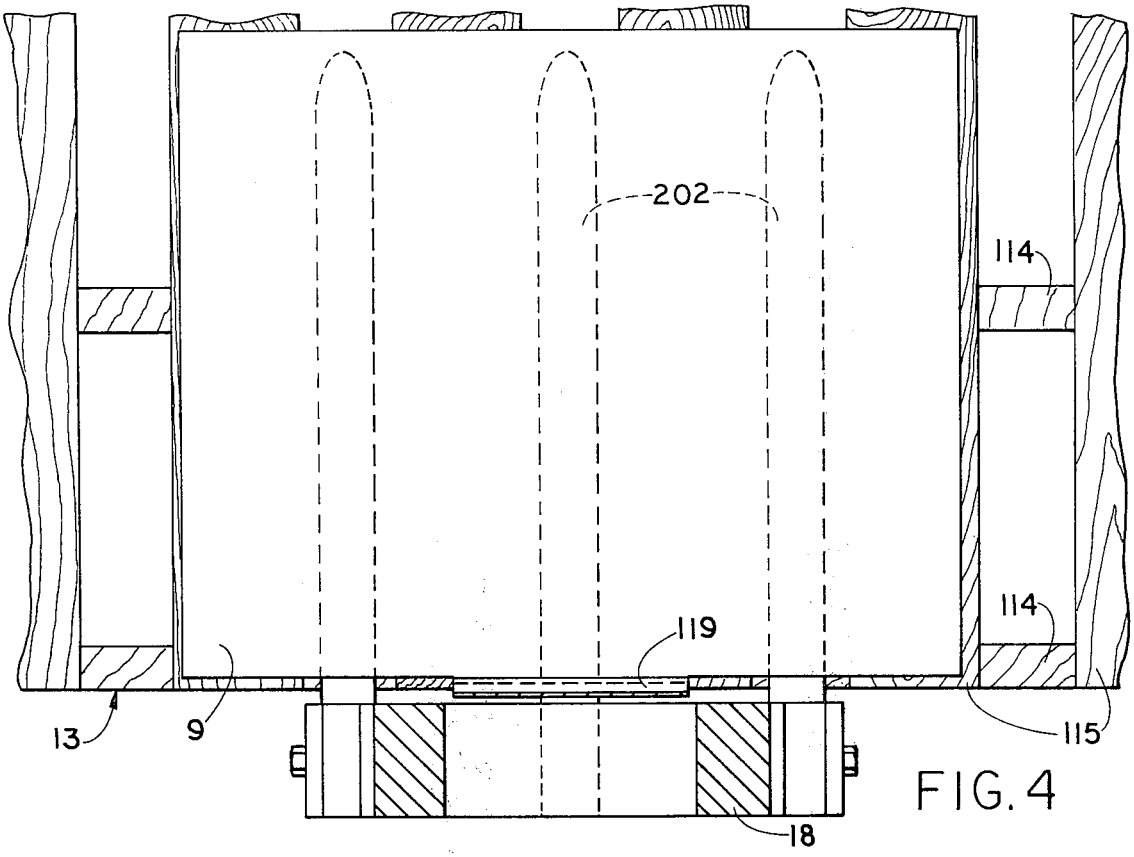
FIG. 4 is a view in section taken on the line 4—4 in FIG. 3.

The automated crane 15 and a mobile mounting structure 21, by action of a sequential programmer, automatically picks up the stacks of cartons 9 from a series of different locations on the pallet 12 (FIG. 1) and delivers them to one fixed drop position. Dashed arrows in FIG. 2 show the path of the automated crane 15. Programming can be arranged to handle carton arrays of less than or more than the six stacks shown, but the invention will be described with reference to programming in connection with the array shown. The automated crane 15 includes two major sections; an upper support section 16 (FIG. 5) and a lower stack supporting section 17. The upper section 16 is a support structure for the lower section 17. The lower section 17 provides a vertically disposed structure 18, a stack clamp 19, and a fork 20. The upper section 16 provides the small vertical movements necessary to raise the fork 20 under the carton stack 9 (FIG. 3) to lift the carton stack 9 off the pallet 13. In a reverse movement it also unloads the crane 15. The upper section 16 (FIG. 5) also permits a small horizontal movement of the crane section 17 in the event that the fork lift 20 would improperly impact the pallet 13 or the pallet stand 12 and includes a limit switch LS-13C which stops advance of the crane assembly. The vertically disposed structure 18 provides a vertical support for the stack of cartons 9. The stack clamp 19, which does not move vertically, is engaged by the top of the carton stack 9 as this stack is lifted from the pallet 13 by the forks 20. The fork 20 is so constructed that its tongues fit between parallel runners 115 of the pallet 13 when the fork is moved under the carton stack 9 as shown in FIG. 4.

The crane 15 is advanced along the path shown by dashed arrows in FIG. 2 by the mobile mounting structure 21 (FIG. 1). The structure 21 includes an upper truck assembly 22 (FIGS. 2 and 8) and a lower truck assembly 23 (FIGS. 1 and 2). The upper truck assembly 22 includes box beams 24 (FIG. 2) supported by a transverse "I" beam assembly 25, and a set of rollers 26 mounted upon the beams 25. A pair of rails 29 supports the rollers 26. The lower truck assembly 23 generally supports the upper truck 22 and includes the rails 29, a set of transverse beams 27 which underlie the rails 29, an assembly of longitudinal beams 28, and a set of rollers 30 mounted upon the beams 28 for mobility thereof. The rollers 30 of the mobile mounting structure 21 are supported and move upon a pair of rails 31 of an overall truck support assembly 32. The overall truck support assembly 32 provides a pair of longitudinal beams 33 that support the rails 31, and a set of pillars 34 that support the beams 33 in fixed relationship with other major parts of the feeder machine 10.

The automated crane 15 delivers the stack of cartons 9 to a fixed drop position, a deposit table 36. The deposit table 36 supports a set of timing belts 37 (see FIG. 2). A support structure assembly 38 for the table 36 (FIG. 10) includes drive mechanism for driving the belts 37 in both counterclockwise and clockwise directions. Counterclockwise movement of the belts 37 moves the stack of cartons 9 off the fork 20 and into a stack straightening tip-over device 40. Clockwise movement of the belts 37 moves the stack of cartons out of the straightening device 40, across the drop position of the deposit table 36 and onto a holding or stand-by table 48.

The stack straightening device 40 aligns the individual cartons of stack 9 with each other to form a perfect "board straight" stack on all sides for non-jamming processing through later stages of the machine 10. The straightening device 40 also places the entire stack of cartons 9 on the center line of the deposit table 36. The straightening device 40 includes a pair of rotatably mounted rollers 41 (FIGS. 11 and 12), a pair of side clamps 42 (FIG. 12), and a back support assembly 43.

Figures 10, 10A:
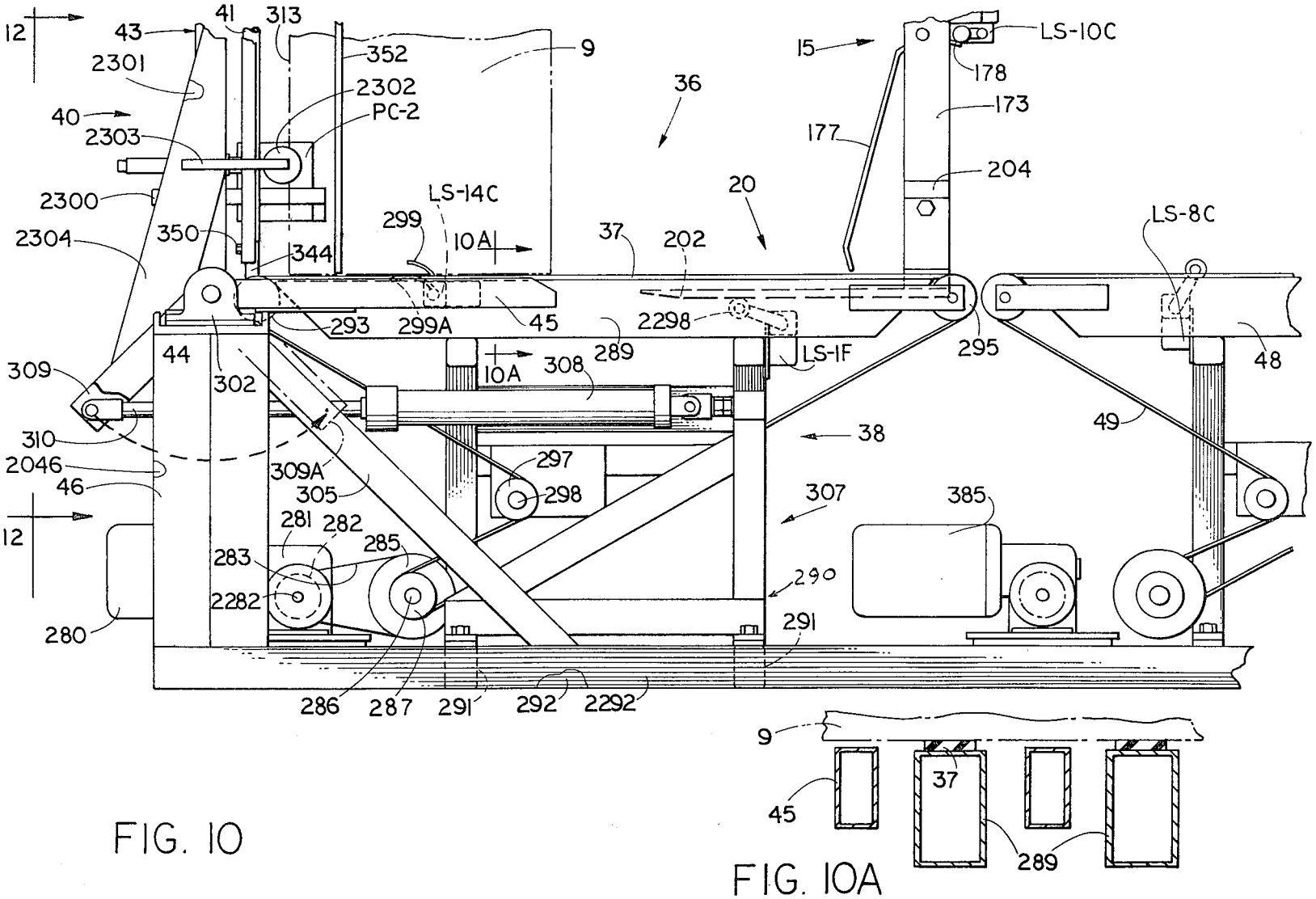
FIG. 10 is a view in side elevation looking in the direction of the arrows 10—10 in FIG. 2 with the tip-over table being shown in raised position.
FIG. 10A is a fragmentary view in section on an enlarged scale on the line 10A—10A in FIG. 10.
Figure 11:
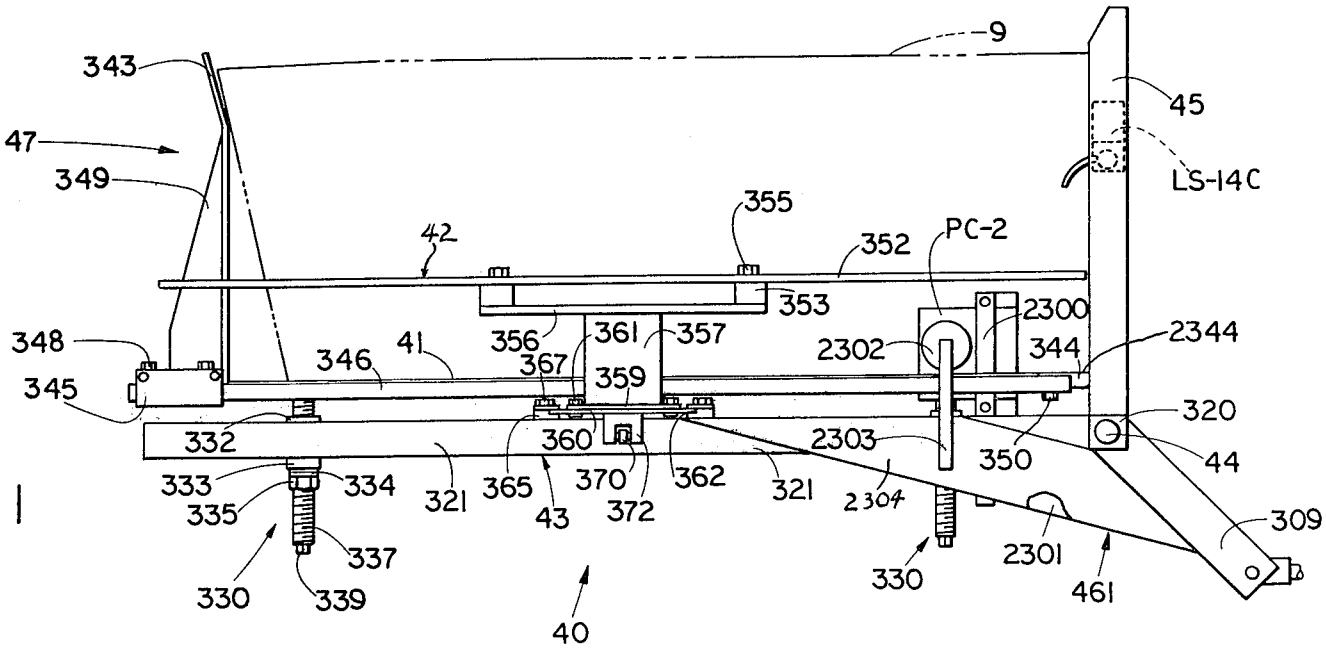
FIG. 11 is a view in side elevation of the tip-over table in lowered position.

A pivot 44 for the stack straightening device 40 is located at the base of the back support 43. A set of pickup fingers or forks 45 extend at right angles to the back support 43 at the base thereof. A stack retainer 47 (FIG. 11) is located near the outer ends of the rollers 41. The rollers 41 are adjustably mounted on the back support assembly 43. The rollers 41 facilitate lateral movement of cartons so that the carton stack can be straightened and centered simultaneously by the opposed lateral movement of the clamps 42. The side clamps 42 are slidably and adjustably mounted to, and actuated by cylinders mounted on the back support assembly 43. The set of pickup fingers 45 can be aligned between portions of the deposit table 36 and can rotate counterclockwise as shown in FIGS. 10 and 11 to lift the stack of cartons 9 off the deposit table 36 and direct the stack onto the rollers 41 as shown in FIG. 11. Impact with the rollers 41 causes any stuck-together cartons to separate, thus assuring freedom of movement for each individual carton. As the straightening device 40 rotates to its lowered position (FIG. 11), the top of the stack of cartons 9 will fall against the stack retainer 47 to permit the operator to remove damaged cartons before the device 40 clamps the stack of cartons 9 and returns it to upright position on the deposit table 36. The timing belts 37 (FIG. 10) of the deposit table 36 then run in a clockwise manner delivering the stack of cartons 9 to the holding table 48.

The holding table 48 includes a set of multiple timing belts 49 (see FIG. 15) and a support structure assembly 50 which provides for the movement of the belts 49 in a clockwise direction only. The set of timing belts 49 receives the carton stack from the deposit table 36 and holds or delivers the stack 9 to a vertical lift device 51. The holding table 48 also functions as a feed table for the vertical lift device 51 by placing the carton stacks in proper position for pickup.

The vertical lift device 51 lifts stacks to an individual carton blank pick-off device 75 (FIG. 18). The vertical lift device 51 includes two major sections, a lower fork elevator 52 (FIG. 17) and an upper tongue elevator 58 (FIG. 18). The lower fork elevator 52 (FIG. 17) includes a set of seven forks 60 (FIG. 16) that intermesh with the timing belts 49 of the holding table 48. The forks 60 are carried by a fork elevator support assembly 53 (FIG. 16) mounted on fork elevator roller boxes 54, one of which is shown in FIG. 17. The roller boxes run on elevator guide rails 55 (FIG. 17). Fork elevator lift cylinders 56 (FIG. 16) actuate lift chains 57. The chains 57 pass over sprockets 463 and are attached to the roller boxes 54 in the manner shown in FIG. 17 so that actuation of the cylinder 56 raises and lowers the fork elevator 52.

The timing belts 49 deliver a stack of cartons into the fork elevator 52. The forks 60 are between and slightly below the timing belts 49, which permits the stack of cartons 9 to pass over and be placed above the forks 60. The forks elevator 52 lifts the stack of cartons 9 toward or into contact with the pick-off device 75 (FIG. 18) and continues moving the stack up until the tongue elevator 58 is inserted under the stack and takes over lifting the remainder of the stack into contact with the pick-off device 75. The fork elevator 52 returns to its bottom position, receives another stack of cartons 9 and lifts the stack into contact with the preceding stack so that there is no discontinuity of flow through the pick-off device 75. The fork elevator support assembly 53 provides structural support for the forks 60 and spaced relationship with the roller boxes 54. The chains 57 are attached to the piston rods of the cylinders 56. The chains 57 pass up and over the lift sprockets 463 and descend to be attached to the elevator roller boxes 54 so that as the piston rods of the cylinders 56 are retracted, the fork elevators 52 rise in a controlled and stable manner.

The upper tongue elevator 58 (FIG. 18) includes two major assemblies, a lift assembly 76 and a tongue and slide assembly 78. The lift assembly 76 provides stationary support relative to the tongue slide assembly 78 and permits horizontal movement thereof. The lift assembly 76 includes roller boxes 59, one of which is shown in FIG. 18, which are slidable up and down the guide rails 55 and which are for stable vertical movement thereof along the guide rails 55 of the tongue and slide assembly 78. A lift system for the tongue elevator 58 includes tongue elevator lift cylinders 62 and associated chains 65 which pass up and over sprockets 2068 in like manner to the fork elevator lift assembly, and are attached to the tongue elevator roller boxes 59 for controlled and stable vertical movement of the tongue elevator 58. The tongue and slide assembly 78 includes a tongue mounting and slide assembly 71 (FIG. 20) and a set of six tongues 69 (FIGS. 19 and 20) attached fixedly thereto. The tongue mounting and slide assembly 71 provides a carriage for the horizontal movement of the slide assembly 78. The slide assembly 78 is moved and controlled by a tongue slide cylinder 73 (FIGS. 1 and 20). The tongues 69 can provide support for a first stack of cartons, but can be withdrawn from under the stack of cartons to permit a new stack on the fork elevator 52 to be raised under the first stack. Thus, the tongue elevator 58 and the fork elevator 52 continuously and smoothly lift the stack of carton 9 into contact with the pick-off device 75.

The stack of cartons 9 is pushed upwardly into contact with the carton pick-off device 75 (FIG. 23). The pick-off device 75 includes a set of four belts 80 which are supported on a swinging frame 83. The frame 83 can swing about a drive shaft 87. Also, a counterweight and control system 89 supports the free end of the frame 83. The pick-off device 75 cooperates with a discriminator assembly 85 (FIG. 25) to direct the carton blanks in a shingled stream to a turnover assembly 90.

Rollers 81 (FIG. 24) mounted on the drive shaft 87 and on an idler shaft 591 provide mechanical support and mobility to the belts 80. As in FIG. 23, the frame 83 is pivotally held at its left on the drive shaft 87, which is rotatably mounted on the overall framework of the feeder machine 10. The free end, or right end in FIG. 1, is restrained by the counterweight and control assembly 89, which automatically swings the frame 83 up and down on top of the stack of cartons 9 as required to keep a constant pressure on the top of the stack 9 for uniform feed therefrom. Variations are required due to non-uniform elevator feed, especially while the stack 9 is transferred from the fork elevator 52 to the tongue elevator 58.

The discriminator assembly 85 (FIG. 25) cooperates with the pick-off device 75. As the belts 80 frictionally kick cartons from the top of the stack, friction is transferred down through the stack 9 tending to spill it. The discriminator assembly 85 limits this spilling action and concentrated it in the upper cartons of the stack and controls the amount of overlap or shingle that the cartons have as they are fed into the turnover assembly 90.

The degree of shingle can be changed by lowering or raising the discriminator assembly 85. Therefore, the purpose of the pick-off device 75 and the discriminator 85 in combination, is to deliver a procession of shingled cartons to a customer machine (not shown) at the same rate as the customer machine requires cartons and with the percent of overlap selected for any particular job by the customer, regardless of the size of the cartons.

The turnover device 90 is aligned with the pick-off device 75 to receive cartons therefrom, and is located to the top and left of the pick-off device 75 in FIG. 25. The turnover device 90 incorporates a drum 91 in combination with a belt assembly 93. The drum is rotatably mounted on the framework of the feeder machine 10, and provides a mechanical path or restraint for the belt assembly 93 to run against, being held thereagainst by a series of pivot arms and rollers to permit automatic adjustment of the belt tension. The turnover device 90 receives the cartons after they have been processed by the discriminator 85. The cartons are advanced for the pick-off device 75 trailing edge and right side up. The cartons are trapped between the belt assembly 93 and the drum 91. As the drum rotates, the cartons travel in an arc and exit from the turnover drum as they reach the top thereof, prepared to enter a horizontal conveyor 95 in face and trailing edge down orientation as can be needed in the customer machine.

The horizontal conveyor 95 (FIG. 26) is provided to transport the procession of cartons horizontally across the top of the lift device 51 to a point convenient for descent into the customer machine.

As inclined conveyor 97 continues the procession of cartons from the horizontal conveyor 95 to a point where the cartons exit the conveyor system and are deposited out a slide conveyor 98 (FIG. 27).

The inclined conveyor 97 incorporates a main frame 99 that rotates about a pivot 101 (FIG. 26) and is adjustable by means of a pair of turnbuckles 103 (FIG. 27) attached between a main frame extension 104 and a lower end of the frame 99. The frame 99 incorporates rollers which support and move the conveyor belts. The pivot 101 (FIG. 26) and turnbuckles 103 (FIG. 27) permit the terminus of the feeder machine to be variable in height. The belts of the horizontal conveyor 95 (FIG. 26) and the inclined conveyor 97 can be the same. In other terms, the conveyor belts are continuous from the exit of the turnover device 90 (FIG. 25) to the slide conveyor 98 (FIG. 27). The horizontal conveyor and the inclined conveyor incorporate a lower belt and an opposed upper belt for controlled transport of the cartons.

The slide conveyor 98 forms a terminus of the feeder machine 10 and is equipped to provide horizontal adjustment between the feeder machine 10 and the customer machine (not shown in detail). It consists of a relative fixed frame or rail assembly 105 (FIG. 28) to cooperate with an inner slide assembly 106 that includes a single, unopposed or open conveyor belt. The parts are moved relative to each other by means of a jack screw 108 (FIG. 27) coupled therebetween. The rail assembly 105 is rigidly fixed to the lower ends of the incline conveyor frame 99 (FIG. 27).

A final shingler belt assembly 110 is mounted on top of and at the end of the sliding conveyor 98 to vary the amount of shingling delivered to the customer machine.

The machine which has been discussed in general terms hereinabove will now be described in greater detail. In the drawings, particularly FIG. 2, one side of the machine has been designated "Operator Side" for ease of reference. In the description, movement toward and away from the operator side is designated "lateral" movement. Movement perpendicular thereto, as indicated in FIG. 2, is designated "longitudinal".

PALLET AND AUTOMATED CRANE

As already pointed out, as shown in FIGS. 1 and 2, the feeder machine 10 provides a loading station 11 comprising a rigid pallet stand 12, a wooden pallet 13 on the top thereof, and an array of carton stacks 14.

Figure 3:
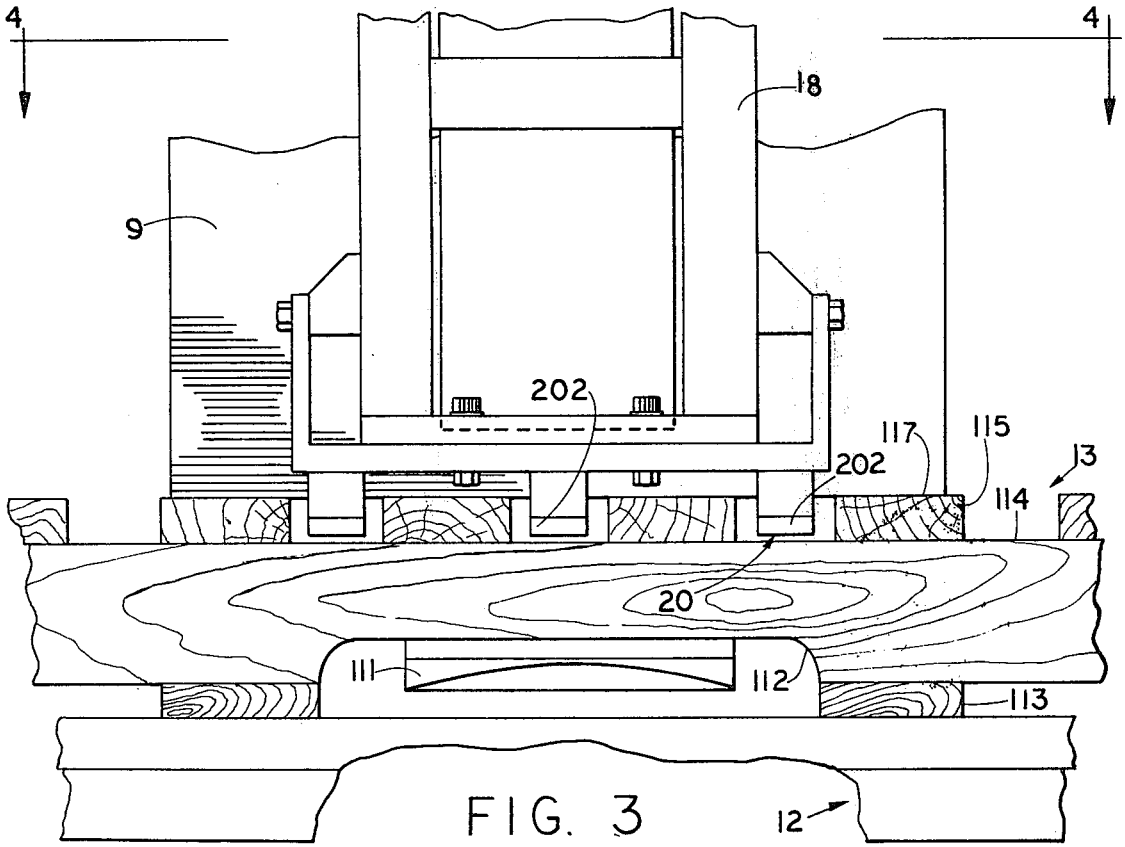
FIG. 3 is a view in elevation on an enlarged scale looking in the direction of the arrows 3—3 in FIG. 1 with a crane being in lowered position and in position to pick up a stack of cartons on a skid, a fragmentary portion of a fork of a lift truck being shown in association therewith.

The rigid pallet stand 12 (FIGS. 2 and 3) is so disposed that the carton array 14 is placed in alignment with the fork 20 of the crane 15. Referring to FIG. 3, tongues 111 of a fork lift truck (not shown in detail) can extend through a pair of slots 112, only one of which is shown, of the pallet 13 to permit placing the pallet 13 on the stand 12 without moving the carton array 14 in relation with the pallet 13. The bottom runners 113 hold a set of cross members 114 in rigid relation with each other. The plurality of top runners 115 provides a discontinuous bearing surface 117 upon which the carton stacks 9 can rest. Each carton stack 9 is therefore suspended above the cross members 114 to provide free and aligned passage for tongues 202 of the fork 20 to enter under the carton stack 9. As can be seen in FIG. 4, the tongues 202 continue to enter under the carton stack 9 until the face of the carton stack 9 is engaged by a limit switch compression plate 119 to depress the plate 119 to the dashed line position 119A of FIG. 5 which stops the progress of crane 15, as will be explained more fully hereinafter. The automated crane 15 then raises the fork 20 sufficiently to lift the stack of cartons 9 off the pallet assembly 13. In so doing, the stack of cartons 9 may shift toward the vertical structure 18 and is retained thereagainst. The crane 15 will then travel and deposit the stack 9 in its deposit position and then return, index and pick up the next stack of cartons in the array 14. This process will be described in further detail hereinafter.

The array of cartons 14 can contain two rows, i.e., two stacks of cartons 9 will be in longitudinal line with each other on the pallet 13 (see FIG. 2). The number of columns, i.e., the number of carton stacks 9 set laterally of each other on the pallet 13, can be varied from two to four depending on the size of the cartons being processed. Hereinafter an array of cartons 14 using two rows of three columns will be described in detail. Other array sizes could be employed with minor modification to controls of the automated crane 15 and the support system 21.

Figure 6:
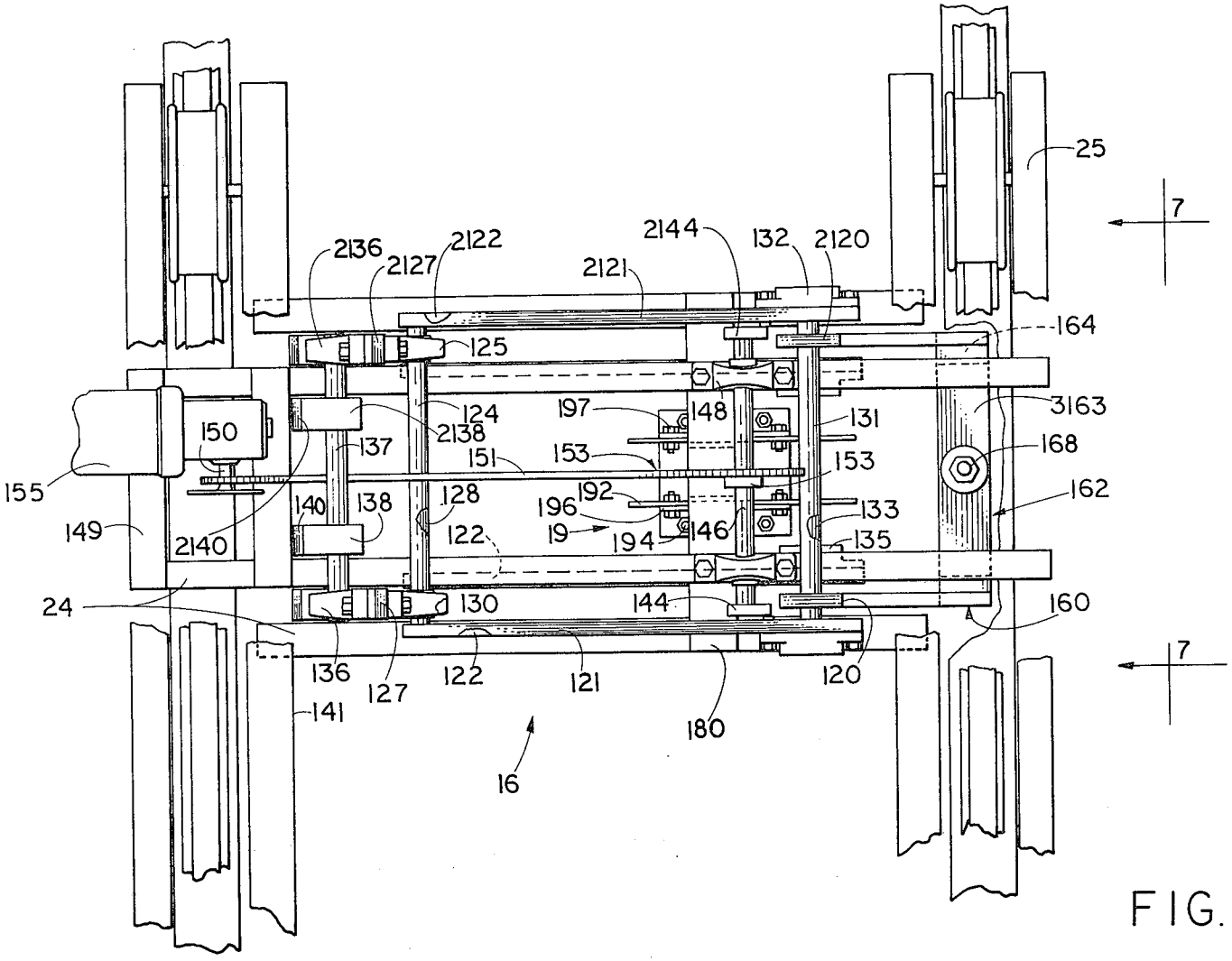
FIG. 6 is a fragmentary plan view of the crane structure shown in FIG. 5.
Figure 7:
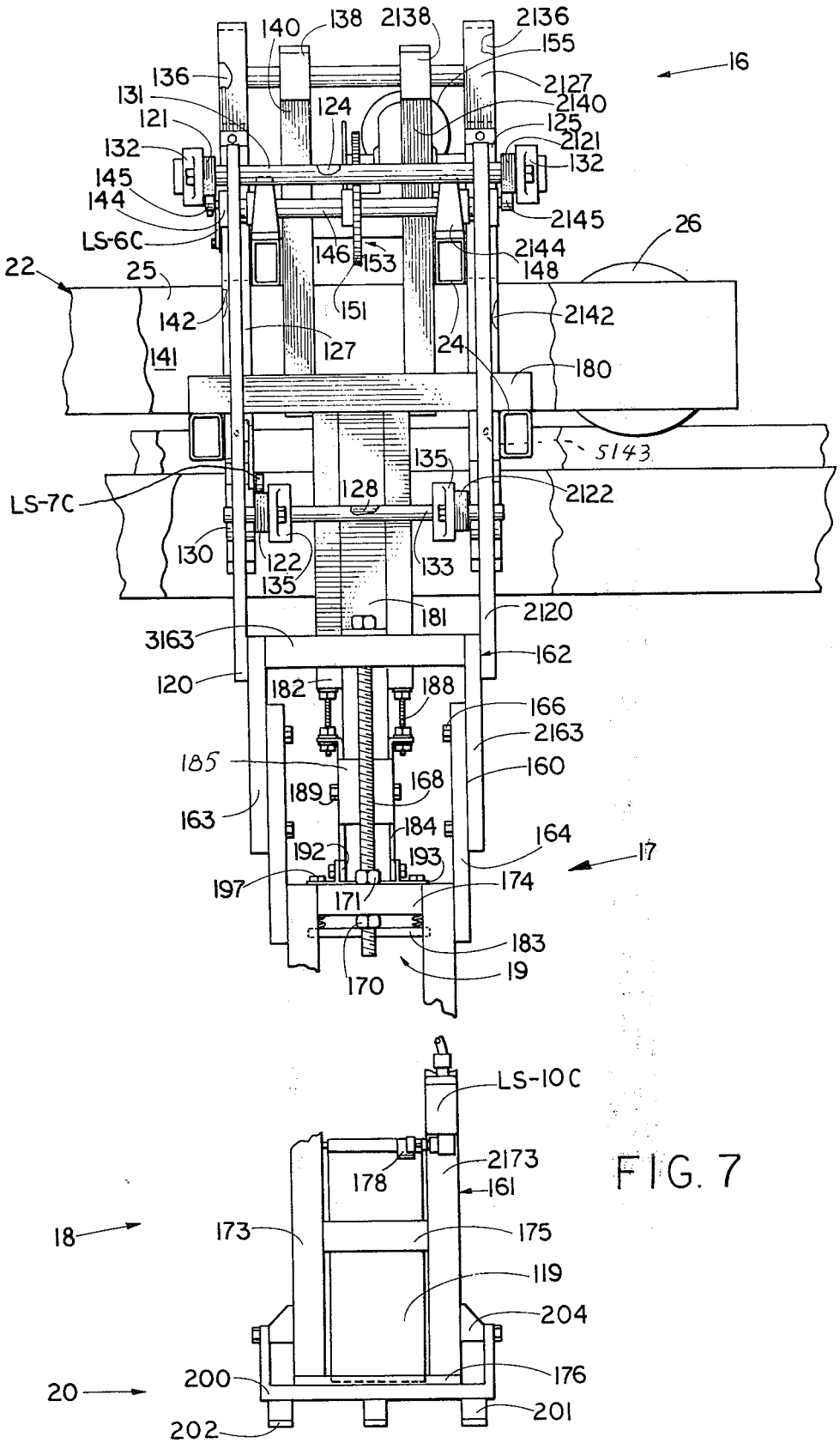
FIG. 7 is a view in end elevation of the crane structure shown in FIGS. 5 and 6 taken in the direction of the arrows 7—7 in FIG. 6.

General details of the automated crane 15 are shown in FIGS. 1 and 2 and greater detail is shown in FIGS. 5, 6, and 7. Referring to FIGS. 5–7, the upper section 16 of the crane 15 is generally a parallelogram support structure for the lower section 17. The parallelogram structure provides the vertical movements necessary to load and unload the fork lift 20. The parallelogram support assembly 16 is also pivotally mounted in such a way to provide a small horizontal movement of the crane 17 in the event that the fork lift 20 improperly impacts the pallet 13 or the pallet stand 12.

More specifically, the lower crane assembly 17 is suspended from a pair of vertical members 120 and 2120. The members 120 and 2120 are held in vertical disposition by a pair of upper pivot arms 121 and 2121 and a lower pair of pivot arms 122 and 2122. The pivot ends of the pivot arms 121 and 2121 are rigidly clamped to a lateral shaft 124. The shaft 124 is rotatably mounted on a set of bearings 125. The set of bearings 125 is mounted on a pair of vertical support members 127 and 2127. The pivot ends of the lower arms 122 and 2122 are rigidly clamped to a lateral shaft 128. A set of bearings 130 provides rotation of the shaft 128 and of the arms 122 and 2122. The free ends of the upper arms 121 and 2121 are rotatably connected to the vertical members 120 and 2120 by means of a lateral shaft 131 and a pair of bearings 132 that are rigidly attached to the free ends of the upper pivot arms 121 and 2121. The free ends of the lower pivot arms 122 are likewise rotatably connected to the vertical members 120 by means of a lateral shaft 133 that is bearinged to the free ends of the lower arms 122 and 2122 by a pair of bearings 135 (FIG. 7). This arrangement of parts permits small vertical movements of the members 120 and 2120 and therefore of the lower crane assembly 17 that is necessary for loading and unloading the fork lift 20.

The vertical support members 127 and 2127 (FIG. 5) function as a relatively fixed reference plane for the movements of the parallelogram assembly 16 hereinafter described in detail. The vertical support members 127 and 2127 are rotatably mounted about their upper ends by means of a set of bearings 136 and 2136 (FIG. 6). The bearins 136 and 2136 carry a shaft 137. The shaft 137 is held in fixed position by a pair of pillow blocks 138 and 2138. The pillow blocks 138 and 2138 are fixedly attached to a pair of vertical mounting members 149 and 2140. The vertical mounting members 140 and 2140 are fixedly attached to a face 141 of the transverse beam assembly 25 of the upper truck system 22. Another pair of lower vertical mounting members 142 and 2142 (FIG. 7) are likewise rigidly affixed to the face 141 of the transverse beam assembly 25 but in line with the vertical support member 127. If the fork lift 20 engages an improper object, the longitudinal force produced at the fork 20 will be transferred into a movement or rotation of the vertical support members 127 and 2127 (FIG. 5) about the shaft 137. This rotation will move the lower end of the vertical support members 127 and 2127 away from the lower end of the lower vertical mounting members 142 and 2142. A limit switch LS-13C will be opened. The limit switch LS-13C shuts off the longitudinal motor driving of the mobile mounting structure, as will be explained in greater detail hereinafter. Compression springs 5142 (FIG. 7) urge the vertical support members 127 and 2127 to the position shown. The springs 5142 are mounted on pins 5143 carried by supports 5144.

Control over the vertical movement of the parallelogram support structure is provided by a pair of cranks 144 and 2144 that turn a pair of rollers 145 and 2145 against the upper pivot arms 121 and 2121 adjacent to the vertical members 120 and 2120 (see FIG. 5). The cranks 144 and 2144 are rigidly attached to a shaft 146 that is carried rotatably by a pair of bearings 148. The bearings 148 are rigidly attached to the upper pair of longitudinal box beams 24. The box beams 24 (FIG. 7) are carried by the transverse beam assemblies 25 and provide a fixed reference upon the upper truck assembly 22 for the rotation of the cranks 144 and 2144. Rotation of the cranks 144 and 2144 is caused by a motor 155 (FIG. 5) mounted on beams 149 that are affixed to the upper pair of longitudinal box beams 24. The motor 155 turns a sprocket 150 that is coupled by a chain 151 to a larger sprocket 53 that is affixed to the shaft 146.

Referring to FIGS. 5 and 7, the cranks 144 and 2144 are in a neutral position. When the motor 155 turns the cranks 144 and 2144 counterclockwise, as shown in FIG. 5, the rollers 145 and 2145 will rotate the pivot arms 121 and 2121 up, raising the vertical members 120 and 2120 until the actuating arm of a limit switch LS-7C is raised. Raising thereof stops the motor 155, as will be explained hereinafter. When the motor 155 is again turned on, it will resume turning the cranks 144 and 2144 counterclockwise, until the actuator arm of the limit switch LS-6C is lowered. Lowering thereof again turns the motor 155 off.

As already pointed out, the lower section 17 or crane section includes a vertically disposed structure 18, a stack clamp 19 and a fork lift 20. The vertical structure 18 includes a height adjustment assembly 160, and a crane structure 161. The height adjustment assembly 160 includes a mounting yoke 162 (FIGS. 5 and 7) rigidly affixed to the lower extremity of the vertical support members 120 and 2120. The yoke 162 includes a pair of angle-shaped beams 163-2163 and a lateral member 3163, and an adjustment fork 164 rigidly mounted to the top of the crane structure 161. The adjustment fork 164 is slidably mounted to the yoke 162 by a set of bolts 166 screwed into the yoke 162 through a set of slots 167 in the fork 164. Adjustment of the crane height is achieved through a jack screw 168 rigidly inserted through the lateral member 3163 of the yoke 162 and slidably mounted through the top portion of the crane structure 161. A nut 170 (FIG. 7) is turned, either raising or lowering the crane structure 161. A nut 171 is turned down compressively on the top of the lateral member 3163 locking the assembly 161 in place. The crane structure 161 includes a pair of vertical beams 173 and 2173 welded in lateral spaced relationship by three horizontal beams; a top beam 174, a lower beam 175 and a bottom plate 176. Rotatably mounted between the beams 173 and 2173 at their lower ends is the compression plate 119, which actuates a limit switch LS-10C through arm 178 when the crane 15 moves under the stack 9 to pick it up. The switch LC-10C turns off the longitudinal crane motor thus stopping longitudinal movement of the crane assembly 15, as will be explained more fully hereinafter. The crane structure 161 provides a back stop for uneven stacks of cartons 9.

The stack clamp 9 (FIG. 5) is an integral part of the lower crane section 17, but is rigidly attached to the lower longitudinal box beams 24. The stack clamp 19 is mounted on lower beams 24 by a lateral beam 180. A vertical box beam 181 is rigidly affixed to the beam 180 and provides mounting and adjustment for the stack clamp assembly 19. The vertical beam 181 with the addition of a pair of flanges 182 (FIGS. 5 and 7), provides reference for the vertical adjustment of a clamp plate 183. A pair of flanges 184 are held in fixed relationship by a pair of plates 185 forming a slidable square collar that slides over the lower end of the vertical beam 181. The vertical height is adjusted by means of a pair of jack screws 188 rigidly bolted in the flanges 184 and slidably clamped in the flanges 182. A bolt and nut 189, located in a hole through the member 181 and slidable in the flanges 184 by means of a slot 190 (FIG. 5), locks the flanges 184 in place. The clamp plate 183 is longitudinally adjustable by means of holes 191 in a pair of rails 192 which are attached to the flanges 184.

The clamp plate 183 is mounted to an upper clamp plate 193 by a set of springs 194. A pair of parallel rails 196 is welded to the upper plate 193 to provide alignment and clamping of the assembly in place by a set of bolts 197 through the holes 191. This provides longitudinal adjustment of the clamp 19 to accommodate different carton sizes. As the fork and crane assembly, lower section 17, is raised by the action of the cams 144 and 2144, the carton stack 9 is raised into contact with the clamp plate 183, compressing springs 194 and consequently securing the stack of cartons 9 on the fork lift 20.

Figure 7A:
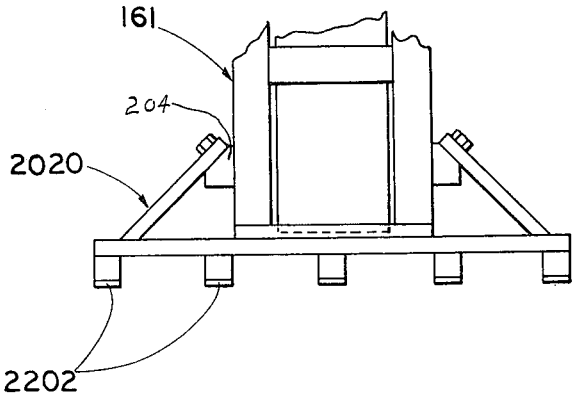
FIG. 7A is a fragmentary view in end elevation of the crane structure showing an alternate fork.

The fork 20 includes a mounting yoke 200, a set of spacer blocks 201 and a set of tongues 202 as shown in FIGS. 5 and 7. The fork 20 can be interchangeable with a fork 2020 (FIG. 7A) including additional tongues 2202 as required. The assemblies 2202 and 20 are bolted to a pair of mounting blocks 204 that are welded to the crane structure 161.

Figure 8:
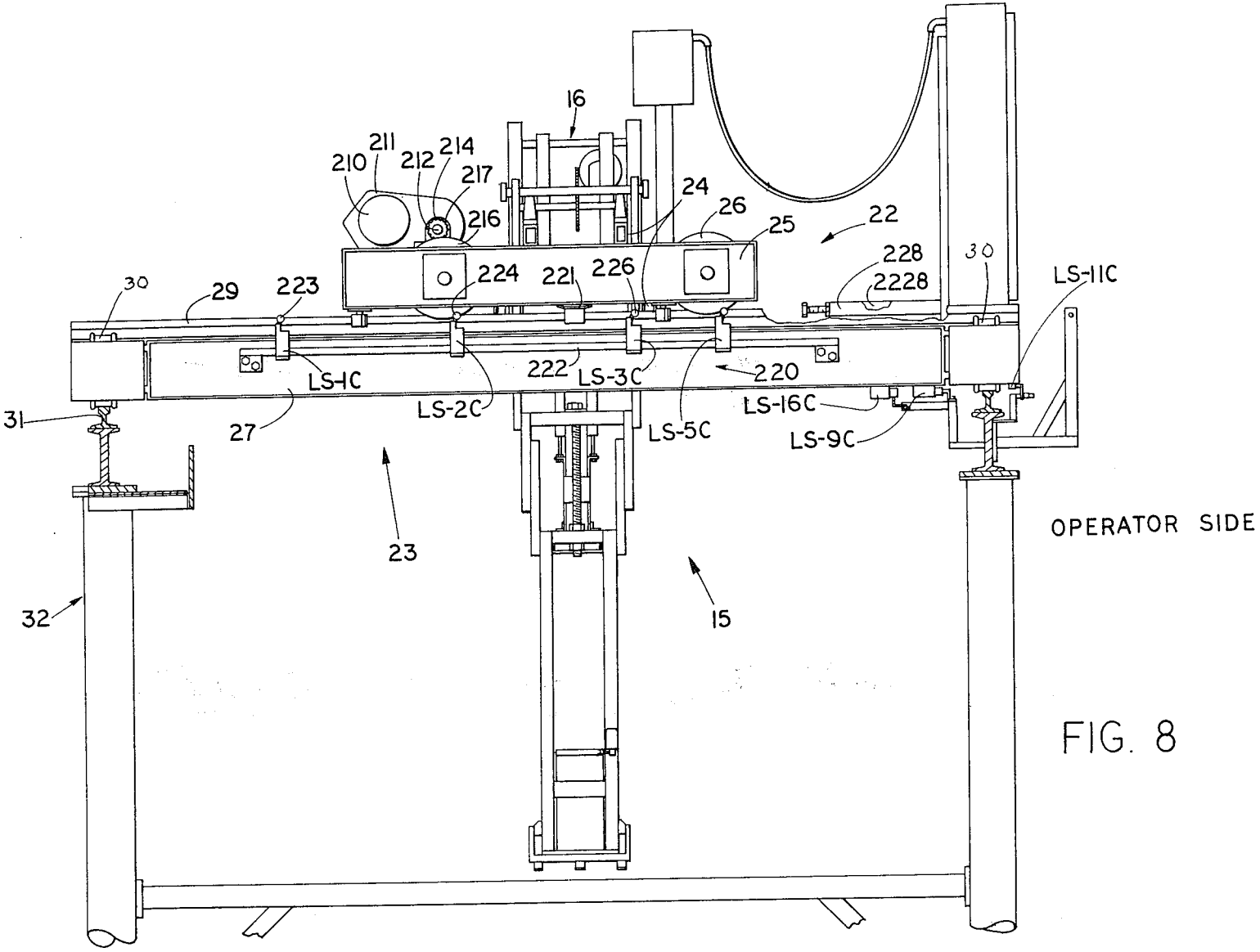
FIG. 8 is a view in section taken on the line 8—8 in FIG. 1.

The crane 17 follows the path shown by dashed arrows 205 in FIG. 2 and is supported by means of the mobile mounting structure 21. Referring to FIGS. 1, 2, 5, 6, and 8, the upper truck assembly 22 of the mobile mounting structure 21 includes the longitudinal box beams 24 (FIGS. 5 and 6) supported by the transverse I beam assemblies 25. The rollers 26 (FIG. 8) are rotatably mounted upon the beams 25. The rails 29 support the rollers 26. The upper truck assembly 22 is moved along the rails 29 by a motor 210 which drives gears (not shown) in a gear box 211 to turn a shaft 212. A pair of gears 214 are rigidly attached to the ends of the shaft 212 and intermesh with a pair of wheel gears 215 (FIG. 2). The wheel gears 215 are integral with a pair of wheels 26A in the set of rollers 26. The shaft 212 is rotatably held in place by a pair of bearings 217. The motor 210 is supported on a beam 218 that is rigidly fixed to the ends of the transverse beam assembly 25. The transverse movement of the upper truck 22 is controlled by a series of limit switches LS-1C, LS-2C, LS-3C, and LS-5C (FIG. 8) clamped to a slide bar 222 mounted on the transverse beam assembly 27 of the lower truck assembly 23 (see FIGS. 2 and 8). A limit switch trip 221 is located on the underside of the transverse beam assembly 25. As the upper truck 22 moves to the left as shown in FIG. 8, the switch trip 221 will contact switch arm and roller 223 of a limit switch LS-1C, rotating it in a counterclockwise direction. This rotation makes the circuit in association with the switch LS-1C, thereby shutting off power to the motor 210. The switch LS-1C is so situated that the crane 15 is in line with the first stack of cartons 9 (FIG. 2) in the array 14. Under circumstances where the truck 22 is moving from the left stop position at LS-1C toward the right as shown in FIG. 8, the switch trip 221 will come into contact with a switch arm and roller 224 of the limit switch LS-2C, rotating the switch arm and roller 224 clockwise, thereby making the circuit associated with the switch LS-2C and stopping the motor 210. The upper truck 22 is now in a proper lateral position to pick up a second stack of cartons 9A (FIG. 2) from the array 14. After the second stack of cartons has been delivered to the deposit table 36, a stepper switch (which will be described hereinafter) electrically disengages the limit switch LS-2C and engages in the circuitry a limit switch LS-3C. As the upper truck 22 leaves the LC-1C position, it will travel past limit switch LS-2C uninterrupted and proceed to LS-3C (FIG. 8) where the switch trip 221 will rotate a switch arm and roller 226 in a clockwise direction. This rotation will actuate the associated circuit to turn off the motor 210, thereby stopping the crane 15 in line with the third stack of cartons 9 in the array 14. After the carton stack has been secured on the crane 15, the truck 22 will move to the left. As it proceeds, the trip 221 will rotate the switch arm and roller 224 of the switch LS-2C counterclockwise. The switch LS-2C is inert for rotations in this direction, and the truck 22 will proceed until the motor 210 is turned off by the limit switch LS-1C. The crane 15 stays in this lateral position until the deposit portion of the cycle is reached. The crane 15 again moves to the right from the LS-1C position, passes switches LS-2C and LS-3C and continues moving to the right until it reaches a deposit switch LS-5C which again disengages the motor 210 halting the truck 22. Switch LS-3C is also inert when triggered in the counterclockwise direction.

Limit switches LS-1C, LS-2C and LS-3C are adjustable along the bar 222 to cooperate with various sizes of cartons and different numbers of stacks 9 in the carton array 14. LS-5C need not be changed once the machine has been set up.

A pair of mechanical stops 228 and 2228 (FIGS. 2 and 8) is installed on the lower truck 23 to stop the upper truck 22 by impacting the lower box beam 24, as shown in FIG. 8, should the electrical circuit malfunction.

Figure 9:
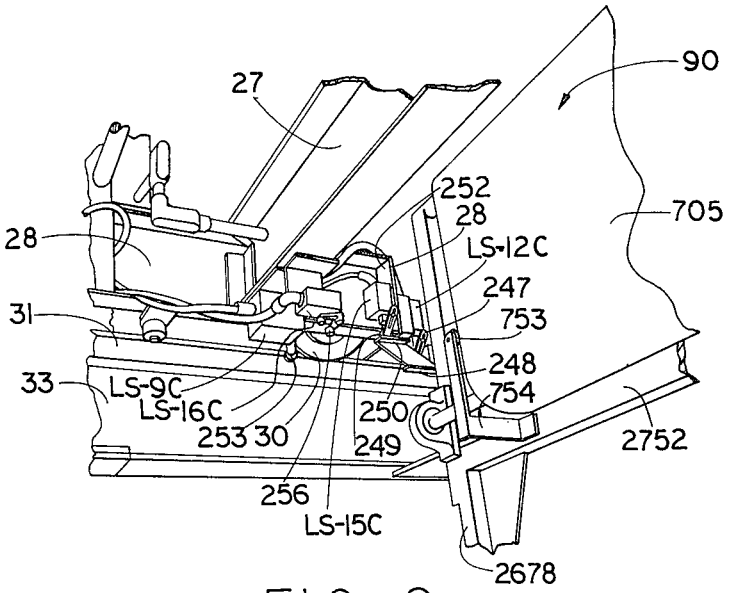
FIG. 9 is a fragmentary perspective view showing details of crane supporting mechanism and limit switch positions.

The lower truck assembly 23 supports and moves the upper truck assembly 22 longitudinally as shown in FIG. 2. Referring to FIGS. 1, 2, and 8, the lower truck assembly 23 includes the set of transverse beams 27 and the assembly of longitudinal beams 28 (FIG. 2). The rollers 30 are rotatably mounted upon the beams 28 for mobility thereof. The mobile mounting structure 21 is supported by and moves upon the pair of rails 31 of the overall truck support assembly 32. The lower truck 23 is moved along the rails 31 by means of a motor 230 (FIGS. 1 and 2), in association with gears (not shown) in a gear box 231 that turns a shaft 232. A pair of gears 233 are rigidly attached to the ends of the shaft 232 and intermesh with a pair of wheel gears 237 (FIG. 2). The wheel gears 237 are integral with a pair of wheels 30A of the set of rollers 30. The shaft 232 is rotatably held at its ends by a pair of bearings 235 and supported at its center by a third bearing 236. The bearing 236 is mounted on a cantilever beam 238 that is rigidly fixed to the transverse beam 27 providing support to the motor 230 and gear box 231. Torque restraint and support is also provided by a transverse beam 239 that is rigidly fixed to the ends of the longitudinal beam assemblies 28. A torque arm 240 is provided therebetween. The longitudinal movement of the lower truck 23 is controlled by a group of limit switches LS-9C, LS-11C, LS-12C, LS-15C, and LS-16C, all of which are shown in FIG. 2 or in FIG. 9, and which are arranged along the side of the machine designated "operator side" in FIG. 2. Details of these switches are also shown in FIGS. 8 and 9. Referring to FIG. 2, the crane 15 starts at a home position 245. This position is also the start position, that is, the crane is loaded and in the up position. It is also called the deposit position, for the first command from the sequential programmer calls for the upper truck 22 to move the crane toward the deposit table as already described. When the lower truck assembly 23 is at the deposit position, a longitudinal position, the limit switch LS-12C is actuated. As shown in FIG. 2, the switch LS-12C is rigidly fixed on the right end of the longitudinal beam 28 on the operator side of the machine. As the lower truck 23 approaches the deposit position, a switch arm and roller 247 (FIG. 9) contacts a trip 248 which rotates the arm and roller 247 clockwise, making the circuit in association with the motor 230 which thereby stops the lower truck 23. The switch LS-15C is mounted on the inside of an end plate 252 of the longitudinal beam 28. As the lower truck 23 approaches the deposit position, a switch arm and roller 249 of the switch LS-15C contacts and rides up on a trip 250 rotating the arm and roller clockwise, which makes the circuit to the motor 210 and permits lateral movement of the upper truck if LS-7C (FIG. 5) is also made, indicating the automated crane 15 in the up position, as will be explained in greater detail hereinafter.

An index position 251 (FIG. 2), a longitudinal position is a pause position to permit the upper truck 22 to laterally index to the proper carton stack before advancing toward the stack. When the crane 15 is at this position, the switch LS-9C is actuated. As the truck 23 moves from the home position 245 toward the carton array 14, a switch arm and roller 253 (FIG. 9) of the limit switch LS-9C contacts a trip 255 (FIG. 2) mounted on the longitudinal beam 33 to control the circuit to motor 230, and stops the crane 15 in its index longitudinal position 251.

A safety switch LS-16C is also provided which incorporates a two-headed L-shaped switch arm and roller actuator 256 as shown in FIG. 9. The actuator 256 contacts a switch trip 257 (FIG. 2) shortly before the switch LS-9C is actuated as the crane moves toward the pallet stand 12 and shortly after the switch LS-9C is actuated when the crane moves toward home position. The switch LS-16C is a make and maintain switch and is not spring loaded for automatic return. The circuit associated with this switch is thereby set up to stop longitudinal advance if there is a malfunction in the forthcoming step. After indexing has occurred, the motor 230 is started and moves the crane 15 toward the pallet 13. If no cartons are present, the motor 230 will run until the lower truck 23, which carries the end of travel switch LS-11C on an end 258 of the beam assembly 28, has moved sufficiently that the switch LS-11C contacts a switch trip 259 turning off the motor 230. In this situation a manual reset is necessary. Otherwise, the crane 15 will contact a carton stack 9 which trips the switch LS-10C (FIG. 5) that stops the motor 230 and continues with the stack pickup. The motor 230 is again started when the stack is clamped in the crane 15 and moves the lower truck 23 back toward the index position 251 (FIG. 2). The switch LS-9C trips first, stopping the truck 23 at the index position. If the switch LS-9C fails, the switch LS-16C trips in close sequence and stops the motor 230 before the crane 15 can run into the tipover device 40.

The mobile mounting structure 21 is supported by and moves upon the pair of rails 31 of the overall truck support assembly 32. The overall truck support assembly 32 includes the pair of longitudinal beams 33 that support the rails 31. The set of pillars 34 supports the beams 33 in fixed relationship with other major parts of the feeder machine 10.

DEPOSIT TABLE AND TIP-OVER

The automated crane 15 delivers the stack of cartons 9 to a fixed drop position at the deposit table 36. Details of construction of the deposit table 36 are shown in FIG. 10. The deposit table 36 is comprised of the set of six timing belts 37 and the support structure assembly 38. The timing belts 37 are driven by a motor 280 in association with a gearing (not shown) in a gear box 281 that drives a sprocket 282 mounted on a drive shaft 2282. A chain 283 connects the sprocket 282 and a larger sprocket 285 that is rigidly affixed to a shaft 286 supplying power thereto. A set of six notched drive rollers 287 are spaced unifomly along the shaft 286. Each of the rollers 287 is associated with and drives one of the sets of belts 37. The timing belts 37 are held in place by the support structure assembly 38. The assembly 38 includes a set of six slide rails 289 (FIGS. 10 and 10A) held in rigid horizontal position by a table-like structure 290 (FIG. 10) The structure 290 is rigidly attached to a pair of cross members 291 that are welded to longitudinal bottom mounting frames 292 and 2292. A set of notched rollers 293, rotatably mounted at the lefthand ends of the slide rails 289, and a set of notched rollers 295, rotatably mounted at the right-hand ends of the slide rails 289, in cooperation with a set of takeup rollers 297 rotatably mounted on the table structure 290 by means of a set of spindles 298 and the drive rollers 287, provides movement of the belts 37 in either direction by reason of the motor 280.

Figure 12:
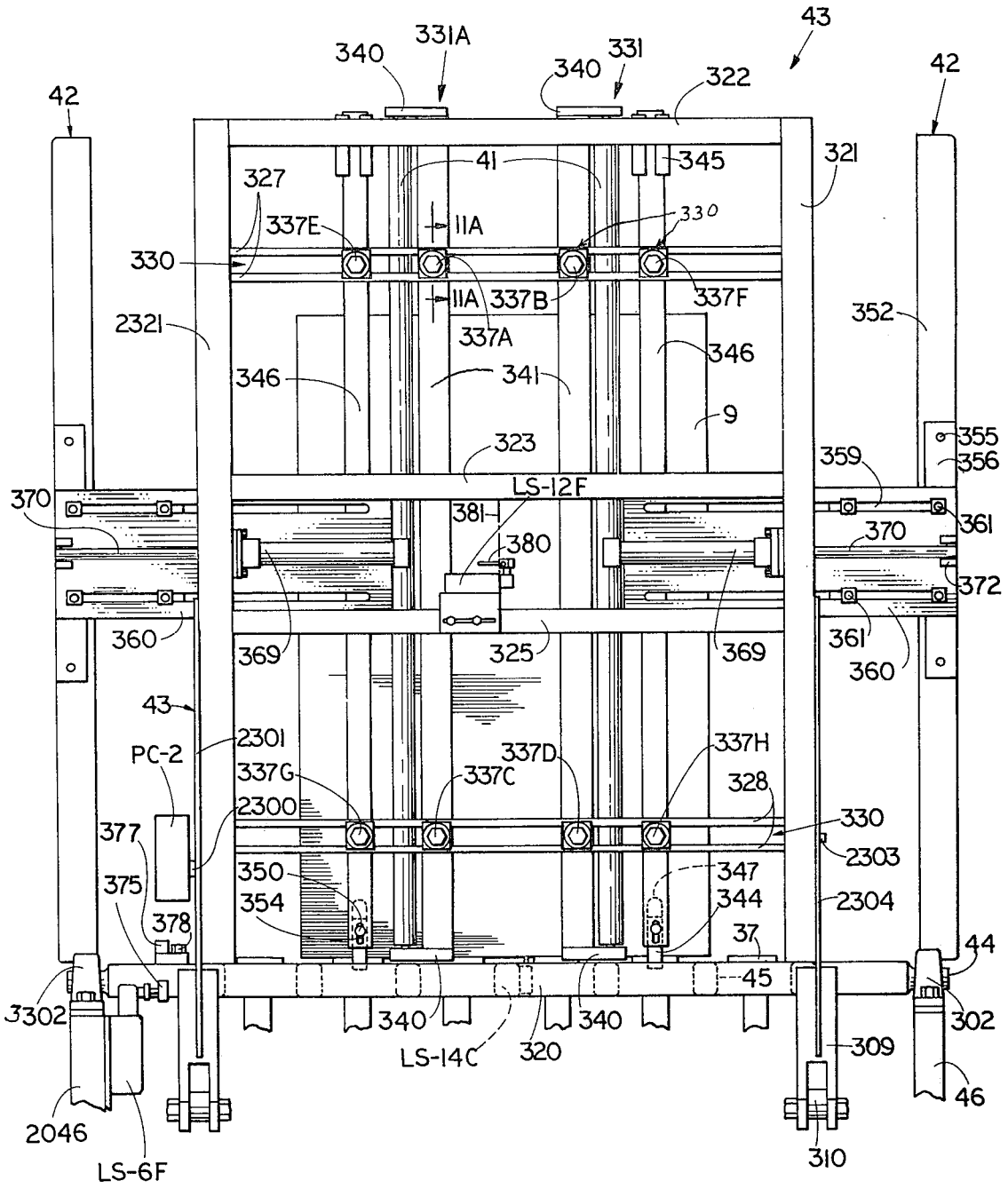
FIG. 12 is a view in end elevation of the tip-over table looking in the direction of the arrows 12—12 in FIG. 10 with side straightening members in extended position.

The automated crane 15 is shown in its deposit position in FIG. 10. The forks 202 are shown inserted between the slide rails 289, a center one of the forks 202 depressing a switch actuator 2298 of a limit switch LS-1F which starts the motor 280 to drive the belts 37 in a counterclockwise direction. The stack of cartons 9 that is now resting on the belts 37 moves from the fork lift 20 and proceeds to the left as shown in FIG. 10, overriding a limit switch arm 299 of a limit switch LS-14C depressing it to a position 299A, and comes to rest as it breaks a light beam of a photocell PC-2. The photocell PC-2 is supported on a bar 2300 attached to a frame element 2301 (FIGS. 11 and 12) of the back support 43 of the stack straightening or tip-over device 40. A target 2302 (FIGS. 10 and 11) for the photocell PC-2 is supported on a bar 2303 carried by a frame element 2304 of the back support 43. The limit switch LS-14C (FIGS. 2 and 10) is located on the center finger of the horizontal pickup fingers 45, also a part of the straightening or tip-over device 40. The stack straightening device 40 will hereinafter be called the tip-over. Closing of the switch LS-14C indicates that a stack 9 is present on the tip-over 40. When the stack 9 reaches and breaks the beam of the photocell PC-2, the tip-over 40 swings to the horizontal position shown in FIG. 11. The tip-over swings on the axis of the pivots 44 rotatably carried in a pair of bearings 302 and 3302 (FIGS. 10 and 12). The bearings 302 and 3302 are supported on posts 46 and 2046 which are attached to the bottom mounting frames 2292 and 292 (FIG. 10), respectively, and reinforced by diagonal members 305. A pair of triangular mounts 307 provides a rigid reference for a pair of cylinders 308 which swing the tip-over. Pivot arms 309 are secured to the frame elements 2301 and 2304 of the tip-over 40. Piston rods 310 of the cylinders 308 are pivotally connected to the pivot arms 309. Retraction of the piston rods 310 of the cylinders 308 rotates the pivot arms 309 to the dot-dash line position of FIG. 10 indicated at 309A. This will place the tip-over 40 in horizontal position (see FIG. 11). When the tip-over is in horizontal position, the stack of cartons is straightened, as will be explained more fully hereinafter. When the stack has been straightened, the tip-over returns from the horizontal position and the stack of cartons 9 remains stationary until the belts 37 (FIG. 10) move in a clockwise direction transporting the stack 9 from the tip-over 40 to the holding table 48 and permitting the switch LS-14C to return to its full line position of FIG. 10.

The tip-over 40 aligns the individual cartons of stack 9 with each other to form a perfect "board straight" stack on all sides for a non-jamming processing through the feeder machine 10. The tip-over 40 also places the entire stack of cartons 9 on the centerline of he deposit table 36.

Figure 11A:
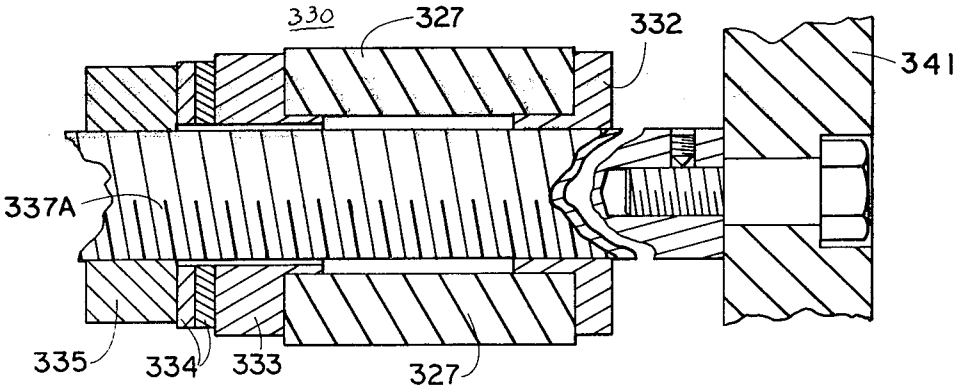
FIG. 11A is a fragmentary view in section taken on an enlarged scale on the line 11A—11A in FIG. 12.

Referring to FIG. 12, the pivots 44 are integral with a bottom horizontal member 320 of the back support assembly 43. The back support 43 includes the bottom horizontal member 320, two radially extending members 321 and 2321, a top transverse member 322, an outer lateral stiffener 323 and an inner lateral stiffener 325. The lateral stiffeners are located near the center of the members 321. A pair of closely spaced transverse mounting rails 327 is fixedly attached to the members 321 near the outer ends of the members 321 and, similarly, a pair of closely spaced transverse mounting rails 328 is fixedly attached near the inner ends of the members 321. Adjustably clamped to the mounting rails 327 and 328 are eight mounting stud assemblies 330. All the studs 330 are constructed in identical manner and are comprised (FIG. 11) of a block nut 332, a clamp block 333, a pair of washers 334, a clamping nut 335 and a threaded stud 337. The threaded stud 337 is fitted with an integral hex head 339 for rotation thereof. The block nut 332 is drilled and threaded on its inside diameter to cooperate with the threads of the stud 337. The clamp block 333 is drilled through for clear passage of the stud 337. If the clamping nut 335 is slightly loosened, the entire unit can be slid along its mounting rails (327 or 328) without changing the depth or thread setting of the stud 337. If the locking nut 335 is loosened and restrained and a torque is applied to the head 339, the stud 337 will advance or retract since the adjusting block 332 is restrained from rotation by close placement between the mounting members 327 or 328 in the manner shown in FIG. 11A. The mounting stud assemblies 330 therefore provide lateral ajustments as well as longitudinal adjustment. The inner set of four studs 337A, 337B, 337C, and 337D (FIG. 12) provide mounting points for a pair of roller assemblies 331 and 331A. Considering the assembly 331A, the assembly provides the vertical roller 41 rotatably mounted in a pair of end brackets 340 which are fixedly attached to a roller mounting member 341. The mounting member 341 is attached to the ends of the studs 337A and 337C in a manner as shown in FIG. 11A to permit the studs to rotate during adjustment.

When the tip-over 40 is in the lowered position of FIG. 11, the stack 9 rests on the rollers 41, and the end thereof remote from the pickup fingers 45 rests against the horizontal stack retainers 47. The retainer 47 includes a pair of fingers 343 angled at their free ends (FIG. 11) and each rigidly attached to one of a pair of mounting clamps 345 that slide on a pair of bars 346 and are held in a fixed position by a set of clamping bolts 348. Each of the fingers 343 is reinforced on the associated mounting clamp 345 by a brace 349. Each of the bars 346 is provided with a carton block 344 adjustably held in a slot 347 (FIG. 12) at the inner end thereof. A screw 350 (FIG. 11) extends through a slot 354 (FIG. 12) in the bar 346 and holds the carton block 344 in place. As shown in FIG. 11, a face 2344 of each block 344 is aligned with the upper edges of the rollers 41 when the tip-over 40 is in lowered position, and the blocks 344 support cartons of the stack which are to the right of the right-hand ends of the rollers 41. An outer set of four mounting studs 337E, 337F, 337G and 337H (FIG. 12) is mounted to the vertical bars 346 in a rotatable manner that permits the in/out adjustment of the studs in the same manner as the studs already described are mounted. The mounting stud structures permit independent adjustment of each roller assembly 331 and each horizontal stack retainer assembly 47 as can be required by cartons with staggered edges.

Figure 13:
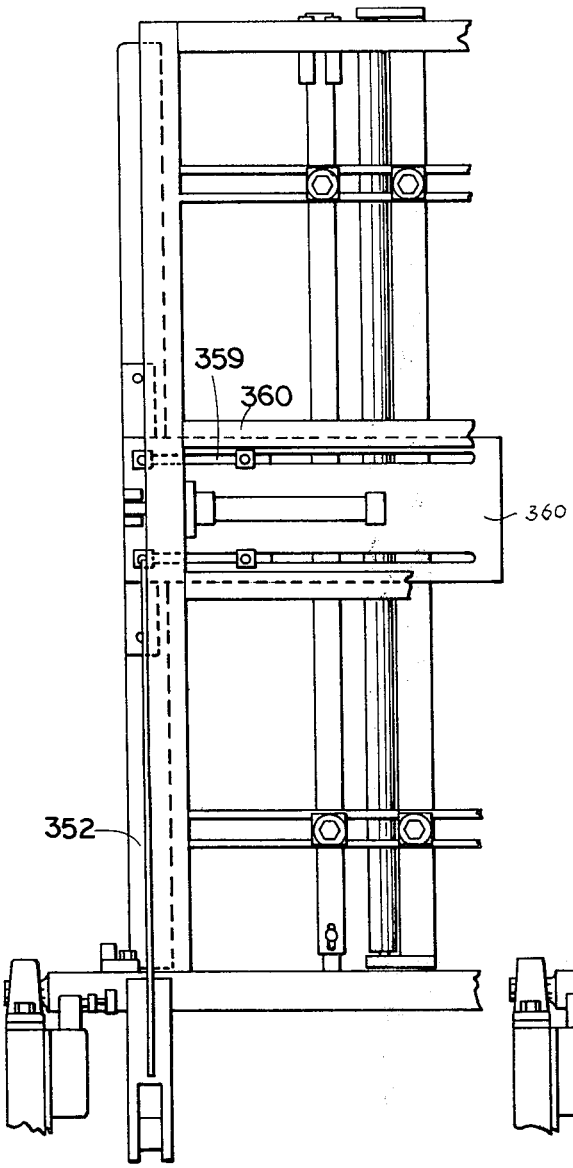
FIG. 13 is a fragmentary view looking in the same direction as FIG. 12 with the side straightening members in retracted position.
Figure 14:
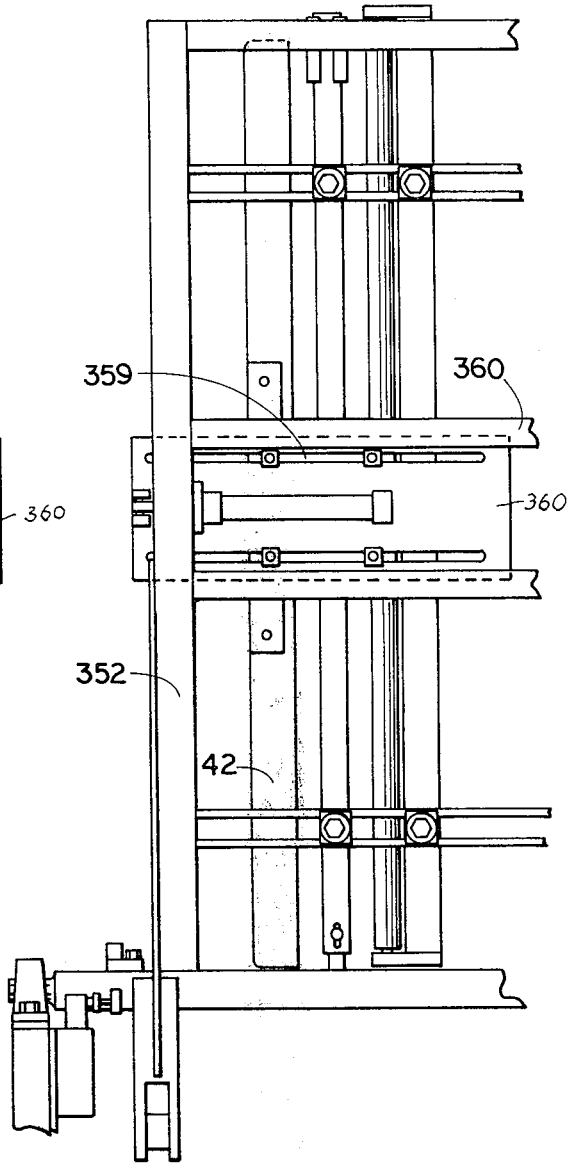
FIG. 14 is a fragmentary view looking in the same direction as FIGS. 12 and 13 but with the side straightening members in an adjusted retracted position.

Details of construction of the side clamp assemblies 42 are shown in FIGS. 11 and 12. Each assembly 42 incorporates a clamp bar 352 fixedly mounted on a pair of mounting lugs 353 (FIG. 11) by a pair of bolts 335. The lugs 353 are fixedly attached to a mounting plate 356 that is welded to a holding arm 357. The holding arm 357 is welded to a slide plate 359 that is clamped to a slide plate 360 by means of a set of four bolts and nuts 361 (FIG. 12). The slide plate 360 is guided by slots 362 (FIG. 11) formed in rails 365 that are attached to the face of the horizontal sitffeners 323 and 325 (FIG. 12) of the back support assembly 43 by bolts 367 (FIG. 11). The pair of slide plates 360 is moved and controlled by a pair of hydraulic cylinders 369 with associated piston rods 370. The free end of each of the rods 370 is pivotally attached to a pair of actuator lugs 372 rigidly affixed to the associated slide plate 360. The cylinders 369 are mounted on the side frames 321 and 2321 of the back assembly 43. When the slide plates 360 are disposed as shown in FIGS. 12 and 13 and the piston rods 370 are moved inwardly of the cylinders 369 from the FIG. 12 to the FIG. 13 position, the clamp bars are advanced inwardly for centering and straightening a stack. The slide plates 359 and 360 can be adjusted as between the position of FIGS. 13 and 14 to adjust the machine for a selected size of carton.

The set of pickup fingers 45 is shown in FIG. 12 by dashed lines. The position of the limit switch LS-14C is also shown in dashed lines in FIG. 12.

A limit switch LS-6F is mounted on the pivot support structure 2046 of the operator's side of the machine. A switch arm and roller 375 of the limit switch LS-6F is rotated downwardly (FIG. 12) as a trip 377, mounted on the horizontal member 320 of the back support structure 42, rotates downwardly into contact with it. The trip 377 is held in place on the member 320 by a pair of bolts 378.

The tip-over 40 is shown in a vertical position in FIG. 10 and in a horizontal position in FIG. 11. Starting with the FIG. 10 position the rotation of the tip-over 40 starts when the beam of light from the photocell PC-2 is interrupted. The photocell PC-2 also stops the motor 280 and therefore the belts 37. Thus, the stack 9 stops in a position whereby a vertical edge 313 of the stack 9 remains generously spaced away from and parallel to the rollers 41. As the tip-over 40 rotates, the carton stack 9 tips over until the static friction within the stack 9 is overcome, causing the cartons to fall into contact with the rollers 41. The impact from the fall separates the cartons that are stuck together by ink, humidity or friction effects. Referring to FIG. 11, as the tip-over 40 reaches its horizontal position, the carton blanks on the left end of the stack will tend to fall rotationally to the left. This fall is limited by the stack retainers 47, and carton blanks fan out so that the operator can brush them back and forth, remove damaged ones, or otherwise pat them into alignment with his hands. The carton blocks 344 prevent any carton blanks from sliding between the horizontal member 320 and the roller end brackets 340 (FIG. 12) while the tip-over 40 is in the horizontal position. After a time delay switch runs out, the side clamps 352 move inward under the power of the cylinders 369 and push the carton blanks on the sides to laterally align the carton blanks as well as to push the entire stack 9 to the centerline of the machine. As the cylinders 369 retract the rods 370, the slide plates 360 move toward the center of the machine. As shown in FIG. 12, the slide plate 360 on the operator side of the tip-over 40 contacts a switch arm 380 of a limit switch LS-12F and rotates it until the inner edge of the plate 360 is coincident with the dot-dash line 381. This makes the circuit associated with the switch LS-12F, indicating that the side clamps 42 are in, which sequences a programmer to be described in greater detail hereinafter to bring the tip-over up. As the tip-over 40 is coming up, the trip 377 rotates free of the limit switch LS-6F which opens the side clamps 42. The stack of cartons 9 are therefore replaced on the table 36, centered and straightened. The stack 9 will remain there until called for by other switches to be described hereinafter. When the stack is required, the crane 15 (FIG. 10) will have been removed from the deposit table, and the motor 280 is driven in a direction to advance the belts 37 clockwise to deliver the stack to the holding table 48.

HOLDING TABLE

The holding table 48 (FIGS. 15 and 16) includes the set of six timing belts 49 and the support structure assembly 50. The timing belts 49 are driven by a motor 385, (FIG. 15) in association with a gear box 386 that drives a sprocket 388. A chain 390 connects the sprocket 388 and a larger sprocket 391 that is rigidly affixed to a shaft 393 supplying power thereto. The shaft 393 is held in place by a set of bearings 394. A set of six notched drive rollers 395 are spaced uniformly along the shaft 393 and each of the set of belts 49 runs on one of the rollers 395. The timing belts 49 are held in place by the support structure assembly 50. The assembly 50 consists of a set of six slide rails 396 held in rigid horizontal position by the table-like support structure 50. The structure 50 is rigidly attached to a pair of cross members 399 that are welded to the bottom mounting frames 292 and 2292. A set of notched rollers 400, at the left hand ends of the slide rails 396 and mounted thereto, and a set of notched rollers 401 (FIG. 15) at the right hand end of the slide rails 396 and rotatably mounted thereon, in cooperation with a set of takeup rollers 403 rotatably mounted on the table structure 50 by means of a set of adjustable spindles 404 and also the set of drive rollers 395 permit advance of the belts 49 in the clockwise direction as driven by the motor 385. Each of the adjustable spindles 404 is rotatably mounted on an adjustable plate 2404. The plates 2404 are mounted on longitudinal frame members 397. Bolts 2405 which extend through slots 2406 in the plates 2404 hold the plates 2404 in adjusted position.

A photocell PC-1F is mounted on the slide rail 396 on the operator side of the feed table 48 and cooperates with a reflector 406 mounted by means of a strut 407 fixedly attached to the slide rail 396 but on the opposite side of the table 48 as shown in FIGS. 15 and 16. Another photocell PC-3F is located alongside but downstream of the cell PC-1F and cooperates with a reflector 408 mounted by means of a strut 410 that is also fixedly attached to the slide rails 396 opposite its companion photocell PC-3F. The light beams from both photocells are directed transversely across the table 48 and are interrupted by the passage of stacks of cartons 9 and do not require adjustment for different size cartons.

A limit switch LS-8C is located in the center of the feed table 48 on a slide rail 396A (FIG. 16) of the set of six slide rails 396. A switch arm and roller 413 extends above the timing belts 49 when cartons are not present, but will rotate clockwise (FIG. 15) when a stack of cartons 9 is transported along the feed table 48. Another limit switch LS-5F (FIG. 16) is mounted on a vertical support member 415 of the elevator support structure on the operator side of the feeder machine 10. A companion support member 416 is located on the opposite side of the feeder machine 10. A trip 417, rigidly affixed to the fork elevator 52 rotates a switch arm and roller 419 in a downward direction as the fork elevator 52 reaches its bottom travel limit.

When the feeder machine 10 is in operation, the sequential programmer will call for different functions in proper and automatic order which will be described hereinafter. Within the automatic sequence, the position 420 of the stack of cartons 9, shown in dot-dash lines in FIG. 15, shows the stack in its standby position. In other words, it has stopped upon interrupting the light beam of photocell PC-1. The stack at this position also depresses the limit switch LS-8C. At the same time, the vertical lift device 51 has been processing a stack of cartons into the pick-off device 75 (FIG. 18). When the tongue elevator 58 (FIG. 16) raises sufficiently to provide clearance for another stack of cartons 9 to enter under it without interference, the fork elevator 52 is returned to its bottom position. The motor 385 advances the belts 49 of the feeder table 48 to move the stack of cartons from the position 420 toward the lift device 51. The stack 9 passes off the limit switch LS-8C which releases it and consequently calls for the crane 15 to move toward the deposit table 36 with another stack of cartons. The crane 15 will not move until the limit switch LS-14C (FIG. 10) is clear. As this is taking place, the stack from position 420 (FIG. 15) is passing through the light beams of photocells PC-1 and PC-3, and continues along the table 48 until the light of PC-3 is re-established causing the belts 49 to stop. This stack position is shown in solid lines at 9 in FIG. 15. When PC-1 sees its own light, it makes the circuit to the motor 280 so that both the timing belts 37 and the timing belts 49 run toward the fork elevator to start the stack of cartons 9 that is waiting in the tip-over 40 toward the feeder table 48, and also releases the limit switch LS-14C (FIG. 10) so that the crane 15 now moves toward the deposit table 36. The re-establishment of the light beam of PC-3 (FIG. 15) stops the motor 385 and therefore the timing belts 49, and also makes the circuit which commands the fork elevator 52 to start its upward traverse. When the fork elevator 52 has left the bottom position the limit switch LS-5F is released to make the circuit to the motor 385 and thereby restart the belts 49. The belts 49 are motionless only momentarily, that is, long enough for the fork elevator 52 to lift the stack of cartons 9 off the belts 49. The timing belts 37 and 49 continue to run until the stack from the tip-over 40 has moved across the deposit table 36 onto the feed table 48 and interrupted the light beam of the photocell PC-1, and again depresses LS-8C resetting its circuit. In the full cycle the fork elevator raises the stack 9 and transfers it to the tongue elevator 58 (FIG. 16). After the tongue elevator 58 raises sufficiently to provide clearance for another stack of cartons 9 to enter under it without interference, the fork elevator 52 is lowered to its bottom position and the cycle repeats.

FORK ELEVATOR

The vertical lift device 51 lifts discrete stacks of cartons 9, sequentially fed from the feeding table 48, into vertical alignment and physical contact with each other for continuous feed into the individual carton pick-off device 75 (FIG. 18). The vertical lift device 51 is made of two major sections, the lower fork elevator 52 and the upper tongue elevator 58.

The lower fork elevator 52 is located to the intermediate right of the feeder table 48 as shown in FIG. 17. The fork elevator 52 is mounted on the pair of vertical guide rails 55 (FIGS. 16 and 17). The upper ends of the guide rails 55 are rigidly attached to the top longitudinal beams 430 of the lift device's main framework and are held in spaced relationship with the beams 430 by means of a pair of guide rail spacers 431 (FIG. 16). The lower ends of the rails 55 are attached in a same manner to the pair of bottom mounting rails 292 and 2292. The two vertical support members 415 and 416 provide rigid spaced relationship for the top longituding beams 430 and the bottom mounting rails 292 and 2292. A lateral beam 434 adds lateral stability to the feeder framework in the area of the vertical lift device 51 and is the complement of a cross member 435 at the bottom of the machine.

The fork elevator 52 incorporates a set of seven box beam forks 60 as shown in FIGS. 16 and 17. Each of the box beams of the forks 60 is rigidly attached to an upper portion of a side face of a butt plate 437 (FIG. 17) and is held in rigid alignment therewith by a braace 438. Each butt plate is fixedly bolted to a fork mounting plate 439 by means of a pair of bolts 440. The individual forks are uniformly spaced along the mounting plate 439 in order that they mesh and sit evenly spaced between the slide rails 396 of the feed table 48. The fork mounting plate 439 is fixedly bolted at each of its ends to a mounting flange 441 by bolts 442. Each flange 441 is in turn welded at right angles to a roller box mounting arm 443 that is disposed parallel to the forks 60. The mounting arms 443 in turn are attached to the roller boxes 54 with mounting arm spacers 2443 in between to provide proper lateral spaced relationship with the rest of the machine. Each fork elevator roller box 54 comprises an inside cover 445 (FIG. 16), a pair of box spacers 446 (FIG. 17), and an outer cover 447. The inside cover 445 and the box spacers 446 are welded together. The outer cover 447 is bolted to the box spacers 446 by a set of eight bolts 449. The lower left hand corner of the roller box 54 has been broken away in FIG. 17 to show one roller 450 of a set of four rollers mounted in roller box 54. The roller 450, like the others in the set of rollers, is rotatably mounted on a shaft 453 which is bolted between the inside cover 445 and the outer cover 447 of the roller box 54. The set of four rollers 450 engage sides of the associated guide rail 55 at corners of the roller box 54 and provides the roller box 54 and therefore the fork elevator 52 with rotational or torque stability. Each of the roller boxes 54 also carries a lateral support roller 455 which is rotatably mounted on a shaft 456 carried by a mounting fixture 457 that is attached to the outer cover 447. The lateral support roller extends through a hole 458 provided in the outer cover 447 and rolls on an outer face of the associated guide rail 55. Vertical movement of the fork elevator 52 is caused by means of the fork elevator cylinders 56 (FIG. 16). Piston rods 460 are driven by the cylinders 56. Each of the cylinders 56 is pinned to one of the bottom mounting frames 292 and 2292 and is vertically disposed. The upper end of each piston rod 460 is attached to one of the chains 57 that extend up and over sprockets 463 that are attached to a lateral shaft 464. The shaft 464 is pivotally held in a pair of bearings 465. Each chain 57 descends vertically and is attached to one of the fork elevator roller boxes 54 (FIG. 17) by means of a turnbuckle 466 and a chain tie down block 467 that is rigidly attached to the upper left hand corner of the roller box 54.

The placement of the limit switch LS-5F on the operator side of the machine has been previously described. The operation of the fork elevator 52 is also dependent upon a limit switch LS-10F. The switch LS-10F is mounted on the vertical member 415 directly about LS-5F and is also operated by the trip 417 that is rigidly attached to the fork elevator 52 as shown when the fork elevator 52 is at the top of its stroke.

When the tongue elevator 58 has risen sufficiently to provide clearance for another stack of cartons 9 to enter under it without interference, it signals the fork elevator 52 to descend, that is, the fork elevator 52 has been waiting in a position 52A shown in dot-dash lines in FIG. 17. The elevator 52 descends in a rapid transverse mode and is stopped in its downward travel by the limit switch LS-5F. The switch LS-5F also starts the motor 385 (FIG. 15) and thereby transports the stack of cartons 9, waiting at the photocell PC-1, onto the fork elevator 52. The upper faces of the belts 49 of holding table 48 are slightly above the upper faces of the forks 60 of the fork elevator 52 when it is in the bottom position on switch LF-5F as shown in FIGS. 16 and 17. The carton stack 9 therefore passes over the forks 60 and comes to rest when the trailing edge of the stack 9 passes the photocell PC-3 permitting it to reestablish its own light, which breaks the circuit to the motor 385 and stops the belts 49. The photocell PC-3 also starts the fork elevator 52 to come up in rapid traverse mode. The forks 60 impact the bottom of the stack 9 and lift it vertically. As soon as the switch arm and roller 419 of switch LS-5F is released, the motor 385 is again started as described in a preceding paragraph. The fork elevator ascends in rapid traverse until it catches up with the tongue elevator 58. When the stack on the fork elevator reaches the tongue elevator, a circuit is made that transfers control of the ascent of the fork elevator to the pick-off device 75 (FIG. 18) that is controlled, which will be described hereinafter. The fork elevator 52 continues to ascend in controlled traverse until the trip 417 of the elevator 52 rotates a switch arm and roller 471 (FIG. 17) of the limit switch LS-10F and makes the circuit that stops the operation of the cylinders 56, thereby halting the fork elevator 52. Making of the switch LS-10F also calls for the tongue elevator 58 to come in under the stack 9 and take over lifting the stack into the pick-off device 75.

TONGUE ELEVATOR

Details of construction of the tongue elevator 58 are shown in FIGS. 18–22 inclusive. The tongue elevator 58 includes two major assemblies, namely, a lift assembly 76 (FIG. 18) and the tongue and slide assembly 78. The tongue elevator 58 is mounted directly above the fork elevator 52 and moves vertically on the guide rails 55, which also guide the fork elevator 52.

Referring to FIGS. 18 and 19, the lift assembly 76 provides the pair of roller boxes 59 which guide vertical movement of the tongue elevator 58. Speaking of one of the roller boxes of the pair 59, the roller box assembly comprises an inner cover plate 480, a pair of spacer bars 481 welded thereto, and an outer cover plate 482, fixedly attached to the spacer bars 481 by a set of eight bolts 484. The spacer bars 481 allow room at both their ends for a set of four rollers 483, only one of which is shown in FIG. 18, rotatably mounted on a set of corresponding shafts 485. Each shaft 485 is fixedly held in place by a nut 487 (FIG. 19). The set of rollers 483 provide the roller boxes 59 with rotational stability in the longitudinal plane and permit vertical movement thereof. The rollers 483 roll on sides of the associated guide rail 55. A lateral support roller 488 is rotatably mounted on a shaft 490 (FIG. 18) that is fixedly held in a channel bracket 491 by a pair of nuts 492. The lateral support roller 488 extends through an opening 493 in the channel bracket 491 and a rectangular hole in the cover plate 482 so that the roller 488 rolls on an outer face of the associated guide rail 55. The lateral rollers 488 of the set of roller boxes 59 provide the tongue elevator 58 with lateral stability. Power for the vertical movement of the tongue elvator 58 is supplied by the pair of cylinders 62 mounted in identical manner to that of the cylinder 56, but to the right of cylinders 56 when viewing FIGS. 17 and 18. The cylinders 62 actuate a pair of piston rods 494 that are attached to the lift chains 65. The chains 65 rise vertically to sprockets 68 (FIG. 19) that are fixedly attached to a shaft 495 which is in turn rotatably held in a pair of bearings 496 (FIG. 18) on top of the feeder machine 10. Each of the chains 65 descends to be attached to a mounting lug 497 (FIG. 18) at an upper corner of one of the roller boxes 478 as shown in FIG. 18 by means of a latch bolt 499. The lug 497 is welded to the roller box spacer 481. A limit switch trip arm 501 (FIG. 18) of L-shape is fixedly attached under two of the bolts 484 but on top of the roller box cover plate 482 of the roller box 478 on the operator side of the machine.

The inner cover 480 of each roller box 478 carries one of a pair of mounting brackets 502. A cover plate 522 of the slide assembly 78 (to be described hereinafter) is attached to each bracket 502 by means of bolts 505.

Referring to FIG. 20, a tongue assembly 507 is comprised of the set of 6 tongues 69 (FIGS. 19 and 20) rigidly attached to a tongue mounting bar 508. Each tongue is attached to the bar 508 by a pair of nut and bolt assemblies 510 (FIG. 20). The tongues 69 are uniformly spaced along the bar 508 and are so placed as to fit between the forks 60 of the fork elevator 52 when the fork elevator 52 is in its up position and the tongue elevator 58 is in its down position. The bar 508 is fixedly fitted at each of its ends with a tongue pivot plate 511. The tongue pivot plate 511 incorporates a tab 514 located at its left end when viewing FIG. 20. The plate 511 rotates about a pair of pivot bolts 512 (see FIG. 21). The bolts 512 are held in the plates 511 by means of a pair of sleeve bearings 513. Downward swinging of the free ends 514 of the pivot plates 511 is restrained by a pair of retainer bolts 515, one of which is shown in FIG. 22, and which are mounted in slide bars 518. The tips of the tongues 69 are free to rotate upwardly if necessary when withdrawing from between two stacks of cartons.

Referring to FIGS. 18 through 22, and most specifically to FIG. 21, the tongue assembly 507 is rotatably held by the pivot bolts 512 to the sliding portion 516 of the slide assembly 78. In general, FIG. 21 shows the sliding or movable parts 516 in section, while the relative stationary parts or rail parts 517 are shown not sectioned. More specifically, FIGS. 20 and 21 show that each of the pivot bolts 512 is threaded into one of the pair of slide bars 518. A spacer bar 519 is fixedly attached to each of the slide bars 518. A rack 520 is fixedly attached to the bottom of each of the spacer bars 519 to complete the sliding assembly 516.

As shown in FIG. 21, the slide bars 518 are slidably supported by the cover plates 522. At the upper edge of each cover plate 522 is mounted an upper guide rail 523. At the lower edge of the cover plate 522 is located a lower guide rail 524. The guide rails retain the slide bars 518 in horizontal position. A slide retainer 526 is fixedly attached to the upper slide rail 523 and restrains the slide rail 518 from lateral dislocation. Both sides of the sliding assembly 516 must remain parallel within the rail members 517 of the slide assembly 78 to prevent binding or locking of the horizontal motion of the tongues 69. The slide assembly 78 is therefore equipped with a pair of gears 528 to cooperate with the racks 520. The gears 528 are fixedly attached to a shaft 529 that is rotatably held in a pair of bearings 530. The bearings 530 are fixedly attached to the outside of the cover plates 522 of the rail or stationary members 517 of the overall slide assembly 78.

Power for movement of the slide assembly 516 with respect to the rail members 517 is provided by the pair of tongue slide cylinders 73. The slide cylinders 73 are attached to mounting blocks 532 that are rigidly attached to the retainer rails 526. Each of the cylinders 73 incorporates a cylinder rod 533, the free end of which is attached to the sliding parts 516 through a rod mount 535 (FIG. 18) which in turn is rigidly affixed to one of the slide spacers 519, as shown in FIG. 18.

A set of upright stripper bars 537 (FIGS. 18, 19, 22 and 22A) cooperate with the tongue elevator system 58. A horizontal and lateral stripper mounting bar 539 carries a pair of mounting pads 541 (FIGS. 21 and 22) at opposite ends thereof which are attached to the retainer rails 526 by bolts 540. The stripper bars 537 are long vertical members that retain the stack of cartons 9 as it enters the fork elevator 52. They are nonuniformly placed along the bar 539, as shown in FIG. 19, so that they pass between both the forks 60 and the tongues 69. Each stripper bar 537 is fixedly attached to a pair of horizontal and longitudinally disposed members 543 (FIG. 22) henceforth called an adjustable stripper mount 544. The bar 537 is welded between the ends of the members 543. Bolt and nut and washer assemblies 545 fixedly clamp the stripper mount 544 to the stripper mounting bar 539 (see FIGS. 18, 22, and 22A). As can be seen in FIG. 19, the stripper bars 537 extend slightly above the tongues 69 to provide a backstop to the carton stack while the tongues 69 are being pulled out from under the stack. The stripper bars 537 also are longitudinally adjustable, since the stack of cartons 9 on the deposit table 36 will stop as soon as it passes the photocell PC-3 (FIG. 17). In other terms, the photocell PC-3 determines the position of the stack of cartons 9 in the elevator system 51. The front edge of the carton stack will always be in the same place, that is, in line with the discriminator 85 (FIG. 18). Therefore, for different size cartons, the strippers 537 are longitudinally adjustable in order to make contact with the advancing side of the stack 9.

A group of limit switches control the movement of the tongue elevator 58 and relate it to the fork elevator 52 and to the pick-off device 75. Referring to FIG. 18, the limit switch LS-10F (FIGS. 16 and 17) is located on the vertical support member 415 on the operator side of the machine 10 and is actuated by the fork elevator at the tip of its stroke as previously described. A lateral cross member 546 (FIGS. 18 and 19) adds strength and lateral stability to the tongue slide assembly 516. A limit switch LS-7F is mounted and adjustable on a plate 547 that is mounted to the bottom of the member 546 and extends to the right therefrom as in FIG. 18. The switch LS-7F is mounted adjacent to one of the racks 520 and incorporates a switch arm and roller 550 that cooperates with a surface 551 of the cover plate 522 which is close to the rack bearing 530 on the operator side of the machine 10 when the tongues are in an advanced position shown in FIG. 17. A limit switch LS-8F (FIG. 18) is also supported by the lateral cross member 546 but on the opposite side of the machine from LS-7F. The limit switch LS-8F is mounted on a plate 553 (FIG. 19) in similar manner to the switch LS-7F. The switch LS-8F incorporates a switch arm and roller 555 (FIG. 18) that cooperates with a switch trip 556 of L-shape and mounted to the cover plate 522 of the rail parts 517. The trip 556 extends to the right (FIG. 18) and downwardly to make contact with the arm and roller 555 when the tongues 69 are in the retracted position of FIG. 18. The limit switch LS-9F is supported at the center of the member 546 by means of a mounting plate 557 that is rigidly affixed to the member 546 as shown in FIG. 19. The switch LS-9F is made and unmade by a push button 558 (FIG. 18) located on top of the switch box. The push button 558 is depressed by a Z-shaped lever arm 560 that pivots about an axis 561 installed on a pair of mounting brackets 563 that are attached in a vertical manner to the lateral member 546. The lever arm 560 generally extends to the left (FIG. 18), then downwardly, then to the left again in order for its end to reach a position slightly below the tongues 69 for actuation thereof as a stack of cartons 9 raises into contact with the tongue elevator 58. A limit switch LS-3F on the operator side of the machine is shown in FIG. 18 to cooperate with the trip 501 already described. This switch employs a double switch arm and roller 562 so that the circuit is made and kept as the tongue elevator 58 rises, and is reset by the trip 501 as the elevator 58 descends. This switch is adjustably clamped to a vertical bar 565 that is held in place by a pair of horizontal bars 566 that are mounted to a control panel 567 located on the operator side of the feeder machine 10. The switch LS-3F is actuated when the tongue elevator 58 has been raised sufficiently for a new stack to enter thereunder.

The tongue elevator 58 is shown in its pause position, or waiting position, in FIG. 18. The tongue and slide assembly 78 is stored in it retracted position. In normal sequence, the fork elevator 52 raises a stack of cartons 9 in rapid traverse from the holding or feed table 36 until the top of the carton stack 9 touches the pick-off device 75. Traverse control is then transferred to the pick-off device 75. The fork elevator 52 continues to raise under rated traverse until it makes the switch LS-10F (FIG. 17) which is the full up position for the fork elevator 52. The switch LS-10F stops the fork elevator and makes the circuit which tells the cylinders 73 to retract rods 533 and thereby move the tongue and slide assembly 78 into place under the stack 9. The tongue and slide assembly 78 moves toward the stack 9 until the switch arm and roller 550 of switch LS-7F contact the trip surface 551 thereby stopping the cylinder 73. It also makes the circuit to the cylinder 62 that begins to retract the rods 494, thus raising the tongue elevator in a controlled or rated manner under control of the pick-off device 75 (FIG. 18). As the tongue elevator 58 continues to rise in rated traverse, the trip 501 contacts and throws the switch arm and roller 562 to its up position, making the circuit to the cylinder 56 which lowers the fork elevator to pick up another stack of cartons. The position of the switch LS-3F is such to provide clearance for another stack 9 under the tongue elevator 58. The fork elevator 52 picks up its new stack and brings it up in rapid traverse until the top of the stack of carton blanks 9 contact the end of the pivot arm 560 which in turn depresses the button 558 of the switch LS-9F, making the circuit which stops the fork elevator 52. The switch LS-9F also makes the circuit to the cylinders 73 which extend the rods 533 to push the tongue and slide assembly 76 from under the preceding stack 9, consequently dropping it on the succeeding stack 9. The tongue and slide assembly 78 retracts under the power of the expanding cylinder 73 until the switch arm and roller 555 of limit switch LS-8F contacts the trip 556. This makes the circuit to stop the cylinders 73. It also makes the circuit that restarts the upward motion of the fork elevator 52, but under the rated control of the pick-off device 75. The switch LS-8F simultaneously makes the circuit to the cylinder 62 that moves the tongue elevator down in rapid traverse to its waiting position, thus completing a typical cycle.

If the fork elevator does not supply another stack, the tongue elevator 58 will continue to feed the advancing stack 9 into the pick-off device 75 until all the cartons are gone (phantom lines at 58R in FIG. 18).

CARTON PICK-OFF

The stack of carton blanks 9 rises into contact with the carton pick-off device 75. The pick-off device 75 is shown in FIGS. 19, 23, 24 and 25. In general, the pick-off 75 comprises in assembly the set of four belts 80, the frame 83 (FIGS. 23 and 24), and the control assembly 89.

The feeder machine framework provides a pair of short vertical frames 571 on the operator side of the machine 10 and 570 on the opposite side, or right side, of the machine 10. Power is fed from the turnover assembly 90 (FIG. 25) (as will be explained hereinafter) into a power sprocket 2766 (FIG. 25A) on the operator side of the machine 10. The power sprocket 2766 is rigidly attached to the drive shaft 87 that is rotatably held to the short vertical frames 571 and 570 by a pair of bearings 575. Rotatably mounted on the drive shaft 87 is the framework 83 (FIG. 23) of the pick-off device 75. The framework 83 incorporates a pair of side frames 576 and 2576 held in rigid parallelism with each other by a forward lateral brace 578 and a rear lateral brace 580 (FIGS. 19 and 24). The frame 83 is pivotally mounted to the drive shaft 87 by means of a pair of bearings 581 rigidly affixed to the ends of the side frames 576 adjacent to the forward lateral brace 578. The opposite end of each of the side frames 576 and 2576 is fitted with an adjusting plate 583, one of which is shown in FIG. 24, on the inside thereof. The adjusting plates 583 are each retained slidably on the associated frame 576 or 2576 by a pair of adjusting bolts 584 (FIG. 23) that are threaded into the plates 583 and pass through slots 586 provided in the side frames 576 and 2576. A tension bolt 587 is provided for each adjusting plate 583 and freely passes through a mounting block 588 fixedly attached to the respective side frame 576 or 2576 and threads into the accompanying adjusting plate 583. Rigidly attached to the pair of adjusting plates 583 is a pair of bearings 590 that rotatably carry an idler shaft 591. The set of eight timing wheels 81 are rigidly affixed to the drive shaft 87 and idler shaft 591 to provide carriage and rotational power to the set of four pick-off belts 80. As the pair of tension bolts 587 are tightened into the plates 583, the plates 583 move toward the mounting blocks 588, tightening the timing belts 80 on the rollers 81. After the tension is set, the bolts 584 are tightened to clamp the adjusting plate 583 to the frames 576 and 2576, thus securing the belts 80.

A lateral bar 592 is mounted at the center of the side frames 576 and 2576 and is held rigidly in place by a pair of bolts 593 which pass through the side frames 576 and 2576 and thread into the bar 592. A set of four collars 595 are fixedly attached to the bar 592 and spaced to cooperate with the belts 80. A set of mounting arms 597 mounted to the collars 595 provide support for a set of shafts 598 (FIG. 24). Rotatably mounted on the shafts 598 is a set of damping rollers 599 that ride against the belts 80 to provide stability thereto.

Also mounted on the frame 83 is a belt slide plate 600. The slide plate 600 cooperates with the belts 80 to limit the deflections of the belts 80 when under load from a stack of cartons 9. The plate 600 is mounted to the forward lateral brace 578 and the rear lateral brace 580 by a set of four bolts 601 that pass through the lateral braces 578 and 580, and are locked in place by four pairs of opposing nuts 603 (FIG. 23). Heads 602 of the bolts 601 are welded to the plate 600.

The rotation of the framework 83 is governed by the control assembly 89. The control assembly 89 is basically a counterweight device 605 that offsets the majority of weight of the pick-off 75 that would otherwise be exerted on the top of a stack of carton blanks 9. A microtorque control system 606 is also included in this system to control the rate of feed of the stack in order to maintain a constant predetermined pressure on the top of the stack 9.

The counter balance system 605 incorporates a pair of supporting chains 608 that are fixedly attached to the right end of the pick-off side frames 576 by means of a pair of chain anchor blocks 609 as shown in FIG. 23. Ends of the chains 608 are fixed to a pair of sprockets 611 that are rigidly attached to a counter balance shaft 612. The shaft 612 is rotatably held on top of the feeder machine 10 by a pair of bearings 613, one of which is shown in FIGS. 23 and 24, fixedly mounted on top of the horizontal frame members 430 and 431. A portion 614 of the shaft 612 extends beyond the one of the bearings 613 on the side of the feeder machine 10 opposite to the operator, as shown in FIG. 24, and carries a counterweight lever 616 that is fixedly clamped to the shaft 612 by means of a pair of bolts 617. The counterweight lever 616 is a fork arrangement which incorporates a stop 618 therebetween to act against a down stop screw 619 (FIG. 23) that is adjustably mounted in a stop block 620 fixedly attached to the side of the frame member 431. The down stop screw 619 acts to prevent runaway of the pick-off device 75 when no elevator or cartons is present to restrain its motion. A counterbalance link 622 is pivotally attached at its upper end on a pin 2622 which extends between the forks of the counterweight lever 616, while its lower end is similarly pivotally attached to a pin 2623 which extends between forks of a secondary lever 624 (FIG. 23). The forks of the secondary lever 624 are held in spaced relation with each other by means of a pivot block 626 (FIG. 24). A shaft 627 extends slidably through the secondary lever 624 at the pivot block 626 and is threaded into a stationary mounting block 628 attached to the frame member 431, as shown in FIG. 24, to pivotally mount the secondary lever 624. A stop bracket 630 (FIG. 23) is mounted on the member 431 and carries a stop screw 631 with a jam nut 633. The stop screw 631 limits the amount of movement that the counterbalance system receives when a stack of cartons 9 impacts the pick-off device 75, which can occur while the elevators are delivering a stack 9 in rapid traverse mode.

The right end of the secondary lever 624 is coupled to a piston rod 636 of a cylinder 635. The cylinder 635 constantly pushes on its piston rod to counterbalance the weight of the pick-off device 75. The piston rod 636 is attached to the secondary lever 624 by means of a cylinder rod coupling 637 pivotally mounted on a pin 638 carried by the secondary lever 624. The counterbalance cylinder is in turn pivotally attached to a cylinder mount 3638 rigidly attached to a frame member 640 of the feeder machine 10. The cylinder 635 is a single acting cylinder with an independent control circuit designed to maintain a constant pressure in the cylinder 635.

The microtorque control system 606 is shown in FIG. 23. A microtorque frame member 642 is fixedly attached between the frame members 416 and 640. A microtorque valve 643 is fixedly attached to a microtorque mounting plate 644 that is in turn rigidly affixed to the frame member 642. The microtorque valve 643 is equipped with a control arm 646 that is pivotally attached to a link rod 647 that connects to the counterweight lever 616 near the link 622. The counterweight lever 616 is equipped with spaced holes 648 to provide a change in mechanical advantage if necessary. The rod 647 is equipped with a pair of turnbuckle connections 650 for adjustment of the microtorque switch system.

As the lift system feeds cartons to the pick-off device 75, two things can occur. First, if the system feeds too fast, the pick-off device 75 will be raised above its median position, the microtorque valve 643 will be rotated in the counterclockwise direction in FIG. 23 and valving therein (to be described in greater detail hereinafter) will power the elevator cylinders 56 and 62, whichever is in the feed portion of its cycle in lowering direction. If the feed of the lift system 51 is too slow, the pick-off device 75 will descend against the constant reaction force of the cylinder 635. The appropriate linkages will rotate the microtorque control arm 696 in a clockwise direction, powering upwardly the one of the lift cylinders 56 and 62 connected thereto. This is what has been previously referred to as rated control from the pick-off device 75. The pick-off device 75 is also capable of assuming whatever angle is necessary to cooperate with different carton sizes but still retain the constant load factor permitted by or set into the counterbalance control system 89.

CARTON TURN-OVER

The pick-off device 75 cooperates with the discriminator assembly 85 (FIG. 25) to produce a controlled stream of cartons for entry into the turnover assembly 90. The discriminator assembly 85 is shown in FIGS. 19 and 25, and comprises a vertically adjustable carriage 652 (FIG. 19), a pair of discriminator bracket assemblies 653, and a pair of mounting plates 655. The mounting plates 655 are fixedly attached to the outside of and extend below the extremity of each of the short vertical beams 570 nd 571. The lower extremity of the short vertical beams 570 and 571 is indicated at 657 in FIG. 25. Each of the plates 655 incorporates an upright slot 658 near the lower end thereof, each slot being paralleled by a pair of upright roller guides 659 that are fixedly attached to the inside of the plates 655 by a set of bolts 660. Referring to FIG. 19, the vertically adjustable carriage 652 is comprised of a discriminator shaft 662 and a pair of sprockets 663 mounted thereto, a handle 664 mounted on the shaft 662, a pair of bearing blocks 665 rotatably mounting the shaft 662, a top bar 667, a bottom bar 668, and a pair of support chains 669 fixedly attached to their respective anchor blocks 670. The discriminator shaft 662 is rotatably held in bearings 2670 (FIG. 19A) imbedded in the bearing blocks 665 and passes through the slots 658 (FIG. 25) in the mounting plates 655. The sprockets 663 (FIGS. 19 and 25) are fixedly attached near the ends of the shaft 662 and are on the outside of the mounting plates 655. The chains 669 are fixedly attached to the sprocket 663 at one end and likewise fixedly attached to anchor blocks 670 carried by the plates 655 at the other end. The handle 664 (FIG. 19) is keyed to the shaft 662 on the operator side of the feeder machine 10. Discriminator shaft locks 671 (FIG. 19A) are provided inside the bearing blocks 665. Each shaft lock 671 has a cylindrical body slidably mounted in a bore 2672 in the associated bearing block 665. A slot 2673 in the body 671 receives the shaft 662.

When the handle 664 is moved through an arc, the chains 669 wind up about the sprockets 663, causing the shaft 662 to rise because of the restraints of the slots 658. The assembly remains in place when a pair of locking bolts 673 threaded in the shaft locks 671 are turned to draw the shaft locks 671 along their bores 2672 to lock the shaft 662 within the bearing blocks 665. The bearing blocks 665 do not rotate out of position because the top bar 667 and the bottom bar 668 are frictionally inserted into the blocks 665, and pass through them to slide within the slots formed by the set of roller guides 659 (FIG. 25) on both sides of the machine 10.

Each of the pair of discriminator bracket assemblies 653 (FIG. 19) incorporates a pair of bar supports 674 through which the bars 667 and 668 pass frictionally and the shaft 662 without friction. A discriminator bracket 675 is mounted on the top of each bar support 674, a pair of which function as mounts for one of a pair of discriminator plates 651. The discriminator bracket assemblies 653 can be placed anywhere along the carriage assembly 652 to cooperate with different size cartons. As shown in FIG. 25, the discriminator plates 651 are angled at their lower portions to accept a stack of cartons that may not have been perfectly placed in the lift device 51. The upper portion of the discriminator plate is also angled to control the amount of forward slip transmitted down through the stack by the friction of the pick-off belts 80. It also begins the shingling process that is determined by the distance between the discriminator plates 651 and the pick-off belts 80.

The function of the pick-off device 75 and the discriminator 85 in combination, is to deliver a procession of shingled cartons which can be delivered to a customer machine (not shown) at the rate required by the customer machine, and with the percent of overlap requred.

The string of shingled cartons is delivered to the turnover device 90. The turnover device 90 incorporates the drum 91, the belt assembly 93 and a drive assembly 677 (FIG. 25). A pair of front vertical support members 678 and 2678 (FIG. 1) is mounted between the bottom mounting frames 292 and 2292 and the top horizontal frames 430 and 431 at a longitudinal position approximate the intersection of the deposit table 36 and the holding table 48. Toward the upper part of the structure a pair of short horizontal beams 679 (FIG. 25) is fixedly attached between the front vertical members 678 and 2678 and the short vertical members 570 and 571.

The drum 91 is fixedly attached to a drum shaft 680 that is rotatably held in a pair of bearings 682 mounted on the short horizontal beams 679, each by a pair of bolts 683. Fixedly attached to the drum shaft 680 is a large drive sprocket 685.

The belt assembly 93 incorporates a pair of top tension and pressure pivot mounts 687, a pair of slack adjustment pivot mounts 688 and a pair of pick-off pressure mounts 689. The top tension and pressure pivot mounts 687 are slidably mounted on a drive shaft 690 and are mounted on and can be attached to a pair of take-up brackets 692, each by means of a pair of adjusting bolts 693 that slidably pass through a pair of solts 695 in the take-up bracket 692. The shaft 690 extends through slots 2691 in the mounts 687. Therefore, by tightening the bolts 693, the mount 687 can be fixedly clamped to the take-up bracket 692 at the desired position. A pair of bolts 696 are threadably mounted in the flange end of the take-up brackets 692 and butt against the ends of the tension and pressure pivot mounts 687, to provide a mechanical adjusting means to the tension and pivot members 687. The take-up brackets 692 are rotatably mounted to the drive shaft 690 by means of a pair of bearings 697. The drive shaft 690 is rotatably mounted in a pair of bearings 698 that are affixed to the top horizontal frames 430 and 431 of the feeder machine framework. Fixedly mounted on the drive shaft 690 is a drive sprocket wheel 701. A pair of idle sprockets 694 (FIG. 25A) are rotatably mounted on the shaft 690. Free ends of the tension and pressure pivot mounts 687 carry a shaft 703 (FIG. 25) which supports a roller 711 over which a belt 705 runs. The shaft 703 is rotatably supported on the pivot mounts 687 by a pair of bearings 704.

The pair of slack adjustment pivot mounts 688 are pivotally mounted to a shaft 706 by means of a pair of bearings 707 fixedly attached to the mounts 688. The shaft 706 is rotatably mounted in a pair of bearings 708 that are fixedly attached to the short vertical frames 570 and 571 by means of a pair of mounting blocks 709. The shaft 706 carries a roller 710 around which a lower belt 712 of the horizontal conveyor 95 runs. The free ends of the slack adjustment pivot mounts 688 carry an idler shaft 715 and a roller 716 around which the belt 705 makes a ninety degree turn. The tension of the belt 705, and consequently the rotation imparted to the slack adjustment pivot mounts 688, are balanced by a spring and chain assembly 718. A portion of the support member 678 has been cut away to expose the assembly 718. One of a pair of anchor mounts 719 is fixedly held to the inboard surface of each of the members 678 and 2678 by a set of four bolts 720.

The foot of one of the mounts 719 (FIG. 25) has been cut away leaving a horizontal portion 2710 thereof shown in section. A vertical hole 2711 (FIG. 25A) in the horizontal portion 2710 of each of the anchor mounts 719 permits clear passage of a pair of spring rods 722. The spring rods 722 are fitted coaxially with a pair of compression springs 724 that are retained on the rods 722 by a pair of nuts 725. The springs 724 are drawn into compression by a pair of chains 727, attached to the upper ends of the rods 722, that pass up and over the idle sprockets 694 and down again to clamp onto the side of the slack adjustment members 688 as shown in FIG. 25 by means of a pair of tie-down clamps 728. Each of the tie-down clamps 728 is rotatably mounted on a stud 2728 mounted in a boss 2729 (FIG. 25A) mounted on one of the mounts 688.

The pair of pick-off pressure mounts 689 is rotatably held on an idler shaft 729 (FIG. 25) by means of a pair of bearings 730 fixedly attached to the mounts 689. The shaft 729 is rotatably held by a pair of bearings 732 that are fixedly attached to the vertical support members 678 and 2678. A roller 2730 is mounted on the shaft 729. The free ends of the members 689 are equipped with an idle roller 733 rotatably mounted on an idler shaft 734 held at its ends by the members 689. The rollers 733 and 2730 support the belt 705. The belt 705 and the roller 733 work opposedly to a pick-off or nip roller 736 rotatably mounted on a driven shaft 737 that is powered by a sprocket 741 fixedly mounted thereto, and that is mounted in line with a sprocket 573 mounted on the shaft 87. The driven shaft 737 is mounted to the horizontal beams 679 by means of a pair of bearings 739.

An appropriate pressure is held between the belt 705 and the pick-off roller 736, and also between the belt 705 and the horizontal conveyor belt 712, which is the entry and exit to the turnover assembly 90, respectively, by means of a tension spring assembly 743. The tension spring assembly 743 comprises a pair of springs 744, a pair of upper anchor blocks 745 hooked to upper ends of the springs 744, and a pair of lower anchor blocks 747 hooked to the bottom ends thereof. The upper anchor blocks 745 are pivotally mounted to the top tension and pressure pivot mounts 687 to the right of the pivot bearings 697. (See FIG. 25). The lower anchor blocks 747 are pivotally mounted near the free ends of the pick-off pressure mounts 689.

The pick-off pressure mounts 689 are restrained from rotating the belt 705 into physical contact with the pick-off roller 736 by means of a pair of bolts 749 and a pair of stops 750. The bolts 749 are threaded into the mounts 689 and the stops 750 are adjustably held in a pair of brackets 752 that are fixedly attached to a cross-frame 2752, which spans the vertical support members 678 and 2678. The belt 705 is held in alignment on the assembly 93 by a pair of lateral rollers 753 rotatably mounted on and held in fixed alignment by a pair of mounting brackets 754 rigidly attached to the cross-frame 2752.

Power is supplied to the turnover assembly by a hydraulic motor 75 mounted on the top horizontal frame member 431 by means of a motor mounting plate 759 rigidly attached thereto. A shaft 2755 of the motor 755 carries a drive sprocket 757 that is in line with the sprocket 701 of the shaft 690. Power is transferred from the sprocket 757 to the sprocket 701 and into the shaft 690 by means of a chain 760. Power is taken from the shaft 690 by means of a take-off sprocket 2762 (FIG. 25A) which drives a chain 762. The chain 762 runs on a sprocket 2763 mounted on the shaft 706 to drive the shaft 706. A sprocket 2764 mounted on the shaft 706 drives a chain 2765 which drives a sprocket 2766 mounted on the shaft 87 to drive the shaft 87. In addition, a sprocket 2768 mounted on the shaft 690 drives a chain 762 which drives the large sprocket 685 to drive the shaft 680 and the drum 91. All the speeds are ratioed and coordinated to cause a stream of cartons to be fed off the top of a stack 9 and over the discriminator plate 651 and under the pick-off roller 736 for entry to the turnover device 90. The stream of carton blanks enters the turnover right side up with the trailing edges of the carton blanks up, and the stream is carried between the belt 705 and the drum 91 to a top position where a doctor plate 765 (FIG. 25) carried by a mounting bracket 2765 supported between the vertical frames 570 and 571 separates the carton blanks from the drum 91 and feeds them onto the horizontal conveyor belt 712, now upside down and trailing edge down.

EXIT CONVEYORS

The horizontal conveyor 95 (FIGS. 1 and 26) transports the procession of cartons horizontally across the top of the lift device 51 (FIG. 1) to a point convenient for descent into the customer machine (not shown in detail). The horizontal conveyor 95 includes a lower belt assembly 767 (FIG. 26) and an upper belt assembly 768. (See FIGS. 19 and 26.)

The lower belt assembly 767 includes longitudinal support frames 769 which support a set of nine belt support rollers 771 rotatably mounted therebetween. The lower belt assembly 767 also includes the roller 710, a mid-roller 773 supported below the axis of the rollers 771, and a bottom pivot roller 774 (FIG. 26). The longitudinal support frames 769 are fixedly attached to the framework of the feeder machine 10 by means of a forward lateral bar 775 that is fixedly attached to the short vertical beams 570 and 571 through a pair of spacers 776 and a rear lateral bar 777 fixedly attached to the vertical rear members 640 through a pair of spacers 778. The drive shaft 706 powers the belt 712 at the turnover end of the horizontal conveyor.

The upper belt assembly 768 comprises a forward pivot mount assembly 779 including forward pivot arms 783 and 2783, and a rear pivot mount assembly 780 including rear pivot arms 792 and 2792. The pivot arms of both pivot assemblies 779 and 780 are pivotally supported by a lateral beam 782 rigidly fixed to the longitudinal members 430 and 431. The forward pivot arms 783 and 2783 are pivotally mounted to a pair of brackets 784 that are fixedly mounted to the lateral member 782, as shown in FIGS. 19 and 26. The free ends of the pivot arms 783 and 2783 pivotally support a large roller 785 and a small roller 787. The small roller 787 has a sufficiently high pivot that a belt 790 of the upper belt assembly 768 comes in gradual contact with the lower belt 712 as the belt 790 passes from the small roller 787 to the large roller 785, thereby capturing and pressing the carton blanks onto the belt 712. The pivot arms 792 (FIG. 26) of the rear pivot assembly 780 are pivotally mounted to a pair of brackets 793 that are fixedly attached to the lateral member 782. These pivot assemblies can swing upwardly as necessary to allow for the thickness of the shingled carton blanks.

The incline conveyor 97 is a continuation of the horizontal conveyor 95. Details of construction thereof are shown in FIGS. 26 and 27. The incline conveyor 97 includes a bottom belt assembly 794 and a top belt assembly 795. The bottom belt assembly 794 includes the pair of main frames 99 and a pair of auxiliary frames 796 fixedly attached thereto. The frames 99 are pivotally mounted on the pivot 101 (FIG. 26), which is supported by a pair of brackets 797 fixedly attached to the rear vertical support members 640. A set of belt support rollers 798 are rotatably attached between the auxiliary frames 796 and are shown in section in FIGS. 26 and 27. The rollers 798 are installed on a slight arc to maintain the stability of the belt 712. The belt 712 returns from a lower or end guide roller 858 (FIG. 27) over a take-up roller 799 (FIG. 26), which is rotatably mounted between slide blocks 2799, one of which is shown in FIG. 26, and over an idle roll 2800 to the roll 774. The slide blocks 2799 are slidably mounted on the frames 99, and each of the slide blocks 2799 is drawn to the left as shown in FIG. 26 by a bolt 2801 pinned thereto. The bolt 2801 is drawn to the left by nuts 2802 threaded thereon and bearing on a cross bar 2803 mounted on guide rails 2804 which guide the slide block 2799.

The top belt assembly 795 comprises a take-up roller mount 801 including an idle roller 800 and a take-up roller 802 rotatably and adjustably mounted therebetween. The lower end portion of the top belt assembly 795 includes an end pivot mount assembly 805. (See FIG. 27). The end pivot assembly 805 includes a pair of pivot mounts 806 pivotally mounted on the frames 99 at pivots 2806. A pair of compression springs 807, one of which is shown in FIGS. 26 and 27, urge the pivot mounts 806 clockwise. Each of the springs 807 is mounted on a spring rod 2807 which is pivotally connected to the associated pivot mount 806. The spring 807 engages nuts 2808 threaded on the spring rod 2807 and a lug 2809 attached to the associated roller mount 801. The spring rod 2807 slides in an opening 2810 in the lug 2809. A pair of pivot arms 808 are pivotally mounted on the pivot mounts 806. A roller 809 is rotatably mounted between the free ends of the pivot arms 808. This provides a tension relief system for the belt 790 while in operation.

The angle of the incline conveyor 97 can be changed by adjusting the pair of turnbuckles 103 (FIGS. 1 and 27). Lower end fittings 2813 (FIG. 27) of the turnbuckles 103 are pivotally connected to lugs 811 mounted on lower end portions of the incline frames 99 (FIGS. 27 and 28). Upper end fittings 2814 (FIG. 27) of the turnbuckles 103 are pivotally connected to the longitudinal frame extensions 104. The angle adjustment of the frames 99 by the turnbuckles 103 essentially adjusts the vertical position of the end of the slide conveyor 98.

The slide conveyor 98 is supported by the frames 99 of the incline conveyor 97. The slide conveyor 98 is comprised of the rail assembly 105 which is attached to the incline conveyor frames 99 and the slide assembly 106 (see FIGS. 27, and 28) which slides therein. The rail assembly 105 provides a pair of cover plates 822, to each of which is attached a top roller rail 823 and a bottom roller rail 824. The cover plates 822 are held in lateral spaced parallelism by being rigidly attached to the incline conveyor frames 99 by means of a pair of spacers 826 (FIG. 28). The slide assembly 106 comprises a pair of side frames 827 held in lateral spaced parallelism by a pair of cross members 828 and 829. A set of sixteen rollers 830 mounted on shafts carried by the side frames 827 cooperates with the roller rails 823 and 824 to permit sliding of the slide assembly upwardly to the left and downwardly to the right, as shown in FIG. 27. A set of nine rollers 832 rotatably mounted between the side frames 827 carry a single unopposed belt 833. The slide assembly 106 is moved relative to the rail assembly 105 by means of the jack screw 108. The jack screw 108 is rotatably mounted in a bearing block 837 (FIG. 27) affixed to a slide assembly cross member 838, and threadably mounted in a thread block 839 affixed to a rail assembly cross member 840 which is the fixed part and is attached to the rail assembly 105. The purpose of this arrangement is to vary the longitudinal dimension of the feeder machine 10. Therefore, the longitudinal and vertical adjusting features of the output end of the feeder machine 10 provides a means whereby the feeder machine 10 can be adjusted to the input section of a customer machine without changing the position of the entire feeder machine 10. The terminus of the slide conveyor 98 carries the final shingler 110 (FIG. 27) to adjust the percent overlap in the procession of cartons exiting the incline conveyor 97. Also, an end jogger assembly 850 (FIG. 28) is provided to keep the cartons from hanging to each other as they exit the machine 10.

FIG. 29 schematically indicates how power is distributed to the incline conveyor 97, the slide conveyor 98, and the final shingling assembly 110. It is a view taken on approximately the same line as FIG. 27 but excluding all the details save for the power assembly. Referring to FIG. 28, a hydraulic motor 851 drives a sprocket 852 on which a chain 853 runs. The chain 853 also runs on a sprocket 855 which is attached to a shaft 857. Fixedly mounted on the shaft 857 is the roller 858 (FIG. 29) that is the end roller for the belt 712. Therefore, power is delivered to the belt 712 by the motor 851 at the bottom of the incline conveyor 97 and at the other end of the conveyor by the turnover motor 755 (FIG. 25). A power take-off sprocket 859 (FIG. 29) is fixedly attached to the shaft 857, and delivers motive power to a slide conveyor chain 860. A pair of idler sprockets 862 are rotatably mounted on the rail assembly cover plates 822 close to the shaft 857 to provide the chain 860 proper tension regardless of the position of the slide assembly 106. The chain 860 passes around a drive sprocket 864 fixedly attached to a shaft 865 providing power thereto for movement of the slide conveyor belt 833 (FIG. 27). The chain 860 (FIG. 29) also passes around a sprocket 866 delivering direct power to a shaft 867. A power take-off sprocket 869 is fixedly attached to the shaft 867 and delivers power to a sprocket 870 and its shaft 871. A roller 872, mounted fixedly to the shaft 871, delivers power to a final shingler belt 873.

The final shingler belt 873 also runs on an idle roll 876 (FIG. 27), an idle roll 877 rotatably mounted between pivot arms 878, an idle roll 879 rotatably mounted between pivot arms 881, and an idle roll 882 rotatably mounted between pivot arms 883. The shaft 871 and the idle roll 876 are rotatably mounted between upright frames 886, which are attached to the side frames 827. The pivot arms 878 and 881 are pivotally mounted on the upright frames 886. Ends of the pivot arms 878 and 881 can rest on the side frames 827 to limit downward swinging thereof. However, the pivot arms 878 and 881 can swing upwardly to permit passage of shingled cartons between the belts 873 and 833. The pivot arms 883 are pivotally mounted at outer ends of the pivot arms 881 and are urged to the left as shown in FIG. 27 by compression springs 889 to put tension on the belt 873. The mountings for the springs 889 are similar to the mountings of the springs 807, already described in detail hereinabove, and include spring rods 891, each of which is pivotally connected to one of the pivot arms 883 and slides through an opening 892 in a guide lug 893 mounted on an associated pivot arm 881.

The belts 833 and 873 discharge the cartons over discharge rollers 894 (FIGS. 27 and 30) which are mounted on a shaft 896 rotatably mounted in bearings 897 (FIGS. 28 and 30) mounted on the side frames 827. As shown in FIG. 29, the shaft 896 carries a drive sprocket 898 on which a chain 899 runs. The chain 899 is driven by a sprocket 901 mounted on the shaft 867. A jogger box 902 (FIGS. 27 and 30) is supported on the shaft 896 on bearings 903 (FIGS. 28 and 30) attached to end plates 904 of the jogger box 902. A cross plate 9031 (FIG. 30) of the jogger box 902 carries teeth 905 which extend between the discharge rollers 894. The jogger box 902 is caused to oscillate or swing back and forth through a small angle by rods 906 pivotally attached to the end plates 904. Each of the rods 906 is attached to a jogger plate 907. An eccentric drive unit 908 (FIG. 27) mounted in the jogger plate 907 is mounted on a shaft 911 rotatably mounted between plates 912 which are attached to and extend downwardly from the side frames 827. The shaft 911 carries a sprocket 913 on which a drive chain 914 runs. The drive chain 914 also runs on a sprocket 916 driven by a motor 917. The motor 917 drives gearing (not shown) in a gear box 918 to drive the sprocket 916. As cartons 921 are discharged over the discharge rollers 894, they fall to an appropriate table 919 (shown schematically), and the jogger box 902 swings back and forth through a small angle as the cartons fall to the table 919 to straighten the cartons 921 as they are discharged.

OPERATION

The operation of the machine will now be described in greater detail with reference to FIGS. 31 and 32, which show electrical connections of the crane controlling portion of the machine, FIG. 33 which shows electrical connections of the elevator-feeder portion of the machine, and FIG. 34, which shows hydraulic connections of the machine.

Electric power is supplied through power leads 1001 and 1002 (FIGS. 31 and 33) across which an appropriate alternating current voltage is impressed. Main on-off switches 996, 997 (FIG. 31), 998, and 999 (FIG. 33) can be provided in the power leads. The crane controlling section of the machine is energized by closing of a push button switch 1003 (FIG. 31), which energizes a control relay RlC closing contacts RlCl thereof to connect a lead 1004 to the power lead 1001. The crane section can be de-energized by opening of a push button switch 1006 to de-energize the control relay RlC. A warning lamp 1007 is lighted when the control relay RlC is energized. The elevator-feeder portion of the machine (FIG. 33) is energized by closing of a push button switch 1008 to energize a control relay RlF to close contacts RlFl thereof to connect a lead 1009 to the power lead 1001. The elevator-feeder portion of the machine is de-energized when a push button switch 1011 is opened to de-energize the control relay RlF. Photocell lamps PC-lF, PC-2F and PC-3F, which are connected across the power leads 1001 and 1002, remain illuminated even when the control relay RlF is de-energized. A warning lamp 1012 is illuminated when the control relay RlF is energized. When an on-off switch 1013 is closed, a hydraulic system powering motor 1014 is energized and a warning lamp 1016 is illuminated. The motor 1014 drives a pump 1015 (FIG. 34) to supply hydraulic fluid under pressure from a sump 1017 to a pressure line 1018. Hydraulic fluid returns to the sump through a return line 1019. When the machine is in automatic operation, a hopper on-off switch 1020 (FIG. 33) is disposed in its on (other) position. Closing of the switch 1020 energizes the motor 917 to actuate the jogger box 902 (FIG. 27).

Reference is now made to FIGS. 31 and 32 for details of the crane controlling circuit. The crane is controlled by a stepping switch 1021 (FIG. 31) having a first deck 1021A and a second deck 1021B which turn together and by a sequentially stepping control programmer 1023, which can be of the type known as a Tenor Model 2410 Programmer. The program of the programmer 1023 is shown in FIG. 32.

The programmer includes a series of steps indicated A–X in FIG. 32. As the programmer is stepped, it operates switches which are numbered 1–22. These switches are indicated in FIG. 31 with the prefix P. When a lead 1024 (FIG. 31) is energized, the programmer advances a single step. When a lead 1026 is energized, the programmer can advance step by step until the lead 1026 is de-energized. When the programmer is advancing, a lead 1028 thereto is connected to a lead 1029 to energize a relay R2C to open contacts R2C1, de-energizing a lead 1030 so that motor windings 155, 210R, 210L, 230F and 230R cannot be energized, which the programmer is stepping.

The machine has been illustrated with three columns of stacks 9 on the pallet 13 (FIG. 2) arranged in two rows. For such operation, a stack selector switch 1031 (FIG. 31) is disposed in the position shown at which leads 1032 and 1033 are connected together to connect selected contacts of the first deck 1021A of the stepping switch 1021. If only two columns of stacks are on the pallet 13, the stack selector switch 1031 is positioned so that leads 1034 and 1032 are connected together as well as the leads 1032 and 1033. If four columns of stacks are positioned on the pallet, the stack selector switch 1031 is disposed in a third position in which the leads 1032, 1033, and 1034 are not connected. When four columns of stacks are on a pallet, an additional limit switch LS-4C (FIG. 31) can be disposed on the slide bar 222 (FIG. 8) between the limit switches LS-3C and LS-5C with the positions of the limit switches adjusted for the positions of the stacks, LS-4C being disposed opposite the fourth column of stacks.

A hand-automatic on-off switch 1036 (FIG. 31) having contacts 1036A, 1036B, 1036C, 1036D and 1036E is in the position shown during automatic operation of the machine, and contacts 1036B thereof connect a lead 1037 to the lead 1004. When the switch 1036 is in its other position for hand operation, the lead 1004 is connected to a lead 1038 by the switch contacts 1036A, and a single step push button switch 1039 can be closed to energize the lead 1024 to cause hand controlled stepping of the programmer 1023.

The home position of the crane 15 is indicated at 245 in FIG. 2, as has already been explained, and, when the crane is at this home position, it carries a stack and is in raised position. When the programmer is at its home position, home contacts PH1 and PH2 (FIG. 31) are in their other position. When the machine is ready for the crane to be advanced from the home position, the limit switch LS-14C (FIGS. 2, 10, and 31) is closed to indicate that the stack straightening device 40 is clear, and the limit switch LS-8C (FIGS. 10, 15, and 31) is closed to show that the stack which had been on the stack straightening device has reached the holding or standby table 48. Contacts LS-12C1 of the limit switch LS-12C are closed to indicate that the crane is in position to be advanced laterally to the deposit position overlying the deposit table 36, and the contacts PH1 of the programmer home position are closed to energize the lead 1026 causing advance of the programmer to step A (FIG. 32). When the programmer is at step A, the home contacts PH1 and PH2 (FIG. 31) return to the position shown and the programmer advances only a single step.

When the programmer is at step A, contacts P4 and P15 are closed. Closing of contacts P4 energizes a right drive winding 210R of the motor 210 (FIGS. 1 and 2) to advance the crane to the deposit position overlying the deposit table 36. When the crane reaches the deposit position, contacts LS-5C1 of the limit switch LS-5C are closed completing a circuit through the contacts P15 to a control relay R4 closing relay contacts R4A to energize the lead 1024 causing advance of the programmer 1023 to step B. Energizing of relay R4 also opens contacts R4B thereof to de-energize the circuits to the motor winding 210R, 210L, 230F, and 230R.

When the programmer is at step B, contacts P8 and P22 (FIG. 31) are closed. Closing of the contacts P8 energizes the motor 155 (FIGS. 5, 6, and 7) which operates until the limit switch LS-6C, which is in series with the contacts P22, closes to indicate that the crane 15 is in lowered position as shown in FIG. 5. When the limit switch LS-6C closes, the control relay R4 (FIG. 31) is energized causing the programmer to step to step C. When the crane 15 is in lowered position at the deposit station, as shown in FIG. 10, the limit switch LS-1F is actuated to close contacts LS-1F2 (FIG. 33) thereof energizing a reverse winding 280R of the motor 280 (FIG. 10) of the deposit table to cause advance of the belts 37 toward the stack straigtening device 40. Actuation of the limit switch LS-1F also opens contacts LS-1F2 (FIG. 33) thereof to prevent engaging of the forward winding 280F of the motor 280 while the crane is down at the deposit position.

When the programmer is at step C (FIG. 32), contacts P9 are closed to energize a time delay relay TD1 (FIG. 31). When there has been a sufficient time delay for the stack to clear the crane as the belts 37 advance the stack, contacts TD1A of the time delay relay TD1 close to energize the lead 1024 causing the programmer to step to step D.

When the programmer is at step D, the contacts P8 and P21 (FIG. 31) are closed. Closing of the contacts P8 energizes the motor 155 to advance the crane 15 upwardly until contacts LS-7C1 of the limit switch LS-7C (FIG. 5) close to energize the control relay R4 (FIG. 31) causing the programmer to advance to step E.

When the programmer is at step E, the contacts P5 and P17 are closed. Closing of the contacts P5 energizes the motor winding 210L to advance the crane from the deposit position to the home position 245 (FIG. 2). The circuit to the motor winding 210L (FIG. 31) is through motor winding relay contacts 210R1 which are closed when the motor 210R is de-energized and through relay contacts R5A of a control relay R5, which is energized when the contacts of the limit switch LS-15C (FIGS. 2 and 9) are closed to indicate that the crane is at the line between the home and deposit positions and the limit switch contacts LS-7C2 (FIG. 31) of the limit switch LS-7C (FIG. 5) are closed to indicate that the crane is up. When the crane reaches the home position 245 (FIG. 2) the limit switch LS-1C (FIG. 8) is actuated to close contacts LS-1C1 (FIG. 31) thereof energizing the control relay R4 to advance the programmer to step F. Closing of contacts LS-1C2 of the limit switch LS-1C make possible energizing of the motor winding 230F when the programmer contacts P6 close at a later step.

When the programmer is at step F, the contacts P8 and P22 are closed and contacts P10 are actuated. Closing of contacts P8 and P22 causes lowering of the crane to its lower position as explained at step B. Contacts P10 include a normally closed set of contacts P10A (FIG. 31) and a normally open set of contacts P10B. If, during operation of the crane through steps A–E, there is a failure, as if a stack is knocked off or dropped, it may be desirable to bring the programmer to step F without stopping at the other steps. When the hand-automatic on-off switch 1036 is in its other position and the contacts P10A are closed, closing of the contacts 1042A of a lift reset push button switch 1042 energizes the lead 1026 to cause continuous stepping of the programmer until the contacts P10B open as the programmer reaches step F. When the programmer reaches step F, a warning lamp 1044 is lighted through contacts P10B and switch contacts 1042B of the switch 1042. When the limit switch LS-6C is closed to indicate that the crane is down, the relay R4 is energized to advance the programmer to step G.

When the programmer is at step G, programmer switch contacts P7 and P19 are closed. In addition, the programmer switch P2 is actuated. The programmer switch P2 includes normally closed contacts P2A and normally open contacts P2B. The operation at this stage is also controlled by the stepping switch 1021. When the stepping switch 1021 is in the home position shown, contacts 1021L thereof are open, and opening of the contacts P2A prevents energizing of the motor windings 210R, 210L, 230F, and 230R. Closing of the contacts P2B completes a circuit through the deck 1021B of the stepping switch 1021 to energize the lead 1026 to cause continuous stepping of the programmer until the contacts P2B open again, and the programmer advances to step H. At step H, the contacts P2 are again actuated and, in a similar manner, the programmer advances to step I.

When the programmer is at step I, the programmer contacts P7 and P20 are closed. Closing of the contacts P7 energizes the motor winding 230R to cause the motor 230 (FIG. 2) to advance the crane toward the pallet 13. The motor winding 230R (FIG. 31) is in series with motor relay contacts 230F1 of the winding 230F, which are closed when the winding 230F is deenergized. In addition, the winding 230R is in series with contacts of LS-13C (FIG. 5) which open if the crane 15 hits a reject object such as a pallet, and with contacts LS-5C2 (FIG. 31) of the limit switch LS-5C (FIG. 8) (which indicates the crane is in deposit position). As the crane moves away from the home position toward the pallet and passes the index position, the limit switch LS-16C (FIGS. 2, 8, and 9) moves to its closed position. The motor winding 230R is energized until the limit switch LS-10C (FIG. 5) is actuated to indicate a stack is on the crane or until the limit switch LS-11C (FIG. 2) is actuated to indicate the limit of crane travel. When one of the limit switches LS-10C and LS-11C is actuated, the relay R4 (FIG. 31) is energized to advance the programmer to step J.

When the programmer is at step J, the programmer contacts P8 and P21 are closed, and the motor 155 operates to raise the crane until the limit switch LS-7C (FIG. 5) is actuated to close the contacts LS-7C1 (FIG. 31) thereof energizing the relay R4, in the same manner as explained at step D, to advance the programmer to step K.

At the steps K and L, programmer contacts P2 are closed and the programmer advances to step M in the manner explained at step G.

When the programmer is at step M, the programmer contacts P6 and P18 are closed. Closing of the contacts P6 energizes the motor winding 230F to advance the crane toward the home position. The motor winding 230F is in series with motor relay contacts 230R1, which are closed when the winding 230R is de-energized. The motor winding 230F is energized until the crane reaches the home position at which the contacts LS-12C2 of the limit switch LS-12C (FIG. 2) close to energize the relay R4 (FIG. 31) to advance the programmer to step N.

At step N, and the succeeding steps, programmer contacts P1 are closed to energize the lead 1026 causing advance of the programmer until the contacts PH2 open to indicate that the programmer is at home position. As the programmer is advanced to step O, the programmer contacts P3 are closed energizing the stepping switch 1021 to advance the stepping switch decks one step counterclockwise. The circuit for actuating the relay 1021 is a direct current circuit for which current is rectified by a rectifier 1046. A condenser 1047 is charged by the rectifier 1046 and discharges through the relay of the stepping switch 1021 when the contacts P3 close. Stepping switch contacts 1048 and 1049 open when the stepping switch advances to prevent inadvertent multiple steps. The stepping switch 1021 can be stepped manually by closing a push button switch 1051. Stepping switch contacts 1052 and 2052 open when the stepping switch is at the home position shown. When the stepping switch is away from the home position, it can be returned to home position by closing of a switch 1053. Resistors 1054 and 1055 and a condenser 1056 protect the stepping switch relay.

The operation of the crane next is repeated through steps A–F inclusive. When the programmer reaches step G, stepping switch contacts 2052 are closed as these contacts are only open when the stepping switch 1021 is at home position, and the contacts 2052 bypass the contacts P2A. In addition, the deck 1021B is no longer connected to the contacts P2B, and operation of the programmer contacts P2 has no effect. At step G, contacts P7 and P19 are closed. Closing of the contacts P7 energizes the winding 230R to cause advance of the crane toward the pallet until the limit switch contacts LS-9C1 close as the crane reaches the index longitudinal position 251 (FIG. 2) to energize the relay R4 (FIG. 31) causing the programmer to advance to step H. Closing of the contacts LS-9C2 of the limit switch LS-9C energizes the relay R5 to close contacts R5A and R5B thereof.

When the programmer is at step H after the stepping switch 1021 has advanced from home position, closing of programmer contacts P4 and P16 is effective. Closing of the contacts P4 energizes the winding 210R to advance the crane at the index position line laterally. The deck 1021B connects the limit switch LS-2C to the lead 1037. When the limit switch LS-2C closes to indicate the crane is opposite the second column of stacks on the pallet, the relay R4 is energized to cause the programmer to advance to step I. The operations at steps I and J are repeated as already explained, the crane advancing to the pallet to a position for pick-up of the first stack in the second column at step I and raising the stack at step J.

When the programmer is at step K after the first stack in the second column has been picked up, closing of the programmer contacts P6 and P19 is effective. Closing of the contacts P6 energizes the motor winding 230F to cause advance of the crane away from the pallet. The crane advances until contacts LS-9C1 close to indicate the crane is at the index position line to energize the relay R4 and cause advance of the programmer to step L. When the programmer is at step L, closing of the contacts P5 and P17 is effective. Closing of the contacts P5 energizes the motor winding 210L to advance the crane laterally toward the home position. When the crane reaches a position aligned with the home position, limit switch contacts LS-1C1 of the limit switch LS-1C are closed to energize the relay R4 causing advance of the programmer to step M. When the programmer is at step M, the crane is returned to the home position and operations continue through the subsequent steps as already explained with the exception that, at step O, closing of the programmer switch P3 causes advance of the stepping switch to the next succeeding position so that on the succeeding cycle the crane picks up the first stack in the third column of stacks, and actuation of the limit switch LS-3C determines the position at which the crane advances from the index position line to pick up the stack. On the next succeeding cycle, when the stepping switch is advanced to a further position, the stepping switch deck 1021A is connected to the lead 1033, which is connected through the switch 1031 to the lead 1032 so that the capacitor 1047 is discharged through the relay of the stepping switch 1021 by way of the deck 1021A, and the stepping switch advances a further position. Other positions on the stepping switch deck 1021A are connected together so that the stepping switch advances until it reaches the home position. The position of the switch 1031 determines the number of stacks which are picked up before the stepping switch returns to home position and the first stack in the second row on the pallet, and the other stacks in the second row are picked up in order.

When the hand-automatic switch 1036 is in its other or hand operated position, the motor windings 210R, 210L, 230F, 230R, and 155 can be energized by closing push button switches 1061, 1062, 1063, 1064, and 1066, respectively, to advance the crane under hand control.

As has already been pointed out, when the crane 15 is lowered at the deposit position as shown in FIG. 10, the limit switch LS-1F is actuated to close contact LS-1F1 thereof (FIG. 33) energizing the reverse winding 280R of the motor 280 (FIG. 10) to advance the stack toward the tip-over and stack straightening device 40. The circuit to the reverse winding includes contacts of a three position switch 1071 and contacts PC2A of the photocell PC2 (FIG. 10). When the beam of the photocell PC2 is broken, the contacts PC2A (FIG. 33) open to de-energize the reverse winding 280R and stop advance of the stack toward the stack straightening device 40 (FIG. 10). When the switch 1071 is in the position shown, the motor 280 is controlled automatically. The switch 1071 can be advanced to an intermediate off position where neither of the windings of the motor 280 can be energized and to a third position at which the switch contacts LS-1F1 are bypassed by a lead 1072 to permit hand control of the reverse winding 280R. When the motor winding 280R is energized, a motor relay 280R1 is energized to prevent energizing of the forward winding 280F and a motor relay 280R2 is energized to permit continuing of the energizing of the motor winding 280R after the limit switch LS-1F returns to its normal position.

When the beam to the photocell PC2 is broken, contacts PC2B thereof close to energize a control relay R12 and a tip-over solenoid 1074. The circuit to the control relay R12 includes normally open motor relay contacts 280R3 of the winding 280R, which are closed when the motor winding 280R is energized and open only after sufficient delay to permit energizing of the control relay R12 as the beam of the photocell PC2 is broken.

Energizing of the control relay R12 closes hold-in contacts R12A thereof and closes contacts R12B thereof to complete the circuit to a solenoid 1074. Energizing of the control relay R12 also opens contacts R12C thereof to prevent energizing of a tip-over return solenoid 1076 until the relay R12 is de-energized.

Energizing of the tip-over solenoid 1074 advances a valve 1077 (FIG. 34) to the right to direct pressure fluid through a line 1078 to the cylinders 308 (FIG. 10) to cause retraction of the rods 310 to swing the stack straightening device 40 from the upright position of FIG. 10 to the lowered position shown in FIG. 11 and in dot-dash lines at 40A in FIG. 2. Fluid returns from the cylinders 308 (FIG. 34) through a line 1079. Throttle check valve units 1081 in the lines 1078 and 1079 permit control of the speed of advance of the piston rods 310. A pressure operated pilot valve 1082 in the line 1079 and actuated by pressure in the line 1078 permits lowering of the stack straightening device when there is positive pressure in the line 1078 but prevents lowering at other times.

When the stack straightening device 40 reaches lowered position, the limit switch LS-6F (FIG. 12) is actuated to close contacts LS-6F1 (FIG. 33) thereof energizing a time delay relay TD-11 and opening contacts LS-6F2 thereof to de-energize the control relay R12. The time delay relay TD11 permits a time delay after the stack straightening device has been lowered for removal of badly formed cartons and the like from the stack 9 (FIG. 11). A three-pole manual-automatic on-off switch 1083 (FIG. 33) can be positioned as shown when the machine is in automatic mode of operation or can be positioned in its other position for manual operation of raising of the stack straightening device. When the switch 1083 is in the automatic mode of operation shown, closing of contacts TD11A of the time delay TD11 energizes a clamp solenoid 1086 to move a valve 1087 (FIG. 34) to its other position to direct fluid from the pressure line 1018 along a line 1088 to the cylinders 369 to cause retraction of the piston rods 370 to draw the side clamps 42 (FIG. 12) inwardly to straighten and position the stack. Opening of contacts TD11B (FIG. 33) of the time delay relay TD11 prevents energizing of the tip-over return solenoid 1076 in automatic mode until the limit switch LS-12F is actuated. When the side clamps 42 are in their closed position, the limit switch LS-12F (FIG. 12) is actuated to close the contacts thereof (FIG. 33) energizing the tip-over return solenoid 1076. Energizing of the solenoid 1076 advances the valve 1077 (FIG. 34) to the left so that pressure fluid is directed along the line 1079 to the cylinders 308 to cause raising of the stack straightening device 40, the fluid returning through the line 1078. When the stack straightening device 40 (FIG. 12) has started up, the limit switch LS-6F is released to permit opening of contacts LS-6F1 (FIG. 33) thereof de-energizing the time delay relay TD11 to open contacts TD11A and de-energizing the solenoid 1086. When the solenoid 1086 is de-energized, the valve 1087 (FIG. 34) returns to the position shown at which pressure fluid is directed along a line 3088 to the cylinders 369 to cause release and opening of the side clamps 42, as shown in FIG. 12. When the switch 1083 (FIG. 33) is in the manual mode (other) position, actuation of a push button switch 1091 causes energizing of the clamp solenoid 1086.

When the stack straightening device 40 has been raised to upright position, the stack 9 remains adjacent the position shown in FIG. 10 until the beam of the photocell PC1 (FIG. 15) is cleared by the next preceding stack to close contacts PC1A (FIG. 33) thereof energizing the forward winding 280F to advance the stack to the right as shown in FIGS. 10 and 15. Energizing of the forward winding 280F closes motor relay contacts 280F1 and opens motor relay contacts 280F2. When the beam of the photocell PC1 is cleared, contacts PC1B of the photocell PC1 are closed making possible energizing of a control relay R18 when contacts LS-5F1 of the limit switch LS-5F (FIG. 16) are closed. In addition, when the beam of the photocell PC1 is cleared, contacts PC1C and PC1D thereof open. When the fork elevator 52 (FIG. 16) moves away from its lowered position, the limit switch contacts LS-5F1 close to energize the control relay R18 and the contacts LS-5F2 and LS-5F3 of the limit switch LS-5F open.

When the control relay R18 is energized, contacts R18A thereof close to energize the motor 385, which drives the belts 49 (FIG. 15), to advance the stack on the holding table 48. When the relay R18 is energized, contacts R18B thereof open and hold-in contacts R18C close. The stack advances on the belts 49 at least until it reaches the position 420 of FIG. 15 at which the beam of the photocell PC1 is broken to open the contacts PC1B (FIG. 33) de-energizing the control relay R18 to stop advance of the belts 49 (FIG. 15). When the next preceding stack has been raised sufficiently that the tongue elevator 58 is above the top of the stack at the position 420, the limit switch LS-3F (FIG. 18) is swung from the open position shown in FIG. 33 to closed position to energize a control relay R19 to close contacts R19A, R19B, and R19C thereof. When the fork elevator 52 (FIG. 15) reaches its lowered position, the limit switch LS-5F is again actuated to close contacts LS-5F2 (FIG. 33) and open contacts LS-5F1, and to close contacts LS-5F3 thereof. At this time contacts PC3A of the photocell PC3 are closed and closing of the contacts LS-5F2 energizes the control relay R18 again causing further advance of the belts 49 (FIG. 15) until the stack reaches the position 9 of FIG. 15 as the trailing side of the stack clears the beam of the photocell PC3. The circuit to the control relay R18 is kept energized by contacts PC3B of the photocell PC3 and the hold-in contact R18C until both of the beams of the photocells PC1 and PC3 have been restored, whereupon the control relay R18 is de-energized. The motor 385 can be manually energized by closing a push button switch 8385.

De-energizing of the control relay R18 also closes the contacts R18B thereof energizing a control relay R15. Energizing of the control relay R15 closes contacts R15A thereof to energize a rapid traverse up solenoid 1092 to advance a rapid traverse valve 1093 (FIG. 34) to the right to direct pressure fluid from the pressure line 1018 through a line 1094 and permitting return through a line 1096. Energizing of the control relay R15 also closes hold-in contacts R15B (FIG. 33) and opens contacts R15C thereof.

As the tongue elevator 58 (FIG. 18) is being raised, the limit switch LS-7F is actuated to indicate that the tongues 69 are in advanced position closing the contacts thereof as shown in FIG. 33 and energizing a control relay R13. Energizing of the control relay R13 opens contacts R13A thereof to de-energize solenoids 1101 and 1102 and closes contacts R13B and R13C thereof. Closing of the contacts R13B energizes solenoids 1103 and 1104. Energizing of the solenoids 1103 and 1104 advances valves 1106 and 1107 (FIG. 34) to their alternate positions so that pressure fluid from the line 1094 is directed along a line 1108 into the upper portions of the fork lift cylinders 66 causing rapid raising of the forks 60 and causing rapid raising of the stack, the fluid returning through a line 1109. A pilot operated check valve 1110 in the line 1108 prevents lowering of the fork elevator except when there is a positive pressure in the line 1109. The stack is rapidly raised until the upper portion of the stack on the forks 60 (FIG. 18) engages the Z-shaped arm 560 and the limit switch LS-9F is actuated to energize a control relay R16 (FIG. 33). Energizing of the control relay R16 opens contacts R16A and R16B and closes contacts R16C thereof. Closing of the contacts R16C energizes a solenoid 1111 to move a valve 1112 (FIG. 34) to its other position to direct pressure fluid through a line 1113 to the tongue cylinders 73, the fluid returning through a line 1114 to cause retraction of the tongues 69 (FIG. 18). When the tongues 69 have been retracted, the limit switch LS-8F is actuated closing the contacts thereof to energize a control relay R14 closing contacts R14A and R14B thereof. Closing of the contacts R14A energizes the solenoids 1101 and 1102 to move the valves 1106 and 1107 to the position shown.

When the valves 1106 and 1107 are in the position shown, fluid under pressure can be directed to the fork lift cylinders 56 through the microtorque valve 643. As the machine requires the stack to be raised, the frame 83 (FIG. 23) swings clockwise about the shaft 87 causing the control arm 646 to swing clockwise as shown in FIG. 23, counterclockwise as shown in FIG. 34, to direct pressure fluid through a line 1117 to the line 1108 causing raising of the forks, the fluid returning through line 1109 and a line 1118. When the stack on the forks is sufficiently raised to raise the frame 83 to bring the control arm 646 back counterclockwise, as shown in FIG. 23 to the position shown in FIG. 18, raising of the forks is stopped until further raising of the stack is required, and the forks continue to rise as required under control of the microtorque valve 643 until the switch LS-10F (FIGS. 16 and 18) is actuated to indicate that the forks are at the top of their stroke. Actuation of the switch LS-10F closes contacts LS-10F1 (FIG. 33) and opens contacts LS-10F2 thereof. Closing of the contacts LS-10F1 energizes a solenoid 1121 to advance the valve 1112 to the position shown causing advance of the tongues 69 (FIG. 17) under the portion of the stack remaining on the forks. When the tongues have been advanced, the limit switch LS-7F (FIG. 33) is actuated to energize the control relay R13 (FIG. 33).

Energizing of the control relay R13 closes the contacts R13B energizing the solenoids 1103 and 1104. Energizing of the solenoids 1103 and 1104 advances the valves 1106 and 1107 (FIG. 34) to their other positions at which pressure from the microtorque valve 643 and the line 1117 is directed along a line 1122 to the upper ends of the tongue elevator lift cylinders 62 (FIG. 18), the fluid returning through a line 1123 and the line 1118, and the tongue lift is raised under control of the microtorque valve 643. A pilot operated check valve 1124 in the line 1122 prevents downward movement of the tongue elevator except when there is a positive pressure in the line 1123. Energizing of the relay R13 (FIG. 33) also closes contacts R13C to energize a solenoid 1126 moving the valve 1093 (FIG. 34) to the left to direct pressure fluid through the line 1096 and the line 1109 to the lower ends of the fork elevator cylinders 56 to cause rapid lowering of the fork elevator.

The pressure in the counterbalance cylinder 635 (FIGS. 23 and 34) is controlled by an adjustable pressure reducing and relieving valve 1031 (FIG. 34) in a line 1032 connecting the pressure line 1018 to the upper portion of the cylinder 635. The motors 851 (FIG. 28) and 755 (FIG. 25) are hydraulically driven as shown in FIG. 34 and the flow of fluid from the pressure line 1018 to the motors 851 and 755 is controlled by an infinite position control valve 1033, which can be adjusted to drive the motors 851 and 755 at the rate required for deliver of carton blanks as required to the machine to which the carton blanks are delivered. A shutoff valve 1036 is provided in a line 1037 which supplies the pressure fluid to the valve 1033.

The machine transfers stacks of articles from the pallet 13 (FIG. 2) to the deposit table 36. At the deposit table, each stack is advanced in turn to the stack straightening device 40. Then each stack is advanced to the fork and tongue elevators which raise the stack against the pick-off belts 80 (FIG. 23) which direct the flat articles of the stack shingle fashion around the drum 91 (FIG. 25) to be discharged downwardly and to the right as shown in FIG. 1.

The machine illustrated in the drawings and described above is subject to structural modification without departing from the spirit and scope of the appended claims.

Having described our invention, what we claim as new and desire to secure by letters patent is:

1. In combination with a conveyor having spaced conveyor belts, a machine for straightening and positioning a stack of articles on the conveyor which comprises a tip-over device swingably mounted at a tip-over station on the conveyor, the tip-over device including fingers which extend between the belts when the tip-over device is in upright position, stack supporting means extending substantially perpendicular to the fingers, and a stack catching member mounted at the outer end of the stack supporting means extending transversely of the stack supporting means on the same side thereof as the fingers, the stack catching member engaging the face of the stack remote from the fingers when the tip-over device is in tipped over position, the stack catching member being spaced from the fingers a distance greater than the height of the stack, means for advancing the conveyor to bring the stack to the tip-over station, means for swinging the tip-over device so that the fingers pick up the stack from the belts and swing the stack against the stack supporting means as the tip-over device is tipped to a position in which the stack supporting means is substantially horizontal so that the stack falls against the stack catching member and the articles in the stack are free to move crosswise of each other, the stack supporting means supporting the stack free of the conveyor, clamps supported on the tipover device on opposite sides of the stack supporting means and engageable with the sides of the articles of the stack, means for drawing the clamps toward the stack supporting means to engage the articles in the stack to align the articles with each other and to center the stack, means for returning the tip-over device to upright position to return the stack to the belt conveyors when the stack has been straightened and positioned and means for advancing the conveyor in an opposite direction to remove the stack from the tip-over station.

2. A combination as in claim 1 in which the machine includes means for releasing the clamps when the tip-over device returns the stack.

3. A combination as in claim 1 wherein the stack supporting means includes spaced parallel rotatably mounted rollers which extend perpendicularly to the fingers.

4. In combination with a conveyor having spaced conveyor belts, a machine for straightening and positioning a stack of articles on the conveyor which comprises a tip-over device swingably mounted at a tip-over station on the conveyor, the tip-over device including fingers which extend between the belts when the tip-over device is in upright position, stack supporting roller means extending substantially perpendicular to the fingers and a stack catching member mounted at the outer end of the stack supporting means extending transversely of the stack supporting means on the same side thereof as the fingers, the stack catching member engaging the face of the stack remote from the fingers when the tip-over device is in tipped over position, the stack catching member being spaced from the fingers a distance greater than the height of the stack, clamps supported on the tip-over device on opposite sides of the stack supporting means and engageable with the sides of the articles of the stack, means for advancing the conveyor to bring the stack to the tip-over station, means for swinging the tip-over device so that the fingers pick up the stack from the belts and swing the stack against the stack supporting roller means as the tip-over device is tipped to a position in which the stack supporting means is substantially horizontal so that the stack falls against the stack catching member and the articles in the stack are free to move crosswise of each other so that sides of articles in the stack can be engaged by said clamps to align the articles with each other and to center the stack, the stack supporting roller means supporting the stack free of the conveyor, means for returning the tip-over device to upright position to return the stack to the belt conveyors when the stack has been straightened and positioned and means for advancing the conveyor in an opposite direction to remove the stack from the tip-over station.

5. A combination as in claim 4 in which the machine includes means for releasing the clamps when the tip-over device returns the stack.

* * * * *